US008709989B2

(12) United States Patent
Yagishita

(10) Patent No.: US 8,709,989 B2
(45) Date of Patent: Apr. 29, 2014

(54) LUBRICANT COMPOSITION AND ANTIOXIDENT COMPOSITION

(75) Inventor: Kazuhiro Yagishita, Yokohama (JP)

(73) Assignee: Nippon Oil Corporation, Tokyo (JP)

( * ) Notice: Subject to any disclaimer, the term of this patent is extended or adjusted under 35 U.S.C. 154(b) by 797 days.

(21) Appl. No.: 11/665,744

(22) PCT Filed: Oct. 19, 2005

(86) PCT No.: PCT/JP2005/019232

§ 371 (c)(1),
(2), (4) Date: May 12, 2008

(87) PCT Pub. No.: WO2006/043606

PCT Pub. Date: Apr. 27, 2006

(65) Prior Publication Data

US 2008/0274922 A1 Nov. 6, 2008

(30) Foreign Application Priority Data

Oct. 19, 2004 (JP) ..... 2004-304639
Oct. 19, 2004 (JP) ..... 2004-304653
Oct. 19, 2004 (JP) ..... 2004-304659
Oct. 19, 2004 (JP) ..... 2004-304666
Oct. 19, 2004 (JP) ..... 2004-304692
Oct. 19, 2004 (JP) ..... 2004-304698

(51) Int. Cl.
*C10M 139/06* (2006.01)

(52) U.S. Cl.
CPC ..... *C10M 139/06* (2013.01); *C10M 2223/042* (2013.01); *C10M 2203/104* (2013.01); *C10M 2215/04* (2013.01); *C10M 2215/28* (2013.01); *C10N 2210/06* (2013.01); *C10N 2230/10* (2013.01); *C10M 2227/09* (2013.01)
USPC ..... 508/362; 508/563; 508/567; 508/584; 508/382

(58) Field of Classification Search
CPC ..... C10M 139/06; C10M 2203/104
USPC ..... 508/363, 396, 382, 362, 563, 567, 584
See application file for complete search history.

(56) References Cited

U.S. PATENT DOCUMENTS

| | | | | |
|---|---|---|---|---|
| 4,995,996 | A | 2/1991 | Coyle et al. | |
| 5,744,430 | A | 4/1998 | Inoue et al. | |
| 6,541,429 | B2 * | 4/2003 | McConnachie et al. | 508/363 |
| 2002/0002120 | A1 * | 1/2002 | Gahagan | 508/396 |

FOREIGN PATENT DOCUMENTS

| | | |
|---|---|---|
| CN | 1346873 A | 5/2002 |
| EP | 0 281 992 | 9/1988 |
| EP | 0 892 037 | 1/1999 |
| JP | 63223094 | 9/1988 |
| JP | 3-35094 | 2/1991 |
| JP | 3-100098 | 4/1991 |
| JP | 3-229799 | 10/1991 |
| JP | 4-36391 | 2/1992 |
| JP | 4-120193 | 4/1992 |
| JP | 8302378 | 11/1996 |
| JP | 9003463 | 1/1997 |
| JP | 9-151387 | 6/1997 |
| JP | 10-279980 | 10/1998 |
| JP | 10287893 | 10/1998 |
| JP | 10287895 | 10/1998 |
| JP | 11-43679 | 2/1999 |
| JP | 11092778 | 4/1999 |
| JP | 11-140479 | 5/1999 |
| JP | 11-140480 | 5/1999 |
| JP | H11-152486 | 6/1999 |
| JP | H11-152487 | 6/1999 |
| JP | 2000-192066 | 7/2000 |
| JP | 2000-192068 | 7/2000 |
| JP | 2000-256691 | 9/2000 |
| JP | 2001-158897 | 6/2001 |
| JP | 2001-262175 | 9/2001 |
| JP | 2001-279288 | 10/2001 |
| JP | 2002-53888 | 2/2002 |
| JP | 2002-294271 | 10/2002 |
| JP | 2003-221588 | 8/2003 |
| JP | 2003-238980 | 8/2003 |
| JP | 2003-277781 | 10/2003 |
| JP | 2003-277783 | 10/2003 |
| JP | 2004-2860 | 1/2004 |
| JP | 2004-018677 | 1/2004 |
| JP | 2004-35619 | 2/2004 |

(Continued)

OTHER PUBLICATIONS

"Handbook of Chemistry, Applied Chemistry 6th Ed.," *The Chemical Society of Japan*, vol. I, Japan, Maruzen Co., Ltd. Jan. 30, 2003, p. 789.

(Continued)

*Primary Examiner* — Prem C Singh
*Assistant Examiner* — Chantel Graham
(74) *Attorney, Agent, or Firm* — Finnegan, Henderson, Farabow, Garrett & Dunner, LLP

(57) ABSTRACT

The lubricating oil composition of the present invention comprises at least one species of aromatic constituent selected from the following (a1) to (a5):

(a1) a lubricating base oil comprising a polycyclic aromatic content of 0.01% by mass or more based on the total amount of base oil (a2) a lubricating base oil comprising a total aromatic content of 20 to 100% by mass based on the total amount of base oil (a3) an aromatic solvent (a4) at least one species of polycyclic aromatic compound selected from alkyl naphthalene and compounds having three or more aromatic rings, and (a5) an aromatic compound having a nitrogen atom, an oxygen atom or a sulfur atom;

and an organic molybdenum compound.

44 Claims, No Drawings

(56) References Cited

FOREIGN PATENT DOCUMENTS

| | | | |
|---|---|---|---|
| JP | 2004-51985 | | 2/2004 |
| JP | 2004-068021 | | 3/2004 |
| JP | 2004-083891 | | 3/2004 |
| JP | 2004-131742 | | 4/2004 |
| JP | 2004-149802 | | 5/2004 |
| JP | 2004-197022 | | 7/2004 |
| JP | 2004-277712 | | 10/2004 |
| JP | 2005-002204 | | 6/2005 |
| JP | 2006-117728 | | 5/2006 |
| JP | 2006-117729 | | 5/2006 |
| JP | 2006-117733 | | 5/2006 |
| WO | WO 95/29976 | | 11/1995 |
| WO | WO 03/064569 | | 8/2003 |
| WO | WO2004053030 | * | 6/2004 |

OTHER PUBLICATIONS

Japanese Office Action dated May 18, 2010.
International Search Report.
Chinese Office Action dated Jun. 26, 2009.
Japanese Office Action dated Aug. 5, 2008.
Japanese Office Action dated Aug. 10, 2010.
Japanese Office Action dated Nov. 16, 2010.
Japanese Office Action dated Sep. 20, 2011.
European Search Report for EP Application No. 05795384.6 dated Aug. 6, 2012.
Office Action for Application No. JP 2004-304692 dated Jun. 26, 2012.

* cited by examiner

LUBRICANT COMPOSITION AND ANTIOXIDENT COMPOSITION

TECHNICAL FIELD

The present invention relates to a lubricating oil composition and an antioxidant composition; specifically, it relates to a lubricating oil composition and an antioxidant composition used suitably in applications such as lubricating oil for internal combustion engine.

BACKGROUND ART

In the field of lubricating oil used in applications such as internal combustion engine and automatic transmission, in recent years, from such points of view as efficient use of resources, decrease in waste oil and cost reduction for users of lubricating oil, requirements have increased regarding lubricating oils to have longer drain intervals.

Thus, in prior art lubricating oils, in response to the above-mentioned requirements, improvement of oxidation stability of lubricating oil is intended, by taking a mineral oil in which the aromatic content has been decreased by high-level refining (highly refined mineral oil) serving as the base oil, and including therein large amounts of a reaction chain terminator, such as a phenol type or an amine type antioxidant, and a sulfur-containing compound having peroxide decomposing ability, such as, zinc dithiophosphate (ZDTP) or molybdenum dithiocarbamate (MoDTC), or the like (for instance, refer to Patent Reference 1).

However, there are limits to maintaining the oxidation stability by a increase of the reaction chain terminator, and in addition, there is the problem that deterioration products of the reaction chain terminator become insoluble. In addition, a sulfur-containing compounds such as ZDTP may per se oxidize or thermally decompose and become the cause of acidic substance generation, such as of sulfuric acid, therefore, in lubricating oils for internal combustion engine, or the like, where metallic detergent and ashless dispersant are mixed in general, it becomes a cause that triggers a decrease in base number, which is an indicator for acid neutralization property, and a decrease in high temperature detergency.

On the other hand, in general, decreasing the quantity of metallic detergent mixed in the lubricating oil is considered to be necessary in order to prevent ash deposition onto pistons of internal combustion engines, catalysts, such as, three-way catalysts, oxidation catalysts and NOx occlusion reduction type catalysts, or emission gas refining devices, such as, DPF; however, simply decreasing the quantity of mixed metallic detergent compromises acid neutralization properties and high temperature detergency.

Furthermore, in regard to the above-mentioned catalysts, in particular the NOx occlusion reduction type catalyst, in order to decrease poisoning due to sulfur, studies on reducing sulfur content in fuels (for instance, gas oil having a sulfur content of 50 mass ppm or less, gasoline having a sulfur content of 10 mass ppm or less, and the like) are proceeding rapidly, and the effects thereof are anticipated, however, in an internal combustion engine using such low sulfur fuels, the influence on the catalysts exerted by the sulfur content in the lubricating oil become relatively important. Consequently, a further increase in the amounts of sulfur-containing compounds in the lubricating oil is not desirable, and decreasing the sulfur content in the lubricating oil is essential.

Thus, studies were made to solve the above-mentioned problematic points in conventional lubricating oils and achieve sufficiently longer drain intervals. For instance, disclosed are, in Patent Reference 2, a lubricating oil composition in which a specific phosphorus compound has been mixed, in Patent Reference 3, a lubricating oil composition in which the content of ZDTP has been decreased and at the same time salicylate and sulfonate and a phosphorus-containing anti-wear agent are used in combination, and, in Patent Reference 4, a lubricating oil composition in which a specific phosphorus compound and a sulfur-containing organic molybdenum complex are used in combination, respectively.

[Patent Reference 1] Japanese Patent Application Laid-open No. H8-302378

[Patent Reference 2] Japanese Patent Application Laid-open No. 2002-294271

[Patent Reference 3] Japanese Patent Application Laid-open No. 2003-277781

[Patent Reference 4] Japanese Patent Application Laid-open No. 2004-83891

DISCLOSURE OF THE INVENTION

Problem the Invention is to Solve

However, even for the above-mentioned prior art lubricating oil compositions, there is still room for improvement to achieve sufficiently longer drain intervals. In particular, since organic molybdenum compounds, such as MoDTC, do not display a sufficient effect when mixed alone with high purity base oil, it is essential to use it in combination with an ashless antioxidant. Furthermore, even if an organic molybdenum compound and an ashless antioxidant are used in combination, increasing sufficiently the entirety of oxidation stability, ability to retain the base number, high temperature detergency and resistance against NOx is difficult.

In addition, the above lubricating oil compositions described in Patent References 1 to 3, allow remarkably longer drain intervals to be achieved compared to prior art lubricating oil in which ZDTP is mixed; however according to studies by the present inventors, even for these lubricating oil compositions, there is still room for improvement to raise, in a balanced and sufficient manner, the entirety of oxidation stability, ability to retain the base number, high temperature detergency and resistance against NOx, in particular, to suppress acid number increase caused by NOx.

The present invention was devised in view of this situation, and an object is to provide an antioxidant composition allowing a lubricating oil to be conferred a sufficient long drain properties, as well as a lubricating oil composition having sufficient long drain properties, and, in particular, the capability of acid number increase suppression against NOx.

Means for Solving the Problems

The present inventors undertook earnest studies to achieve the above objective, and as a result, discovered that the above issue is resolved by using in combination a specific aromatic constituent and an organic molybdenum compound, and reached completion of the present invention.

That is to say, the present invention provides a lubricating oil composition comprising at least one species selected from the following aromatic constituents (a1) to (a5):

(a1) a lubricating base oil comprising a polycyclic aromatic content of 0.01% by mass or more based on the total amount of base oil (a2) a lubricating base oil comprising a total aromatic content of 20 to 100% by mass based on the total amount of base oil (a3) an aromatic solvent (a4) at least one species of polycyclic aromatic compound selected from alkyl naphthalene and compounds having three or more aromatic rings (a5) an aromatic compound having a nitrogen atom, an oxygen atom or a sulfur atom, and an organic molybdenum compound.

Note that "polycyclic aromatic content" referred to in the present invention and "monocyclic aromatic content" mentioned below mean polycyclic aromatic content and monocyclic aromatic content measured respectively according to methods disclosed in Hirsch, D. E., Anal. Chem., 44, p 915 (1972). In addition, "total aromatic content" referred to in the present invention means the aromatic content content measured according to ASTM D2549. Such aromatic content comprises both monocyclic aromatic compounds and polycyclic aromatic compounds. More concretely, in addition to alkyl benzene and alkyl naphthalene, anthracene, phenanthrene and alkylation products thereof, compounds having four rings or more condensed benzene rings, as well as compounds having hetero aromatic rings, such as, pyridines, quinolines, phenols, naphthols, and the like, are included.

In addition, as the above-mentioned organic molybdenum compound, organic molybdenum compounds such as molybdenum dithiocarbamate, molybdenum dithio phosphate, molybdenum-amine complex, molybdenum-succinimide complex, molybdenum salts of organic acids, molybdenum salts of alcohols can be cited, and among these, organic molybdenum compounds not containing sulfur as a constitutive element are preferred, among which more preferred are molybdenum-amine complexes, molybdenum salts of organic acids and molybdenum salts of alcohols, which do not contain sulfur as a constitutive element.

In the lubricating oil composition of the present invention, the organic molybdenum compound content in terms of molybdenum element based on the total amount of the composition as the reference is preferably 10 to 1000 mass ppm.

According to the lubricating oil composition of the present invention, even if an ashless antioxidant is not used in combination, using in combination the above-mentioned specific aromatic constituent and organic molybdenum compound, in particular an organic molybdenum compound not containing sulfur as a constitutive element, allows oxidation stability, the ability to retain the base number, high temperature detergency and resistance against NOx to be achieved at a high level and in a balanced manner, and in particular, allows the resistance against NOx to be raised significantly. This effect is prominently demonstrated particularly when using a base oil having a total aromatic content of 10% by mass or less, for instance, highly refined mineral oil such as API Gr III base oil (saturate content: 90% by mass or greater; viscosity index: 120 or greater, sulfur content: 0.05% by mass or less) or a lubricating base oil having a low aromatic content, such as, poly α-olefin type base oil, or fundamentally not containing an aromatic content In addition, as a preferred lubricating oil composition, the present invention provides a lubricating oil composition comprising a lubricating base oil containing a polycyclic aromatic content of 0.01% by mass or more based on the total amount of base oil (above-mentioned (a1) constituent), and an organic molybdenum compound not containing sulfur as a constitutive element (for the sake of convenience, hereinafter referred to as "first lubricating oil composition").

According to the above-mentioned first lubricating oil composition, even without combining a sulfur-containing peroxide decomposer or a specific metallic detergent, using in combination the above-mentioned lubricating base oil containing a particular polycyclic aromatic content and an organic molybdenum compound not containing sulfur as a constitutive element allows oxidation stability, ability to retain the base number, high temperature detergency and resistance against NOx to be achieved at a high level and in a balanced manner, and in particular, allows the resistance against NOx to be raised significantly. When viewed from the technical level of the prior art, where decreasing as much as possible the aromatic content of the lubricating base oil through high high-level refining, or the like, is desirable, the above effects by the first lubricating oil composition can be considered to be extremely unexpected effects.

The above-mentioned first lubricating oil composition can be used suitably in internal combustion engines for which low sulfur fuels are used, in particular fuels having a sulfur content of 100 mass ppm or less. That is to say, in an internal combustion engine using such a low sulfur fuel, the SOx content in the combustible gas can be decreased, not only sulfur poisoning against catalysts such as oxidation catalysts, three-way catalysts and NOx occlusion reduction type catalysts can be decreased, but also the mixing of SOx into the lubricating oil can be decreased to prevent deterioration of lubricating oil. Therefore, by using the first lubricating oil composition that enables more sulfur content reduction than the prior art ZDTP mixed oil, sulfur poisoning originating from lubricating oil against the above catalysts can be further decreased, in addition, oxidation stability, ability to retain the base number, high temperature detergency and resistance against NOx can all be achieved at an extremely high level; therefore, using the first lubricating oil composition and a low sulfur fuel in an internal combustion engine, the merits thereof (emission gas cleaning, longer life span of catalysts and longer drain intervals of lubricating oil as well as, based thereon, decrease in cost/amount of waste oil and greater resource saving, and the like) can be fully exhibited.

In addition, the organic molybdenum compound contained in the first lubricating oil composition is preferably at least one species selected from molybdenum-amine complexes, molybdenum salts of organic acids and molybdenum salts of alcohols. The above effects by the first lubricating oil composition can be achieved at an even higher level by using such organic molybdenum compounds.

In addition, the first lubricating oil composition preferably contains a chain-terminating type antioxidant. As the oxidation stability of the lubricating oil composition is thereby brought even higher, the ability to retain the base number and high temperature detergency in the present invention can be brought even higher.

In addition, the first lubricating oil composition preferably further comprises at least one species of phosphorus-containing additive selected from the phosphorus compound represented by the following General Formula (2) or (3) as well as metal salts (except molybdenum salts) and amine salts thereof. By adding such a phosphorus-containing additive together with the above-mentioned organic molybdenum compound, oxidation stability, ability to retain the base number, high temperature detergency and resistance against NOx can be achieved at even higher levels and in a balanced manner.

[Chemical formula 1]

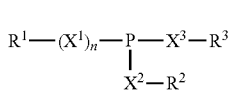

$$R^1-(X^1)_n-\underset{\underset{X^2-R^2}{|}}{P}-X^3-R^3 \quad (2)$$

wherein $R^1$ represents a hydrocarbon group having 1 to 30 carbons, $R^2$ and $R^3$ may be identical or different, each representing a hydrogen atom or a hydrocarbon group having 1 to 30 carbons, $X^1$, $X^2$ and $X^3$ may be identical or different, each representing an oxygen atom or a sulfur atom, and n represents 0 or 1, at least one among $X^2$ or $X^3$ representing an oxygen atom when n represents 0, and at least one among $X^1$, $X^2$ or $X^3$ representing an oxygen atom when n represents 1.

[Chemical formula 2]

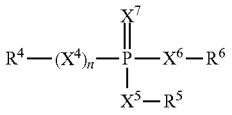

(3)

wherein $R^4$ represents a hydrocarbon group having 1 to 30 carbons, $R^1$ and $R^6$ may be identical or different, each representing a hydrogen atom or a hydrocarbon group having 1 to 30 carbons, $X^4$, $X^5$, $X^6$ and $X^7$ may be identical or different, each representing an oxygen atom or a sulfur atom, n represents 0 or 1, at least two among $X^5$, $X^6$ or $X^7$ representing oxygen atoms when n represents 0, and at least three among $X^4$, $X^5$, $X^6$ or $X^7$ representing oxygen atoms when n represents 1.

In addition, in this case, the phosphorus-containing additive is preferably at least one species selected from the phosphorus compounds represented by the following General Formula (4) or (5) and metal salts thereof (excluding molybdenum salts).

[Chemical formula 3]

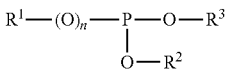

(4)

wherein $R^1$ represents a hydrocarbon group having 1 to 30 carbons, $R^2$ and $R^3$ may be identical or different, each representing a hydrogen atom or a hydrocarbon group having 1 to 30 carbons, and n represents 0 or 1.

[Chemical formula 4]

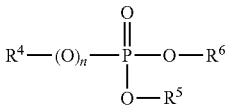

(5)

wherein $R^4$, $R^5$ and $R^6$ may be identical or different, each representing a hydrogen atom or a hydrocarbon group having 1 to 30 carbons, and n represents 0 or 1.

In addition, as long as the effects of the present invention are not inhibited notably, various additives containing sulfur as a constitutive element can be included in the first lubricating oil composition, the content thereof being preferably 0.1% by mass or less when in terms of sulfur element based on the total amount of the composition. Herein, "additive containing sulfur as a constitutive element" includes sulfur-containing anti-wear agents, such as, phosphorus compounds where a portion or the entirety of $X^1$ to $X^7$ is a sulfur atom in the above General Formula (2) or (3), or metal salts or amine salts thereof, ZDTP, metal salts of dithiophosphoric acid, dithio carbamic acid ester or metal salts thereof, sulfide oil fats, disulfides, sulfide olefins, and the like. In addition, these additives containing sulfur are sometimes mixed as a mixture of carrier oil or the like, and "the content of additive containing sulfur as a constitutive element" means the content of effective ingredient excluding the carrier oil and the like. Furthermore, "the content of additive containing sulfur as a constitutive element being preferably 0.1% by mass or less when in terms of sulfur element based on the total amount of the composition" means the total amount of sulfur contained in the lubricating base oil constituting the lubricating oil composition of the present invention and the constituents of the additive other than carrier oil is 0.1% by mass or less in terms of sulfur element based on the total amount of the composition, and, in other words, the value (unit: % by mass) represented by [(sulfur content in the entire composition)−(sulfur content originating from lubricating base oil and carrier oil)].

In addition, in the first lubricating oil composition, the sulfur content of the lubricating base oil is preferably 0.005% by mass or less based on the total amount of lubricating base oil. Using a lubricating base oil having a sulfur content of 0.005% by mass or less, the above effects of the first lubricating oil composition can be achieved at even higher levels.

Note that, "sulfur content" referred to in the present invention means a value measured according to, JIS K 2541-4 "Energy-dispersive X-ray fluorescence method" (in general, a range of 0.01 to 5% by mass) or JIS K 2541-5 "Bomb Mass Determination Method, Appendix (Regulations), Inductively Coupled Plasma Spectrophotometry" (in general, 0.05% by mass or greater), and the content in terms of sulfur element for an additive containing sulfur as a constitutive element is determined by measuring respectively [sulfur content in the entire lubricating oil composition] and [sulfur content originating from lubricating base oil and carrier oil], and subtracting the latter measurement value from the former measurement value. In addition, as a method to determine directly the sulfur content of the additive containing sulfur as a constitutive element, there is the method of separating the effective ingredient of the additive from the lubricating oil and carrier oil, and measuring the sulfur content for the effective ingredient according to the above method. The effective ingredient in the lubricating oil composition or the additive can be separated from the lubricating base oil and carrier oil, by conventional methods such as rubber membrane dialysis and chromatography (for instance, refer to Yagishita et. al., Nippon Mitsubishi Oil review Volume 41, No. 4, pp 25 to 34 (issued October 1999)). In addition, if the sulfur content is no greater than the conventional measuring limits of the above methods, it can be determined from a calibration curve obtained by measuring standards at suitably modified concentrations.

In addition, as a preferred lubricating oil composition, the present invention provides a lubricating oil composition comprising a lubricating base oil having a total aromatic content of 20 to 100% by mass based on the total amount of base oil (above-mentioned (a2) constituent), a lubricating base oil having a total aromatic content of less than 20% by mass based on the total amount of base oil, and an organic molybdenum compound (for the sake of convenience, hereinafter referred to as "second lubricating oil composition").

In addition, the present invention provides an antioxidant composition comprising a lubricating base oil having a total aromatic content of 20 to 100% by mass based on the total amount of base oil (above-mentioned (a2) constituent) and an organic molybdenum compound (for the sake of convenience, hereinafter referred to as "first antioxidant composition").

According to the above-mentioned first antioxidant composition, by using in combination an organic molybdenum compound and a lubricating base oil having a total aromatic content of 20 to 100% by mass, even without using in combination an ashless antioxidant, the oxidation stability of the organic molybdenum compound can be exerted efficiently. Then, despite the aromatic content of the lubricating base oil used in combination with the first antioxidant composition, the oxidation stability, ability to retain the base number, high temperature detergency and resistance against NOx of the lubricating oil can be achieved at high levels in a balanced manner.

In addition, the first antioxidant composition is extremely useful on the points of simplification of the manufacturing process of lubricating oil and prevention of the deposition of organic molybdenum compounds from the lubricating oil. That is to say, most of the organic molybdenum compounds used as antioxidant are in a solid state at ordinary temperature, having a low solubility with respect to high purity base oil. Therefore, there are problems in prior art manufacturing process of lubricating oil, such as, dissolution of an organic molybdenum compound requires a large amount of time and a cumbersome manipulation, and in addition, organic molybdenum compounds deposits easily from the lubricating oil after manufacture. In contrast to this, in the first antioxidant composition, since the lubricating base oil having a total aromatic content of 20 to 100% by mass demonstrates sufficient solubility with respect to organic molybdenum compounds, the organic molybdenum compounds are added to the lubricating oil in a state where they are dissolved in the lubricating base oil. Therefore, even if the lubricating oil where the first antioxidant composition is to be added contains a high purity base oil, the organic molybdenum compound can be solubilized sufficiently in the lubricating oil, and in addition, the dissolution state of such an organic molybdenum compound can be retained stably.

The first antioxidant composition, as described above, despite the aromatic content of the lubricating base oil used in combination, can exert excellent oxidation stability; however, the effect thereof is fully exerted when used in combination with a lubricating base oil having a total aromatic content of less than 20% by mass, similarly to the above-mentioned second lubricating oil composition.

In the second lubricating oil composition and the first antioxidant composition, the kinematic viscosity at 100° C. of the lubricating base oil having a total aromatic content of 20 to 100% by mass is preferably 5 $mm^2/s$ or greater. The use of a lubricating base oil having such kinematic viscosity allows the evaporability to be inhibited at the same time as readily maintaining an improving effect on oxidation stability.

In addition, the organic molybdenum compounds according to the second lubricating oil composition and the first antioxidant composition preferably do not contain sulfur as a constitutive element. Using such organic molybdenum compound, even higher-level long drain intervals can be achieved.

In addition, in the first antioxidant composition, the organic molybdenum compound content in terms of molybdenum element based on the total amount of the antioxidant composition as the reference is preferably 0.1 to 20% by mass. By bringing the organic molybdenum compound content within the above-mentioned limits, longer drain intervals and simplification of manufacturing process of the lubricating oil, and prevention of the deposition of organic molybdenum compounds from the lubricating oil can be achieved at higher levels.

In addition, as a preferred lubricating oil composition, the present invention provides a lubricating oil composition containing a first lubricating base oil having a total aromatic content of 20 to 100% by mass (above-mentioned (a2) constituent), a second lubricating base oil having a total aromatic content or 10% by mass or less, and an organic molybdenum compound not containing sulfur as a constitutive element, the proportion of the first lubricating base oil in the total amount of the first and second lubricating base oils being 1% by mass or greater (for the sake of convenience, hereinafter referred to as "third lubricating oil composition").

According to the above-mentioned third lubricating oil composition, using in combination a first lubricating base oil, a second lubricating base oil and an organic molybdenum compound not containing sulfur as a constitutive element, and bringing the proportion of the first lubricating base oil in the total amount of the first and second lubricating base oils to fulfill the above-mentioned conditions, even without combining a sulfur-containing peroxide decomposer or a specific metallic detergent, allows oxidation stability, ability to retain the base number, high temperature detergency and resistance against NOx to be achieved at a high level and in a balanced manner, and in particular, allows the resistance against NOx to be raised significantly. When viewed from the technical level of the prior art, where decreasing as much as possible the aromatic content of the lubricating base oil through high high-level refining, or the like, is desirable, such effects by the present invention can be considered to be extremely unexpected effects.

In addition, the third lubricating oil composition, owing to the same reasons as for the above-mentioned first lubricating oil composition, can be used suitably in an internal combustion engine using low sulfur fuel, and in particular a fuel having a sulfur content of 100 mass ppm or less.

In addition, the organic molybdenum compound contained in the third lubricating oil composition, owing to the same reasons as for the above-mentioned first lubricating oil composition, is preferably at least one species selected from molybdenum-amine complexes, molybdenum salts of organic acids and molybdenum salts of alcohols.

In addition, the third lubricating oil composition, owing to the same reasons as for the above-mentioned first lubricating oil composition, can further contain a chain-terminating type antioxidant.

In addition, the third lubricating oil composition, owing to the same reasons as for the above-mentioned first lubricating oil composition, preferably further contains at least one species of phosphorus-containing additive selected from phosphorus compounds represented by the above-mentioned General Formula (2) or (3) as well as metal salts (except molybdenum salts) and amine salts thereof.

In addition, in this case, the phosphorus-containing additive is preferably at least one species selected from phosphorus compounds represented by the above-mentioned General Formula (4) or (5) and metal salts thereof (excluding molybdenum salts).

In addition, the third lubricating oil composition can contain various additives containing sulfur as a constitutive element, as long as the effects of the present invention is not inhibited noticeably, however, the content thereof in terms of sulfur element based on the total amount of the composition as the reference is preferably 0.1% by mass or less.

In addition, in the third lubricating oil composition, the sulfur content of the second lubricating base oil is preferably 0.005% by mass or less. By using a second lubricating base oil having a sulfur content of 0.005% by mass or less, the above effects of the present invention can be achieved at even higher levels.

In addition, the third lubricating oil composition can be obtained suitably by a method for preparing a lubricating oil composition comprising a first step of mixing a first lubricating base oil having a total aromatic content of 20 to 100% by mass (above-mentioned (a2) constituent) and an organic molybdenum compound not containing sulfur as a constitutive element, and a second step of mixing the mixture obtained in the first step and a second lubricating base oil or a mixed base oil of first and second lubricating base oils having a total aromatic content of 10% by mass or less, in such a way that the proportion of the first lubricating base oil in the total amount of the first and second lubricating base oils becomes 1% by mass or more.

The organic molybdenum compound not containing sulfur as a constitutive element according to the present invention demonstrates a higher solubility with respect to the first lubricating base oil than the second lubricating base oil. Therefore, by mixing each constituent in the sequence shown in the above-mentioned first and second steps, the time required to dissolve the organic molybdenum compound into the base oil can be shortened sufficiently, and in addition, homogeneity and stability of the organic molybdenum compound in the lubricating base oil can be increased. Thus, the above-mentioned preparation method is extremely useful on the point of ability to balance the increase in the efficiency of preparation of the third lubricating oil composition, and the increase in the quality of the third lubricating oil composition.

In addition, as a preferred lubricating oil composition, the present invention provides a lubricating oil composition comprising a lubricating base oil, an organic molybdenum compound and an aromatic solvent (above-mentioned (a3) constituent) (for the sake of convenience, hereinafter referred to as "fourth lubricating oil composition").

In addition, the present invention provides an antioxidant composition comprising an organic molybdenum compound and an aromatic solvent (above-mentioned (a3) constituent) (for the sake of convenience, hereinafter referred to as "second antioxidant composition").

According to the above-mentioned second antioxidant composition, by using in combination an organic molybdenum compound and an aromatic solvent, even without using in combination an ashless antioxidant, the oxidation stability of the organic molybdenum compound can be exerted efficiently. Then, despite the aromatic content of the lubricating base oil used in combination with the second antioxidant composition, the oxidation stability, ability to retain the base number, high temperature detergency and resistance against NOx of the lubricating oil can be achieved at high levels in a balanced manner.

In addition, owing to the same reasons as for the above first antioxidant composition, the second antioxidant composition is extremely useful on the points of simplification of the manufacturing process of lubricating oil and prevention of the deposition of organic molybdenum compounds from the lubricating oil.

In addition, according to the above fourth lubricating oil composition, sufficiently longer drain intervals can be achieved by including the second antioxidant composition.

In the fourth lubricating oil composition and the second antioxidant composition, the organic molybdenum compound preferably does not contain sulfur as a constitutive element. Using such organic molybdenum compounds, even higher-level long drain intervals can be achieved.

In addition, in the fourth lubricating oil composition and the second antioxidant composition, the aromatic solvent preferably contains an aromatic compound having two rings or more or an aromatic compound having two or more aromatic rings, which is fluid at 0° C. Using such aromatic solvents, improvement of long drain intervals, simplification of the manufacturing process of lubricating oil, and prevention of the deposition of organic molybdenum compounds from the lubricating oil can be achieved at higher levels.

In addition, the aromatic solvent preferably contains at least one species of polycyclic aromatic compound selected from alkyl naphthalene and compounds having three or more aromatic rings (above-mentioned (a4) constituent). Using aromatic solvents containing such polycyclic aromatic compounds, even higher level long drain intervals can be achieved.

In addition, in the second antioxidant composition, owing to the same reasons as for the above first antioxidant composition, the content of the organic molybdenum compound in terms of molybdenum element based on the total amount of the composition as the reference is preferably 0.1 to 20% by mass.

In addition, as a preferred lubricating oil composition, the present invention provides a lubricating oil composition comprising a lubricating base oil, an organic molybdenum compound, and at least one species of polycyclic aromatic compound selected from alkyl naphthalene and compounds having three or more aromatic rings (above-mentioned (a4) constituent) (for the sake of convenience, hereinafter referred to as "fifth lubricating oil composition").

According to the above-mentioned fifth lubricating oil composition, using in combination an organic molybdenum compound and the above-mentioned specific polycyclic aromatic compound, even without combining a sulfur-containing peroxide decomposer or a specific metallic detergent, allows oxidation stability, ability to retain the base number, high temperature detergency and resistance against NOx to be achieved at a high level and in a balanced manner, and in particular, allows the resistance against NOx to be raised significantly. When viewed from the technical level of the prior art, where decreasing as much as possible the aromatic content of the lubricating base oil through high high-level refining, or the like, is desirable, the above effects by the fifth lubricating oil composition can be considered to be extremely unexpected effects.

In addition, owing to the same reasons as for the above-mentioned first lubricating oil composition, the fifth lubricating oil composition can be used suitably in an internal combustion engine using low sulfur fuel, and in particular a fuel having a sulfur content of 100 mass ppm or less.

In addition, owing to the same reasons as for the above-mentioned first lubricating oil composition, the organic molybdenum compound contained in the fifth lubricating oil composition preferably does not contain sulfur as a constitutive element, and is preferably at least one species selected from molybdenum-amine complexes, molybdenum salts of organic acids and molybdenum salts of alcohols.

In addition, in the fifth lubricating oil composition, the content of polycyclic aromatic compound is preferably 0.05 to 5 parts in mass with respect to 100 parts in mass of lubricating base oil. By bringing the content of the polycyclic aromatic compound to within the above-mentioned limits, the above effects by the fifth lubricating oil composition can be obtained more effectively.

In addition, owing to the same reasons as for the above-mentioned first lubricating oil composition, the fifth lubricating oil composition preferably further contains a chain-terminating type antioxidant.

In addition, owing to the same reasons as for the above-mentioned first lubricating oil composition, the fifth lubricating oil composition preferably further contains at least one species of phosphorus-containing additive selected from the phosphorus compounds represented by the above-mentioned General Formula (2) or (3) as well as metal salts (except molybdenum salts) and amine salts thereof.

In addition, in this case, the phosphorus-containing additive is preferably at least one species selected from the phosphorus compounds represented by the above-mentioned General Formula (4) or (5) and metal salts thereof (excluding molybdenum salts).

In addition, as long as the effects of the present invention are not inhibited notably, various additives containing sulfur as a constitutive element can be included in the fifth lubricating oil composition, the content thereof being preferably 0.1% by mass or less when in terms of sulfur element based on the total amount of the composition.

In addition, owing to the same reasons as for the above-mentioned first lubricating oil composition, in the fifth lubricating oil composition, the sulfur content of the lubricating base oil based on the total amount of lubricating base oil is preferably 0.005% by mass or less.

In addition, as a preferred lubricating oil composition, the present invention provides a lubricating oil composition comprising a lubricating base oil, an organic molybdenum compound, and an aromatic compound having a nitrogen atom, an oxygen atom or a sulfur atom (above-mentioned (a5) constituent) (for the sake of convenience, hereinafter referred to as "sixth lubricating oil composition").

Note that, "aromatic ring" referred to in the present invention includes both aromatic carbocyclic rings and heteroaromatic rings.

In the above-mentioned sixth lubricating oil composition, using in combination an organic molybdenum compound and the above-mentioned specific aromatic compound, even without combining a sulfur-containing peroxide decomposer or a specific metallic detergent, allows oxidation stability, ability to retain the base number, high temperature detergency and resistance against NOx to be achieved at a high level and in a balanced manner, and in particular, allows the resistance against NOx to be raised significantly.

In the sixth lubricating oil composition, aromatic compound containing a nitrogen atom, an oxygen atom or a sulfur atom preferably has a structure represented by the following General Formula (1).

[Chemical formula 5]

$$(R)_a\text{-}A\text{-}(X)_b \quad (1)$$

wherein A represents an aromatic ring, X represents a monovalent functional group having at least one nitrogen atom, oxygen atom or sulfur atom, R represents an organic group having 1 to 40 carbons (with the proviso that the tert-butyl group is excluded), a represents an integer of 1 or greater, b represents an integer of 1 or greater when A is an aromatic carbocyclic ring, and b represents an integer of 0 or 1 or greater when A is a heteroaromatic ring.]

In addition, X in the above-mentioned General Formula (1) is preferably an SH group, an OH group or an $NH_2$ group.

In addition, owing to the same reasons as for the above-mentioned first lubricating oil composition, the sixth lubricating oil composition can be used suitably in an internal combustion engine using low sulfur fuel, and in particular a fuel having a sulfur content of 100 mass ppm or less.

Owing to the same reasons as for the above-mentioned first lubricating oil composition, in the sixth lubricating oil composition, the organic molybdenum compound preferably does not contain sulfur as a constitutive element.

In addition, owing to the same reasons as for the above-mentioned first lubricating oil composition, in the sixth lubricating oil composition, the sulfur content of the lubricating base oil based on the total amount of lubricating base oil is preferably 0.005% by mass or less.

Effects of the Invention

According to the present invention, an antioxidant composition allowing a lubricating oil to be conferred with sufficient long drain intervals, and in particular the ability of suppressing the increase in acid number against NOx, as well as a lubricating oil composition having sufficient long drain intervals, and in particularly the ability of suppressing the increase in acid number against NOx, are provided.

BEST MODE FOR CARRYING OUT THE INVENTION

Hereinafter, Embodiment (I) of the present invention will be described in detail.

The lubricating oil composition of the present invention comprises a specific aromatic constituent and an organic molybdenum compound, the specific aromatic constituent being at least one species of aromatic constituent selected from the following (a1) to (a5):

(a1) a lubricating base oil comprising a polycyclic aromatic content of 0.01% by mass or more based on the total amount of base oil (a2) a lubricating base oil comprising a total aromatic content of 20 to 100% by mass based on the total amount of base oil (a3) an aromatic solvent (a4) at least one species of polycyclic aromatic compound selected from alkyl naphthalene and compounds having three or more aromatic rings, and (a5) an aromatic compound having a nitrogen atom, an oxygen atom or a sulfur atom.

Note that regarding the details of the above-mentioned (a1) to (a5), they will be described in the detailed description section of the preferred embodiments (first to sixth embodiments).

In addition, as the above-mentioned organic molybdenum compounds, organic molybdenum compounds such as molybdenum dithiocarbamate, molybdenum dithio phosphate, molybdenum-amine complex, molybdenum-succinimide complex, molybdenum salts of organic acids, molybdenum salts of alcohols can be cited, and among these organic molybdenum compounds not containing sulfur as a constitutive element being preferred, among which molybdenum-amine complexes, molybdenum salts of organic acids and molybdenum salts of alcohols not containing sulfur as a constitutive element being more preferred.

As molybdenum compounds constituting the above-mentioned molybdenum-amine complexes, molybdenum compounds not containing sulfur, such as, molybdenum trioxide or hydrate thereof ($MoO_3.nH_2O$), molybdic acid ($H_2MoO_4$), alkali metal salts of molybdic acid ($M_2MoO4$; M represents an alkali metal salt), ammonium molybdate ($(NH_4)2MoO_4$ or $(NH_4)_6[Mo_7O_{24}].4H_2O$), $MoCl_5$, $MoOCl_4$, $MoO_2Cl_2$, $MoO_2Br_2$, $Mo_2O_3Cl_6$, and the like, may be cited. Among these molybdenum compounds, from the point of yield of molybdenum-amine complex, hexavalent molybdenum compounds are preferred. Furthermore, from the point of availability, among the hexavalent molybdenum compounds, molybdenum trioxide or hydrate thereof, molybdic acid, alkali metal salts of molybdic acid, and ammonium molybdate are preferred.

In addition, as amine compounds constituting the molybdenum-amine complexes, concretely, monoamine, diamine, polyamine and alkanol amine may be cited as nitrogen compounds with no particular limitations. More concretely, alkyl amines having an alkyl group having 1 to 30 carbons such as methylamine, ethyl amine, propyl amine, butyl amine, pentyl amine, hexyl amine, heptyl amine, octyl amine, nonyl amine, decyl amine, undecyl amine, dodecyl amine, tridecyl amine, tetradecyl amine, pentadecyl amine, hexadecyl amine, heptadecyl amine, octadecyl amine, dimethylamine, diethyl amine, dipropyl amine, dibutyl amine, dipentyl amine, dihexyl amine, diheptyl amine, dioctyl amine, dinonyl amine, didecyl amine, diundecyl amine, didodecyl amine, ditridecyl amine, ditetradecyl amine, dipentadecyl amine, dihexadecyl amine, diheptadecyl amine, dioctadecyl amine, methyl ethyl amine, methyl propyl amine, methyl butyl amine, ethyl propyl amine, ethyl butyl amine, and propyl butyl amine (these alkyl groups may be linear or branched); alkenyl amines having an alkenyl group having 2 to 30 carbons such as ethenyl amine, propenyl amine, butenyl amine, octenyl amine, and oleyl amine (these alkenyl group may be linear or branched); alkanol amines having an having an alkanol group 1 to 30 carbons such as methanol amine, ethanolamine, propanol amine, butanol amine, pentanol amine, hexanol amine, heptanol amine, octanol amine, nonanol amine, methanol ethanolamine, methanol propanol amine, methanol butanol amine, ethanol propanol amine, ethanol butanol amine, and propanol butanol amine (these alkanol group may be linear or branched); alkylene diamines having an alkylene group having 1 to 30 carbons such as methylene diamine, ethylenediamine, propylene diamine, and butylene diamine; polyamines such as diethylene triamine, triethylene tetramine, tetraethylene pentamine, pentaethylene hexamine; compounds having an alkyl group or an alkenyl group having 8 to 20 carbons on the above monoamines, diamines or polyamines, such as, undecyl diethyl amine, undecyl diethanolamine, dodecyl dipropanol amine, oleyl diethanolamine, oleyl propylene diamine and stearyl tetraethylene pentamine, and heterocyclic compounds such as imidazoline; alkylene oxide adducts of these compounds; and mixtures thereof, or the like, can be given as examples. Among these amine compounds, primary amines, secondary amines and alkanol amines are preferred.

The number of carbons of the hydrocarbon group on the amine compound constituting the molybdenum-amine complex is preferably four or greater, more preferably 4 to 30, and particularly preferably 8 to 18. If the number of carbons of the hydrocarbon group on the amine compound is less than four, the solubility tends to deteriorate. In addition, by bringing the number of carbon of the amine compound to 30 or less, the amount of molybdenum in the molybdenum-amine complexes can be increased relatively, allowing the effects of the lubricating oil composition according to the first embodiment to be even higher by mixing small amounts.

In addition, as molybdenum-succinimide complexes, complexes of a molybdenum compound not containing sulfur such as those given as examples in the description of the above molybdenum-amine complexes and a succinimide having an alkyl group or an alkenyl group having 4 carbons or more may be cited. As succinimide, succinimides having at least one alkyl group or alkenyl group having 40 to 400 carbons within the molecule or derivatives thereof described in the section of ashless dispersant, succinimides having an alkyl group or an alkenyl group having 4 to 39 carbons, preferably having 8 to 18 carbons, and the like, may be cited. If the number of carbons of the alkyl group or the alkenyl group in the succinimide is less than 4, the solubility tends to deteriorate. In addition, although succinimides having an alkyl group or an alkenyl group having a number of carbon exceeding 30 and no greater than 400 can also be used, by letting the number of carbons of the alkyl group or the alkenyl group to be 30 or less, the amount of molybdenum in the molybdenum-succinimide complexes can be increased relatively, enabling an even higher increase of the effects of the lubricating oil composition according to the first embodiment by mixing small amounts.

In addition, as molybdenum salts of organic acids, salts of molybdenum bases such as molybdenum oxides or molybdenum hydroxides given as examples in the description of the above molybdenum-amine complexes, molybdenum carbonate or molybdenum chloride, and an organic acid, may be cited. As organic acids, the phosphorus compounds and carboxylic acids represented by the above-mentioned General Formula (4) or (5) are preferred. Herein, regarding the preferred modes for General Formulae (4) and (5) in the molybdenum salts of the phosphorus compounds represented by General Formula (4) or (5), they can be the same as in the case of the phosphorus-containing additives described below.

In addition, as carboxylic acids constituting the molybdenum salts of carboxylic acid, they may be either monobasic acids or polybasic acids.

As monobasic acids, fatty acids having a number of carbons of in general 2 to 30, and preferably 4 to 24, are used, and these fatty acid may be linear or branched, and in addition, may be saturated or unsaturated. Concretely, for instance, saturated fatty acid, such as, acetic acid, propionic acid, linear or branched butanoic acid, linear or branched pentanoic acid, linear or branched hexanoic acid, linear or branched heptanoic acid, linear or branched octanoic acid, linear or branched nonanoic acid, linear or branched decanoic acid, linear or branched undecanoic acid, linear or branched dodecanoic acid, linear or branched tridecanoic acid, linear or branched tetradecanoic acid, linear or branched pentadecanoic acid, linear or branched hexadecanoic acid, linear or branched heptadecanoic acid, linear or branched octadecanoic acid, linear or branched hydroxy octadecanoic acid, linear or branched nonadecanoic acid, linear or branched icosanoic acid, linear or branched henicosanoic acid, linear or branched docosanoic acid, linear or branched tricosanoic acid and linear or branched tetracosanoic acid, and unsaturated fatty acids, such as, acrylic acid, linear or branched butenoic acid, linear or branched pentenoic acid, linear or branched hexenoic acid, linear or branched heptene acid, linear or branched octenoic acid, linear or branched nonenoic acid, linear or branched decenoic acid, linear or branched undecene acid, linear or branched dodecenoic acid, linear or branched tridecenoic acid, linear or branched tetradecenoic acid, linear or branched pentadecenoic acid, linear or branched hexadecenoic acid, linear or branched heptadecenoic acid, linear or branched octadecenoic acid, linear or branched hydroxy octadecenoic acid, linear or branched nonadecenoic acid, linear or branched icosenoic acid, linear or branched henicosenoic acid, linear or branched docosenoic acid, linear or branched tricosenoic acid and linear or branched tetracosenoic acid, and mixtures thereof, or the like, may be cited.

In addition, as monobasic acids, other than the above-mentioned fatty acids, monocyclic or polycyclic carboxylic acids (may have a hydroxyl group) may be used, the number of carbons thereof being preferably 4 to 30, and more preferably 7 to 30. As monocyclic or polycyclic carboxylic acids, aromatic carboxylic acids or cycloalkyl carboxylic acids having 0 to 3, and preferably 1 to 2 linear or branched alkyl groups having 1 to 30 carbons, and preferably having 1 to 20 carbons, and the like, may be cited, and more concretely, (alkyl)benzene carboxylic acid, (alkyl)naphthalene carboxylic acid, (alkyl)cycloalkyl carboxylic acid, and the like, can be given as examples. As preferred examples of monocyclic or polycyclic carboxylic acids, benzoic acid, salicylic acid, alkyl benzoic acid, alkyl salicylic acid, cyclohexane carboxylic acid, and the like, may be cited.

In addition, as polybasic acids, dibasic acids, tribasic acids, tetrabasic acids, and the like, may be cited. The polybasic acids may be either aliphatic polybasic acids or cyclic polybasic acids. In addition, in the case of a aliphatic polybasic acid, it may be either linear or branched, and in addition, may be either saturated or unsaturated. As aliphatic polybasic acids, aliphatic dibasic acids having 2 to 16 carbons are preferred, and concretely for instance, ethane dioic acid, propane dioic acid, linear or branched butane dioic acid, linear or branched pentane dioic acid, linear or branched hexane dioic acid, linear or branched heptane dioic acid, linear or branched octane dioic acid, linear or branched nonane dioic acid, linear or branched decane dioic acid, linear or branched undecane dioic acid, linear or branched dodecane dioic acid, linear or branched tridecane dioic acid, linear or branched tetradecane dioic acid, linear or branched heptadecane dioic acid, linear or branched hexadecane dioic acid, linear or branched hexene dioic acid, linear or branched heptene dioic acid, linear or branched octene dioic acid, linear or branched nonene dioic acid, linear or branched decene dioic acid, linear or branched undecene dioic acid, linear or branched dodecene dioic acid, linear or branched tridecene dioic acid, linear or branched tetradecene dioic acid, linear or branched heptadecene dioic acid, linear or branched hexadecene dioic acid, alkenyl succinic acid and mixtures thereof, or the like, may be cited. In addition, as cyclic polybasic acids, alicyclic dicarboxylic acids [such as] 1,2-cyclohexane dicarboxylic acid and 4-cyclohexene-1,2-dicarboxylic acid, aromatic dicarboxylic acids such as phthalic acid, aromatic tricarboxylic acids such as trimellitic acid, aromatic tetracarboxylic acids such as pyromellitic acid, and the like, may be cited.

In addition, as the above-mentioned molybdenum salts of alcohols, salts of molybdenum compound not containing sulfur given as examples in the description of the above molybdenum-amine complexes, and an alcohol, may be cited, and the alcohol may be any among a monoalcohol, a polyalcohol, a partial ester or a partial ester compound of a polyalcohol, a nitrogen compound having a hydroxyl group (alkanol amine and the like) and the like. Note that molybdic acid is a strong acid and forms an ester by reaction with an alcohol, and the ester of molybdic acid and alcohol is also included in the molybdenum salts of alcohols referred to in the present invention.

As monoalcohols, those with a number of carbons of in general 1 to 24, preferably 1 to 12, and more preferably 1 to 8 are used, as such alcohols, they may be linear or branched, and in addition, may be saturated or may be unsaturated. As alcohols having 1 to 24 carbons, concretely, for instance, methanol, ethanol, linear or branched propanol, linear or branched butanol, linear or branched pentanol, linear or branched hexanol, linear or branched heptanol, linear or branched octanol, linear or branched nonanol, linear or branched decanol, linear or branched undecanol, linear or branched dodecanol, linear or branched tridecanol, linear or branched tetradecanol, linear or branched pentadecanol, linear or branched hexadecanol, linear or branched heptadecanol, linear or branched octadecanol, linear or branched nonadecanol, linear or branched icosanol, linear or branched henicosanol, linear or branched tricosanol, linear or branched tetracosanol and mixtures thereof, or the like, may be cited.

In addition, as polyalcohols, those that are in general di- to deca-, and preferably di- to hexa- are used. As di- to deca-polyalcohols, concretely, for instance, diols such as ethylene glycol, diethylene glycol, polyethyleneglycol (trimers to 15-mers of ethylene glycol), propylene glycol, dipropylene glycol, polypropylene glycol (trimers to 15-mers of propylene glycol), 1,3-propanediol, 1,2-propanediol, 1,3-butanediol, 1,4-butanediol, 2-methyl-1,2-propanediol, 2-methyl-1,3-propanediol, 1,2-pentane diol, 1,3-pentane diol, 1,4-pentane diol, 1,5-pentane diol and neopentyl glycol; polyalcohols, such as, glycerin, polyglycerol (dimers to octamers of glycerin, for instance, diglycerin, triglycerin, tetraglycerin and the like), trimethylol alkane (trimethylol ethane, trimethylol propane, trimethylol butane and the like) and dimers to octamers thereof, pentaerythritol and dimers to tetramers thereof, 1,2,4-butane triol, 1,3,5-pentane triol, 1,2,6-hexane triol, 1,2,3,4-butane tetrol, sorbitol, sorbitan, sorbitol glycerin condensation product, adonitol, arabitol, xylitol and mannitol; saccharides, such as, xylose, arabinose, ribose, rhamnose, glucose, fructose, galactose, mannose, sorbose, cellobiose, maltose, isomaltose, trehalose and sucrose, and mixtures thereof, or the like, may be cited.

In addition, as partial esters of polyalcohol, compounds in which a portion of the hydroxyl groups on the polyalcohols given as examples in the description of the above-mentioned polyalcohols is hydrocarbyl esterified, and the like, may be cited, among which glycerin monoolate, glycerin diolate, sorbitan monoolate, sorbitan diolate, pentaerythritol monoolate, polyethyleneglycol monoolate, polyglycerol monoolate, and the like, are preferred.

In addition, as partial ethers of polyalcohol, compounds in which a portion of the hydroxyl groups on the polyalcohols given as examples in the description of the above-mentioned polyalcohols is hydrocarbyl etherified, compounds in which ether linkage is formed by condensation of polyalcohols with each other (sorbitan condensation product and the like) and the like, may be cited, among which 3-octadecyl oxy-1,2-propanediol, 3-octadecenyl oxy-1,2-propanediol, polyethyleneglycol alkyl ether, and the like, are preferred.

In addition, as nitrogen compounds having a hydroxyl group, alkanol amines given as examples in the description of above molybdenum-amine complex, as well as alkanol amides in which the amino group of the alkanol is amidated (diethanol amide and the like) and the like may be cited, among which stearyl diethanolamine, polyethyleneglycol stearylamine, polyethyleneglycol dioleyl amine, hydroxyethyl lauryl amine, oleic acid diethanol amide, and the like, are preferred.

In the lubricating oil composition of the present invention, the content of organic molybdenum compound in terms of molybdenum element based on the total amount of the composition as the reference is preferably 10 mass ppm or greater, more preferably 30 mass ppm or greater, and even more preferably 100 mass ppm or greater, in addition, preferably 1000 mass ppm or less, more preferably 600 mass ppm or less, and even more preferably 400 mass ppm or less. If the content of the organic molybdenum compound in terms of molybdenum element is less than 10 mass ppm, the effects of improvement of oxidation stability, ability to retain the base number, high temperature detergency and resistance against NOx by the combined use of the molybdenum compound and the above lubricating base oil tend to be insufficient, and in addition, even if 1000 mass ppm is exceeded, the above improvement effects tend not to be obtained commensurate to the increase in the content.

Note that, in the lubricating oil composition according to the first to sixth embodiments, which are preferred embodiments of the present invention described in the following, the content of the antioxidant composition containing an organic molybdenum compound or an organic molybdenum, unless specifically clearly indicated, is in the above range established in amounts in terms of molybdenum element, and in the sections for each of the first to sixth embodiments, duplicate description will be omitted.

Hereinafter, the preferred embodiments of the present invention will be described in detail.

The lubricating oil composition according to the first embodiment of the present invention is the above-mentioned first lubricating oil composition, and containing a base oil (a1) for lubricating oil comprising a polycyclic aromatic content of 0.01% by mass or more based on the total amount of base oil. From the point of achieving sufficient long drain intervals through the combined used with an organic molybdenum compound not containing sulfur as a constitutive element, the polycyclic aromatic content of the lubricating base oil based on the total amount of the base oil total has to be 0.01% by mass or greater, preferably 0.1% by mass or greater, and more preferably 0.5% by mass or greater. In addition, from the point of high temperature detergency, the polycyclic aromatic content of the lubricating base oil based on the total amount of the base oil is preferably 5% by mass or less. Furthermore, when the lubricating oil composition according to the first embodiment further contains a chain terminator, in order to further increase the synergistic action of the organic molybdenum compound not containing sulfur as a constitutive element and the chain terminator, 3% by mass or less is more preferred, and 1% by mass or less is particularly preferred.

The lubricating base oil (a1) having polycyclic aromatic content of 0.01% by mass or more based on the total amount of base oil, can be constituted with one species or two or more species of the mineral base oil or synthetic oil described below.

Concretely, those [oils] obtained by distillating crude oil at ordinary pressure, subjecting the obtained ordinary pressure residual oil to distillation at reduced pressure, and subjecting the obtained lubricating oil fraction to refining by carrying out one or more treatments, such as, solvent deasphalting, solvent extraction, hydrocracking, solvent dewaxing and hydrofining, or wax isomerized mineral oils and base oils prepared by methods whereby a GTL WAX (gas-to-liquid wax) is isomerized, and the like, can be given as examples of mineral base oils.

Although the sulfur content in the mineral base oil is not limited in particular, it is preferably 0.2% by mass or less, more preferably 0.1% by mass or less, even more preferably 0.05% by mass or less, all the more preferably 0.01% by mass or less, and particularly preferably 0.005% by mass or less. By decreasing the sulfur content of the mineral base oil in this way, a low sulfur lubricating oil composition can be obtained, having better long drain intervals, and, when used as lubricating oil for internal combustion engine, allowing detrimental effects on emission gas after-treatment device to be avoided as much as possible.

Meanwhile, as synthetic oils, concretely, polybutene or hydrogenated compounds thereof; poly-α-olefins such as 1-octene oligomer and 1-decene oligomer or hydrogenated compounds thereof; diesters such as ditridecyl glutarate, di-2-ethyl hexyl adipate, diisodecyl adipate, ditridecyl adipate, and di-2-ethyl hexyl sebacate; polyol esters such as neopentyl glycol ester, trimethylol propane caprylate, trimethylol propane pelargonate, pentaerythritol-2-ethyl hexanoate, and pentaerythritol pelargonate; aromatic synthetic oils such as alkyl naphthalene, alkyl benzene, and aromatic esters, or mixtures thereof, and the like, can be given as examples.

In the lubricating oil composition according to the first embodiment, among the above mineral base oils or the above synthetic oils, one species may be used alone, or two or more species may be used in combination. Herein, when combining two or more species of mineral base oil or synthetic oil, if the polycyclic aromatic content of the mixed base oil is 0.01% by mass or more, a portion thereof may contain a base oil having a polycyclic aromatic content of less than 0.01% by mass.

In addition, a lubricating base oil having a polycyclic aromatic content of 0.01% by mass or more can also be obtained by supplemental addition of a polycyclic aromatic compound to a lubricating base oil having a polycyclic aromatic content of less than 0.01% by mass. As polycyclic aromatic compounds to be added supplementally, naphthalene, acenaphthene, anthracene, phenanthrene, benzoanthracene, benzophenanthrene, chrysene, pyrene, benzopyrene, cyclopentapyrene, cyclopentabenzophenanthrene, dibenzoanthracene, fluorene, triphenylene, and the like, and alkylation products thereof, or petroleum-containing alkylated polycyclic aromatic compounds (alkyl polycyclic aromatic compound extracted from a petroleum content), and the like, are desirable.

In addition, the monocyclic aromatic content of the lubricating base oil used in the first embodiment, based on the total amount of the base oil total, is preferably 35% by mass or less, and more preferably 25% by mass or less. If the monocyclic aromatic content of the lubricating base oil exceeds the above upper limit value, the high temperature detergency tend to decrease.

In addition, the total aromatic content of the lubricating base oil based on the total amount of the base oil total is preferably 40% by mass or less, and more preferably 28% by mass or less. If the total aromatic content of the lubricating base oil exceeds the above upper limit value, the high temperature detergency tend to decrease.

In addition, the kinematic viscosity of the lubricating base oil is not limited in particular, and the kinematic viscosity thereof at 100° C., is preferably 20 $mm^2/s$ or less, and more preferably 10 $mm^2/s$ or less. Meanwhile, the kinematic viscosity thereof is preferably 1 $mm^2/s$ or greater, and more preferably 2 $mm^2/s$ or greater. If the kinematic viscosity at 100° C. of the lubricating base oil exceeds 20 $mm^2/s$, the low temperature viscosity characteristic deteriorates, on the other hand, if the kinematic viscosity thereof is less than 1 $mm^2/s$, as oil film formation is insufficient at the lubrication spot, lubricity becomes poor and loss of lubricating base oil by evaporation becomes important, both of which being undesirable.

In addition, the viscosity index of the lubricating base oil is in general 200 or less with no particular limitation; however, in order to obtain excellent viscosity characteristics from a low temperature to a high temperature, the value thereof is preferably 80 or greater, more preferably 100 or greater, and even more preferably 120 or greater. If the viscosity index of the lubricating base oil is less than 80, the low temperature viscosity characteristics tend to deteriorate. In addition, the viscosity index of the lubricating base oil is preferably 160 or less.

In addition, the amount of lubricating base oil lost by evaporation, in terms of NOACK evaporation amount, is preferably 20% by mass or less, more preferably 16% by mass or less, and particularly preferably 10% by mass or less. A NOACK evaporation amount exceeding 20% by mass for the lubricating base oil is not desirable, since not only the loss of lubricating oil by evaporation is important, there is the risk that sulfur compound and phosphorus compound, or the metal content within the composition, along with the lubricating base oil, deposit in the emission gas treatment apparatus when used as a lubricating oil for internal combustion engine, and detrimental effects on emission gas cleaning ability are feared. Note that NOACK evaporation amount referred to in the present invention was measured according to ASTM D5800.

In the lubricating oil composition according to the first embodiment, an organic molybdenum compound not containing sulfur as a constitutive element is mixed to the above lubricating base oil (a1). As such organic molybdenum compound, concretely, molybdenum-amine complexes, molybdenum-succinimide complexes, molybdenum salts of organic acids, molybdenum salts of alcohols and the like can be cited, among which, molybdenum-amine complexes, molybdenum salts of organic acids and molybdenum salts of alcohols are preferred, and concrete examples and preferred examples as well as preferred content ranges thereof are as described in the section of the above-mentioned Embodiment (I) of the present invention, and duplicate description will be omitted here.

Note that, in order to achieve oxidation stability, ability to retain the base number, high temperature detergency and resistance against NOx at high levels and in a balanced manner, the lubricating oil composition according to the first embodiment of the present invention particularly preferably uses as the above-mentioned lubricating base oil (a1) a base oil having a total aromatic content of 10% by mass or less, for instance, a highly refined mineral oil such as API Gr III base oil (saturate fraction: 90% by mass or greater; viscosity index: 120 or greater; sulfur content: 0.05% by mass or less) or a lubricating base oil having a low aromatic content, such as, poly α-olefin type base oil, or fundamentally not containing an aromatic content, subjected to preparation in the manufacturing process of the highly refined mineral oil to obtain [a product] containing a polycyclic aromatic content of 0.01% by mass or more, or to supplemental addition of a polycyclic aromatic constituent in such a way that the content thereof becomes 0.01% by mass or more.

The lubricating oil composition according to the first embodiment may comprise the above lubricating base oil (a1) and an organic molybdenum compound not containing sulfur as a constitutive element only, or may further contain, as necessary, various additives described below.

The lubricating oil composition according to the second embodiment of the present invention is the above-mentioned second lubricating oil composition, containing an antioxidant composition containing an organic molybdenum compound and a lubricating base oil having a total aromatic content of 20 to 100% by mass (a2), and preferably, contains the antioxidant composition and a lubricating base oil having a total aromatic content of less than 20% by mass.

First, the antioxidant composition according to the second embodiment will be described in detail.

Since the organic molybdenum compound contained in the antioxidant composition according to the second embodiment has the same description as the section for the organic molybdenum compound in the above-mentioned Embodiment (I), duplicate description will be omitted here.

In the antioxidant composition according to the second embodiment, the content of the organic molybdenum compound in terms of molybdenum element based on the total amount of the composition as the reference is preferably 0.1% by mass or greater, more preferably 0.5% by mass or greater, and even more preferably 1% by mass or greater, in addition, preferably 20% by mass or less, more preferably 10% by mass or less and even more preferably 5% by mass or less. If the content of the organic molybdenum compound in terms of molybdenum element is less than 0.1% by mass, the effects of improvement of oxidation stability, ability to retain the base number, high temperature detergency and resistance against NOx by the combined use of the organic molybdenum compound and the lubricating base oil having a total aromatic content of 20 to 100% by mass (a2) tend to be insufficient, in addition, even if 20% by mass is exceed, the above improvement effects tend not to be obtained commensurate to the increase in the content.

In addition, the antioxidant composition according to the second embodiment contains a lubricating base oil having a total aromatic content of 20 to 100% by mass (a2). Such lubricating base oil may be either a mineral oil or a synthetic oil, as long as the total aromatic content satisfies the above-mentioned conditions.

Concretely, among those [oils] obtained by distillating crude oil at ordinary pressure, subjecting the ordinary pressure residual oil obtained to distillation at reduced pressure, and subjecting the obtained lubricating oil fraction to refining by carrying out one or more treatments, such as, solvent deasphalting, solvent extraction, hydrocracking, solvent dewaxing and hydrogenation refining, or wax isomerized mineral oils and base oils prepared by methods whereby a GTL WAX (gas-to-liquid wax) is isomerized, and the like, those having a total aromatic content of 20% by mass or more can be used as mineral base oils. Among these mineral base oils, solvent-treated mineral oils obtained by carrying out solvent treatment, such as, solvent deasphalting, solvent extraction, solvent dewaxing and the like are preferred.

When using a mineral oil, the total aromatic content thereof based on the total amount of mineral base oil is 20 to 100% by mass as above, preferably 25 to 100% by mass, and more preferably 28 to 100% by mass. If the total aromatic content of the mineral base oil is less than 20% by mass, the effect of increasing the long drain intervals by the combination of a lubricating oil composition having a low aromatic lubricating base oil as the main component and the antioxidant composition according to the second embodiment tends to be insufficient.

Note that, upper limit value of the total aromatic content of the mineral base oil has no particular limitations, from the points of availability and that a stability improving effect due to refining can be anticipated, mineral base oil having a total aromatic content of 20 to 45% by mass is more preferred, and a mineral oil system of 25 to 40% by mass is more preferred.

In addition, when using a mineral oil, the breakdown of the total aromatic content, that is to say, the content of monocyclic aromatic content and polycyclic aromatic content, has no particular limitations, and from the point of the ability to achieve even higher level long drain intervals, the polycyclic aromatic content based on the total amount of the mineral base oil, is preferably 1% by mass or greater, more preferably 2% by mass or greater, and more preferably 3% by mass or greater. In addition, from the point of high temperature detergency, the polycyclic aromatic content of the mineral base oil based on the total amount of the mineral base oil is preferably 20% by mass or less, more preferably 10% by mass or less, and even more preferably 5% by mass or less.

Meanwhile, the monocyclic aromatic content of the mineral base oil based on the total amount of the mineral base oil is preferably 40% by mass or less, and more preferably 30% by mass or less. If the monocyclic aromatic content of the mineral base oil exceeds the above-mentioned upper limit value, the viscosity index of the lubricating oil composition tends to be low.

In addition, when using a mineral oil, the sulfur content thereof is not limited in particular; however 0.05% by mass or greater is preferred, 0.1% by mass or greater is more preferred, 0.2% by mass or greater is even more preferred, and 0.5% by mass or greater is in particularly preferred. In this way, by setting the sulfur content of the mineral base oil somewhat high, a lubricating oil composition with long drain intervals improved by the sulfur compounds contained originally in the mineral base oil can be obtained.

On the other hand, as synthetic oils, concretely, aromatic synthetic oils, such as, alkyl benzene, alkyl naphthalene, anthracene, phenanthrene and alkylation products thereof, compounds having four rings or more condensed benzene rings, as well as compounds having a hetero aromatic ring such as pyridines, quinolines, phenols and naphthols, may be cited. In addition, mixed base oils of these aromatic synthetic oils and other synthetic oils having a total aromatic content of 20% by mass or more can also be used.

In the antioxidant composition according to the second embodiment, among the above mineral base oils or synthetic oils, of those having a total aromatic content of 20% by mass or more, one species alone, or two or more species mixed can be used as lubricating base oil. In addition, if the total aromatic content of the mixed base oil is within the range of 20 to 100% by mass, a mixed base oil of a base oil having a total aromatic content of 20 to 100% by mass and a base oil having a total aromatic content of less than 20% by mass may be used a lubricating base oil. Furthermore, lubricating base oil in which the total aromatic content has been brought to 20 to 100% by mass by supplementally adding an aromatic compound to a lubricating base oil having a total aromatic content of less than 20% by mass can also be used. As supplementally added aromatic compound, other than alkyl benzene and alkyl naphthalene, compounds having a hetero aromatic ring, such as, anthracene, phenanthrene and alkylation products thereof, compounds having four rings or more condensed benzene rings, as well as pyridines, quinolines, phenols, naphthols, and the like are desirable.

In addition, the kinematic viscosity of the lubricating base oil having a total aromatic content of 20 to 100% by mass has no particular limitations, and the kinematic viscosity thereof at 100° C. is preferably 50 $mm^2/s$ or less, more preferably 25 $mm^2/s$ or less, and even more preferably 15 $mm^2/s$ or less, and in addition, preferably 4 $mm^2/s$ or greater, more preferably 5 $mm^2/s$ or greater, and even more preferably 7 $mm^2/s$ or greater. If the kinematic viscosity at 100° C. of the lubricating base oil exceeds the previous upper limit value, the low temperature viscosity characteristic deteriorates; on the other hand, if the kinematic viscosity thereof is less than the previous lower limit value, this causes a decrease in the viscosity of the lubricating oil, in addition, leads to greater evaporation loss of the lubricating base oil, both of which being undesirable.

In addition, the viscosity index of the lubricating base oil has no particular limitations, and in order to obtain excellent viscosity characteristics from a low temperature to a high temperature, the value thereof is preferably 50 to 120, more preferably 80 to 105, and even more preferably 90 to 98. If the viscosity index of the lubricating base oil is lower than the previous lower limit value, the low temperature viscosity characteristics tend to deteriorate.

In addition, the amount of lubricating base oil lost by evaporation, in terms of NOACK evaporation amount, is preferably 25% by mass or less, more preferably 16% by mass or less, and particularly preferably 10% by mass or less. A NOACK evaporation amount of the lubricating base oil exceeding the previous upper limit value is not desirable, since not only the loss of lubricating oil by evaporation is important, there is the risk that sulfur compound and phosphorus compound, or the metal content within the composition, along with the lubricating base oil, deposit in the emission gas cleaning apparatus when used as a lubricating oil for internal combustion engine, and detrimental effects on emission gas cleaning ability are feared.

The content of lubricating base oil having a total aromatic content of 20 to 100% by mass in the antioxidant composition according to the second embodiment, is preferably selected suitably so as to obtain a content of organic molybdenum compound in the above preferred range.

Hereinafter, the lubricating oil composition according to the second embodiment will be described.

The lubricating oil composition according to the second embodiment contains a lubricating base oil having a total aromatic content of less than 20% by mass and the above-mentioned antioxidant composition according to the second embodiment.

Herein, the content of the antioxidant composition according to the second embodiment in the lubricating oil composition according to the second embodiment is in the range established in amounts in terms of molybdenum element described in the previous section of Embodiment (I), and duplicate description will be omitted here.

As lubricating base oils having a total aromatic content of less than 20% by mass in the lubricating oil composition according to the second embodiment, the mineral base oils or synthetic oils shown below can be used.

Concretely, among those [oils] obtained by distillating crude oil at ordinary pressure, subjecting the ordinary pressure residual oil obtained to distillation at reduced pressure, and subjecting the obtained lubricating oil fraction to refining by carrying out one or more treatments, such as, solvent deasphalting, solvent extraction, hydrocracking, solvent dewaxing and hydrogenation refining, or wax isomerized mineral oils and base oils prepared by methods whereby a GTL WAX (gas-to-liquid wax) is isomerized, and the like, those having a total aromatic content of 10% by mass or less can be used as mineral base oils.

As lubricating base oil having a total aromatic content of less than 20% by mass in the lubricating oil composition according to the second embodiment, among the above-mentioned mineral base oil and synthetic oils, preferred are hydrocracked mineral oils obtained by distillating a crude oil at ordinary pressure, distillating the obtained ordinary pressure residual oil at reduced pressure and hydrocracking the obtained lubricating oil fraction.

As one preferred example of methods for preparing hydrocracked mineral oil, the method whereby a reduced pressure distillate oil (WVGO), mildly hydrocracked (MHC) WVGO, a deasphalted oil (DAO), mildly hydrocracked (MHC) DAO, or an mixed oil thereof, is hydrocracked under the reaction conditions of 150 $kg/cm^2$ or less total pressure, 360 to 440° C. temperature and 0.5 $hr^{-1}$ or less LHSV, in the presence of a hydrocracking catalyst, so as to obtain a cracking rate of 40 weight % or greater, then, the product as-is, or the lubrication fraction after separation and recovery, undergoes dewaxing treatment followed by dearomatization treatment or dearomatization treatment followed by dewaxing treatment, may be cited.

When using a mineral oil as lubricating base oil having a total aromatic content of less than 20% by mass in the lubricating oil composition according to the second embodiment, the total aromatic content thereof based on the total amount of the mineral base oil is preferably 10% by mass or less, more preferably 0.1 to 10% by mass, even more preferably 1 to 8% by mass, all the more preferably 3 to 8% by mass, and particularly preferably 4 to 7% by mass. By bringing the total aromatic content of the lubricating base oil having a total aromatic content of less than 20% by mass in the lubricating oil composition according to the second embodiment to within the above limits, effect of increasing the long drain intervals can be obtained at a high level even when the content of the antioxidant composition according to the second embodiment is in small amounts, and in addition, a higher level effect of increasing the long drain intervals can be obtained when the lubricating base oil having a total aromatic content of 20 to 100% by mass contained in the antioxidant composition according to the second embodiment is a monocyclic aromatic synthetic oil such as alkyl benzene.

Note that, as lubricating base oil having a total aromatic content of less than 20% by mass in the lubricating oil composition according to the second embodiment, a lubricating base oil having a total aromatic content less than 1% by mass can also be used; however, when using such a lubricating base oil, a mineral oil having a total aromatic content of 20 to 100% by mass is preferred as lubricating base oil having a total aromatic content of 20 to 100% by mass contained in the antioxidant composition according to the second embodiment. When a mineral oil having a total aromatic content of 20 to 100% by mass and a lubricating base oil having a total aromatic content of less than 1% by mass are used in combination, a higher effect of increasing the long drain intervals can be obtained than when a monocyclic aromatic synthetic oil such as alkyl benzene and a lubricating base oil having a total aromatic content of less than 1% by mass are used in combination.

When using a mineral oil as lubricating base oil having a total aromatic content of less than 20% by mass in the lubricating oil composition according to the second embodiment, the breakdown of the total aromatic content, that is to say, the content of monocyclic aromatic content and polycyclic aromatic content, has no particular limitations, and from the point of the ability to achieve even higher level long drain intervals, the polycyclic aromatic content based on the total amount of the mineral base oil is preferably 0.01% by mass or greater, more preferably 0.03% by mass or greater, and more preferably 0.04% by mass or greater. In addition, from the points of high temperature detergency and high effects of the use in combination with the antioxidant composition according to the second embodiment, the polycyclic aromatic content of the mineral base oil based on the total amount of the mineral base oil is preferably 2% by mass or less, and more preferably 0.5% by mass or less.

Note that a lubricating base oil having a polycyclic aromatic content of less than 0.01% by mass can be used as lubricating base oil having a total aromatic content of less than 20% by mass in the lubricating oil composition according to the second embodiment; however, when using such a lubricating base oil, a mineral and/or a synthetic oil having a polycyclic aromatic content of preferably 0.01 to 100% by mass, more preferably 1 to 100% by mass, even more preferably 2 to 100% by mass, and particularly preferably 5 to 100% by mass are preferred as lubricating base oil having a total aromatic content of 20 to 100% by mass in the antioxidant composition according to the second embodiment. When a mineral and/or a synthetic oil having a polycyclic aromatic content of less than 0.01% by mass and the antioxidant composition according to the second embodiment containing a mineral and/or a synthetic oil having a polycyclic aromatic content of 0.01 to 100% by mass are used in combination, a higher effect of increasing the long drain intervals can be obtained than when an antioxidant composition comprising a monocyclic aromatic synthetic oil such as alkyl benzene and an organic molybdenum compound is used.

Meanwhile, the monocyclic aromatic content of the mineral base oil [serving] as lubricating base oil having a total aromatic content of less than 20% by mass in the lubricating oil composition according to the second embodiment based on the total amount of the mineral base oil is preferably 10% by mass or less, and more preferably 7% by mass or less. If the monocyclic aromatic content of the mineral base oil exceeds the above upper limit value, the effect of the use in combination with the antioxidant composition according to the second embodiment tends to become smaller.

In addition, when using a mineral oil as lubricating base oil having a total aromatic content of less than 20% by mass in the lubricating oil composition according to the second embodiment, the sulfur content thereof is not limited in particular; however, 0.05% by mass or less is preferred, 0.01% by mass or less is more preferred, 0.005% by mass or less is even more preferred, and 0.001% by mass or less is particularly preferred. In this way, by decreasing the sulfur content of the mineral base oil, a low sulfur lubricating oil composition can be obtained, having better long drain intervals, and, when used as a lubricating oil for internal combustion engine, allowing detrimental effects on emission gas after-treatment device to be avoided as much as possible.

Meanwhile, as synthetic oil [serving] as lubricating base oil having a total aromatic content of less than 20% by mass in the lubricating oil composition according to the second embodiment, concretely, polybutene or hydrogenated compounds thereof; poly-α-olefins such as 1-octene oligomer and 1-decene oligomer, or hydrogenated compounds thereof; diesters such as ditridecyl glutarate, di-2-ethyl hexyl adipate, diisodecyl adipate, ditridecyl adipate, and di-2-ethyl hexyl sebacate; polyol esters such as neopentyl glycol ester, trimethylol propane caprylate, trimethylol propane pelargonate, pentaerythritol-2-ethyl hexanoate, and pentaerythritol pelargonate; mixture of two or more species of the above synthetic oils; mixed base oil of the above synthetic oil and another synthetic oil (aromatic synthetic oil and the like) and having a total aromatic content of less than 20% by mass, and the like, can be given as examples.

As lubricating base oil having a total aromatic content of less than 20% by mass in the lubricating oil composition according to the second embodiment, among the above mineral base oil or synthetic oil, one species alone, or two or more mixed species of those having a total aromatic content of less than 20% by mass can be used. In addition, a mixed base oil of a base oil having a total aromatic content of less than 20% by mass and a base oil having a total aromatic content of 20 to 100% by mass may be used as the first lubricating base oil, if the total aromatic content of the mixed base oil is less than 20% by mass.

The kinematic viscosity of the lubricating base oil having a total aromatic content of less than 20% by mass in the lubricating oil composition according to the second embodiment has no particular limitations, and the kinematic viscosity thereof at 100° C. is preferably 20 $mm^2/s$ or less, and more preferably 6 $mm^2/s$ or less. Meanwhile, the kinematic viscosity thereof at 100° C. is preferably 1 $mm^2/s$ or greater, and more preferably 3 $mm^2/s$ or greater. If the kinematic viscosity at 100° C. of the lubricating base oil having a total aromatic content of less than 20% by mass exceeds the previous upper limit value, the low temperature viscosity characteristics deteriorate, and on the other hand, if this kinematic viscosity is less than the above lower limit value, as oil film formation is insufficient at the lubricating surface, lubricity becomes poor and loss of lubricating base oil by evaporation becomes important, both of which being undesirable.

In addition, the viscosity index of the lubricating base oil having a total aromatic content of less than 20% by mass in the lubricating oil composition according to the second embodiment has no particular limitations, in order to obtain excellent viscosity characteristics from a low temperature to a high temperature, the value thereof is preferably 80 or greater, more preferably 100 or greater, and even more preferably 120 or greater. If the viscosity index of the lubricating base oil is lower than the previous lower limit value circumstance, low temperature viscosity characteristic tends to deteriorate.

In addition, as the amount of lubricating base oil having a total aromatic content of less than 20% by mass in the lubricating oil composition according to the second embodiment mass lost by evaporation, in terms of NOACK evaporation amount, is preferably 20% by mass or less, more preferably 16% by mass or less, and particularly preferably 10% by mass or less. A NOACK evaporation amount exceeding the previous upper limit value for the lubricating base oil is not desirable, since not only the loss of lubricating oil by evaporation is important, there is the risk that sulfur compound and phosphorus compound, or the metal content within the composition, along with the lubricating base oil, deposit in the emission gas cleaning apparatus when used as a lubricating oil for internal combustion engine, and detrimental effects on emission gas cleaning ability are feared.

In the lubricating oil composition according to the second embodiment, the proportion of the lubricating base oil having a total aromatic content of 20 to 100% by mass, which is the antioxidant composition according to the second embodiment, based on the total amount of the lubricating oil composition as the reference, is preferably 0.1% by mass or greater, more preferably 0.5 to 90% by mass, and even more preferably 1 to 90% by mass. If the proportion is less than 0.1% by mass, effect of increasing the long drain intervals of the lubricating oil composition according to the second embodiment tends to be insufficient. In addition, if the proportion exceeds 90% by mass, the viscosity index of the lubricating oil composition tends to be difficult to increase.

In addition, if the lubricating base oil having a total aromatic content of 20 to 100% by mass contained the antioxidant composition according to the second embodiment is a mineral oil, and the sulfur content thereof is 0.2% by mass or greater, from the points of long drain intervals increasing effect and sulfur content reduction, the proportion of the lubricating base oil having a total aromatic content of 20 to 100% by mass based on the total amount of the composition as the reference is preferably 50% by mass or less, more preferably 10% by mass or less, even more preferably 5% by mass or less, and particularly preferably 3% by mass or less.

The antioxidant composition and lubricating oil composition according to the second embodiment may respectively comprise the above-mentioned constituents only, and may also contain, as necessary, various additives described below. Note that the method for including the following additives to the lubricating oil composition according to the second embodiment may be either method in (I) or (II) below.

(I) After including the following additive in the antioxidant composition according to the second embodiment, this antioxidant composition and a lubricating base oil having a total aromatic content of less than 20% by mass are mixed to obtain the lubricating oil composition according to the second embodiment.

(II) The following additive and the antioxidant composition according to the second embodiment are each mixed separately with a lubricating base oil having a total aromatic content of less than 20% by mass to obtain the lubricating oil composition according to the second embodiment.

The lubricating oil composition according to third embodiment of the present invention is the above-mentioned third lubricating oil composition, containing a first lubricating base oil having a total aromatic content of 20 to 100% by mass (a2), a second lubricating base oil having a total aromatic content of 10% by mass or less, and an organic molybdenum compound not containing sulfur as a constitutive element, the proportion of the first lubricating base oil in the total amount of the first and second lubricating base oils being 1% by mass or more.

Note that as the first lubricating base oil used in the third embodiment, the mineral base oils and synthetic oils having a total aromatic content of 20 to 100% by mass given as examples in the description of above-mentioned second embodiment may be cited.

Meanwhile, since the second lubricating base oil is the same as in the description of the lubricating base oil having a total aromatic content of less than 20% by mass in the lubricating oil composition of the second embodiment, except that the total aromatic content is 10% by mass or less, duplicate description will be omitted here.

In the lubricating oil composition according to the third embodiment, the proportion of the first lubricating base oil in the total amount of the first and second lubricating base oils must be, as mentioned above, 1% by mass or greater, preferably 5 to 90% by mass, and more preferably 20 to 80% by mass. If the proportion is less than 1% by mass, effects of increasing the long drain intervals by the combination of the first and second lubricating base oils as well as the organic molybdenum compound not containing sulfur as a constitutive element become insufficient, in particular, balancing high temperature detergency and oxidation stability becomes difficult. In addition, if the proportion exceeds 90% by mass, the viscosity index of the lubricating oil composition tends to be low.

In addition, when using a mineral oil having a sulfur content of 0.2% by mass or more as first lubricating base oil, from the points of high temperature detergency and sulfur content reduction, the proportion of the first lubricating base oil in the total amount of the first and second lubricating base oils is preferably 10 to 60% by mass, and more preferably 20 to 50% by mass.

In addition, the total aromatic content after mixing the first and the second lubricating base oils based on the total amount of mixed base oil is preferably 1% by mass or greater, more preferably 5% by mass or greater, and even more preferably 10% by mass or greater. If the total aromatic content of the mixed base oil is less than the above lower limit value, the effect of increasing the long drain intervals by the combination of the first and the second lubricating base oils as well as the organic molybdenum compound not containing sulfur as a constitutive element tend to be insufficient. In addition, from the point of the ability to raising the viscosity index of the lubricating oil composition, the total aromatic content of the mixed base oil based on the total amount of mixed base oil is preferably 30% by mass or less, and more preferably 20% by mass or less.

In addition, the breakdown of the total aromatic content after mixing the first and the second lubricating base oils, that is to say, the content of monocyclic aromatic content and polycyclic aromatic content, has no particular limitations, and from the point of the ability to achieve even higher level long drain intervals, the polycyclic aromatic content based on the total amount of the mineral base oil is preferably 0.01% by mass or greater, more preferably 0.05% by mass or greater, and more preferably 0.1% by mass or greater. In addition, from the point of high temperature detergency, the polycyclic aromatic content of the mixed base oil based on the total amount of mixed base oil is preferably 10% by mass or less, more preferably 5% by mass or less, even more preferably 3% by mass or less, and particularly preferably 2% by mass or less.

Meanwhile, the monocyclic aromatic content of the mixed base oil of first and second lubricating base oils based on the total amount of mixed base oil is preferably 30% by mass or less, and more preferably 20% by mass or less. If the monocyclic aromatic content of the mixed base oil exceeds the above upper limit value, the viscosity index of the lubricating oil composition tends to be low.

In addition, the sulfur content of the mixed base oil of first and second lubricating base oils is not limited in particular, and is preferably 0.005 to 0.6% by mass, more preferably 0.05 to 0.5% by mass, even more preferably 0.1 to 0.4% by mass, and particularly preferably 0.1 to 0.2% by mass. By setting the sulfur content of the mixed base oil to within the above limits and further selecting a low sulfur base oil, a low sulfur lubricating oil composition can be obtained, having better long drain intervals, and, when used as a lubricating oil for internal combustion engine, allowing detrimental effects on emission gas after-treatment device to be avoided as much as possible.

In addition, the kinematic viscosity of the mixed base oil of first and second lubricating base oils has no particular limitations, and the kinematic viscosity thereof at 100° C. is preferably 20 $mm^2/s$ or less, and more preferably 10 $mm^2/s$ or less. Meanwhile, the kinematic viscosity thereof is preferably 3 $mm^2/s$ or greater, and more preferably 5 $mm^2/s$ or greater. If the kinematic viscosity at 100° C. of the mixed base oil exceeds the previous upper limit value circumstance, the low temperature viscosity characteristics deteriorate, on the other hand, if this kinematic viscosity is less than the above lower limit value, as oil film formation is insufficient at the lubrication spot, lubricity becomes poor and loss of lubricating base oil by evaporation becomes important, both of which being undesirable.

In addition, the viscosity index of the mixed base oil of first and second lubricating base oils has no particular limitations, and in order to obtain excellent viscosity characteristics from a low temperature to a high temperature, the value thereof is preferably 80 or greater, more preferably 95 or greater, and even more preferably 10 or greater. If the viscosity index of the lubricating base oil is lower than the previous lower limit value, the low temperature viscosity characteristics tend to deteriorate.

In addition, the amount of mixed base oil of first and second lubricating base oils lost by evaporation, in terms of NOACK evaporation amount, is preferably 20% by mass or less, more preferably 16% by mass or less, and particularly preferably 10% by mass or less. A NOACK evaporation amount of the lubricating base oil exceeding the previous upper limit value is not desirable, since not only the loss of lubricating oil by evaporation is important, there is the risk that sulfur compound and phosphorus compound, or the metal content within the composition, along with the lubricating base oil, deposit in the emission gas cleaning apparatus when used as a lubricating oil for internal combustion engine, and detrimental effects on emission gas cleaning ability are feared.

In the lubricating oil composition according to the third embodiment, an organic molybdenum compound not containing sulfur as a constitutive element is mixed in the above-mentioned first and second lubricating base oils. Note that, since the organic molybdenum compound not containing sulfur as a constitutive element used in the third embodiment is the same as in the case of the above-mentioned first embodiment, duplicate description will be omitted here.

In the lubricating oil composition according to the third embodiment, the content of the organic molybdenum compound not containing sulfur as a constitutive element is in the range established in amounts in terms of molybdenum element described in the previous section of Embodiment (I), duplicate description will be omitted here.

When preparing the lubricating oil composition according to the third embodiment, there is no particular limitation in the sequence for mixing the first and the second lubricating base oils as well as the organic molybdenum compound not containing sulfur as a constitutive element, and for instance mixing can be carried out in the sequence shown below in (A), (B) or (C).

(A) After mixing the organic molybdenum compound with the first lubricating base oil, mixing this mixture and the second lubricating base oil or the mixed base oil of first and second lubricating base oils.

(B) After mixing the organic molybdenum compound with the second lubricating base oil, mixing this mixture and the first lubricating base oil or the mixed base oil of first and second lubricating base oils.

(C) After mixing the first and the second lubricating base oils, mixing this mixed base oil and the organic molybdenum compound.

Herein, the organic molybdenum compound not containing sulfur as a constitutive element demonstrates higher solubility with respect to the first lubricating base oil than the second lubricating base oil. Therefore, by mixing each constituent in the sequence shown in (A) above, the time required for each organic molybdenum compound to dissolve into the base oil can be shortened sufficiently, and in addition, homogeneity and stability of the organic molybdenum compound in the lubricating base oil can be increased.

The mixing processes shown in (A) to (C) above are preferably carried out under stirring, in addition, the temperature condition during the mixing is optimally 20 to 100° C.

The lubricating oil composition according to the third embodiment, may comprise the above-mentioned first and second lubricating base oils as well as the organic molybdenum compound not containing sulfur as a constitutive element only, and may also further contain, as necessary, various additives described below.

The lubricating oil composition according to the fourth embodiment of the present invention is the above-mentioned fourth lubricating oil composition, and containing an antioxidant composition comprising an organic molybdenum compound and an aromatic solvent (a3), and more concretely, contains the antioxidant composition and a lubricating base oil.

First, the antioxidant composition according to the fourth embodiment will be described in detail.

Since the organic molybdenum compound contained in the antioxidant composition according to the fourth embodiment has the same description as in the section for the organic molybdenum compound in the above-mentioned Embodiment (1), duplicate description will be omitted here.

In the antioxidant composition according to the fourth embodiment, the content of the organic molybdenum compound in terms of molybdenum element based on the total amount of the composition as the reference is preferably 0.1% by mass or greater, more preferably 0.5% by mass or greater, and even more preferably 1% by mass or greater, and in addition, is preferably 20% by mass or less, more preferably 10% by mass or less, and even more preferably 5% by mass or less. If the content of the organic molybdenum compound in terms of molybdenum element is less than 0.1% by mass, the effects of improvement of oxidation stability, ability to retain the base number, high temperature detergency and resistance against NOx by the combined use of the organic molybdenum compound and the aromatic solvent tend to be insufficient, and in addition, even if 20% by mass is exceeded, the above improvement effects tend not to be obtained commensurate to the increase in the content.

In addition, the antioxidant composition according to the fourth embodiment contains an aromatic solvent. As such aromatic solvent, those that are fluid at 0° C. are preferred.

The aromatic solvent may be constituted by either a monocyclic or a polycyclic aromatic compound, and as such aromatic compounds, alkyl benzenes, alkyl naphthalenes, compounds represented by the General Formula (B) or (C) below, and furthermore, polycyclic aromatic compounds having three or more aromatic rings, and the like, may be cited.

As alkyl benzenes, those having an alkyl group having 1 to 40 carbons are preferred. As such alkyl groups, concretely, for instance, methyl group, ethyl group, propyl group (including all isomers), butyl group (including all isomers), pentyl group (including all isomers), hexyl group (including all isomers), heptyl group (including all isomers), octyl group (including all isomers), nonyl group (including all isomers), decyl group (including all isomers), undecyl group (including all isomers), dodecyl group (including all isomers), tridecyl group (including all isomers), tetradecyl group (including all isomers), pentadecyl group (including all isomers), hexadecyl group (including all isomers), heptadecyl group (including all isomers), octadecyl group (including all isomers), nonadecyl group (including all isomers), icosyl group (including all isomers), henicosyl group (including all isomers), docosyl group (including all isomers), tricosyl group (including all isomers), tetracosyl group (including all isomers), pentacosyl group (including all isomers), hexacosyl group (including all isomers), heptacosyl group (including all isomers), octacosyl group (including all isomers), nonacosyl group (including all isomers), triacontyl group (including all isomers), hentriacontyl group (including all isomers), dotriacontyl group (including all isomers), tritriacontyl group (including all isomers), tetratriacontyl group (including all isomers), pentatriacontyl group (including all isomers), hexatriacontyl group (including all isomers), heptatriacontyl group (including all isomers), octatriacontyl group (including all isomers), nonatriacontyl group (including all isomers), tetracontyl group (including all isomers), and the like, may be cited. Among these, alkyl benzenes having one to four (more preferably one to two) alkyl groups having 8 to 30 carbons, and a total number of carbons for these alkyl groups of 10 to 50 (more preferably 20 to 40) are used preferably.

The alkyl group of the alkyl benzene may be linear or branched; however, from the points of stability, viscosity characteristics and the like, branched alkyl groups are preferred, in particular, from the point of availability, branched alkyl groups derived from oligomers of olefins, such as, propylene, butene and isobutylene, are more preferred. The number of alkyl groups in the alkyl benzene is preferably one to four, however from the points of stability and availability, alkyl benzenes having one or two alkyl groups, that is to say, monoalkyl benzenes, dialkyl benzenes, or mixtures thereof are most preferably used.

The above alkyl benzene may be used as one species alone, or may be used as a mixture two or more species. When using a mixture of alkyl benzene of two or more species, the average molecular weight of the mixture is preferably 200 to 500.

The methods for preparing alkyl benzene are arbitrary and not limited in any way, and preparation is generally possible by the synthesis methods shown below. As aromatic compounds serving as starting materials, concretely, for instance, benzene, toluene, xylene, ethyl benzene, methyl ethyl benzene, diethyl benzene, and mixtures thereof, and the like, are used. In addition, as alkylating agents, concretely, for instance, linear or branched olefin having 6 to 40 carbons obtained by polymerization of lower mono olefins, such as ethylene, propylene, butene and isobutylene, preferably propylene; linear or branched olefins having 6 to 40 carbons obtained by thermal decomposition of wax, heavy oil, petroleum content, polyethylene, polypropylene, or the like; linear olefins having 6 to 40 carbons obtained by isolating n-paraffin from the petroleum content of kerosene, gas oil, or the like, and olefinizing this with a catalyst; and mixtures thereof, and the like, can be used.

In addition, as alkylating catalysts during alkylation, well known catalysts, such as, Friedel-Krafts type catalysts such as aluminum chloride and zinc chloride; acidic catalysts such as sulfic acid, phosphoric acid, silico-tungstic acid, hydrofluoric acid, activated earth; are used.

In addition, as alkyl naphthalenes, there are no particular restrictions as long as they have a naphthalene ring and an alkyl group bonded to the naphthalene ring;

however, the compounds represented by the following General Formula (A) are used preferably as alkyl naphthalenes.

[Chemical formula 6]

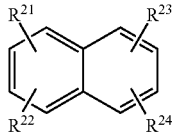

(A)

wherein $R^{21}$, $R^{22}$, $R^{23}$ and $R^{24}$ may be identical or different, each representing a hydrogen atom or a hydrocarbon group having 1 to 40 carbons, and at least one of $R^{21}$, $R^{22}$, $R^{23}$, or $R^{24}$ being an alkyl group.

In the above-mentioned General Formula (A), $R^{21}$, $R^{22}$, $R^{23}$ and $R^{24}$ each represents a hydrogen atom or a hydrocarbon group, the hydrocarbon group including, in addition to alkyl groups, alkenyl groups, aryl groups, alkyl aryl groups, aryl alkyl groups and the like, alkyl groups being preferred.

As alkyl group, concretely, for instance, alkyl groups having 1 to 40 carbons, such as, methyl group, ethyl group, propyl group (including all isomers), butyl group (including all isomers), pentyl group (including all isomers), hexyl group (including all isomers), heptyl group (including all isomers), octyl group (including all isomers), nonyl group (including all isomers), decyl group (including all isomers), undecyl group (including all isomers), dodecyl group (including all isomers), tridecyl group (including all isomers), tetradecyl group (including all isomers), pentadecyl group (including all isomers), hexadecyl group (including all isomers), heptadecyl group (including all isomers), octadecyl group (including all isomers), nonadecyl group (including all isomers), icosyl group (including all isomers), henicosyl group (including all isomers), docosyl group (including all isomers), tricosyl group (including all isomers), tetracosyl group (including all isomers), pentacosyl group (including all isomers), hexacosyl group (including all isomers), heptacosyl group (including all isomers), octacosyl group (including all isomers), nonacosyl group (including all isomers), triacontyl group (including all isomers), hentriacontyl group (including all isomers), dotriacontyl group (including all isomers), tritriacontyl group (including all isomers), tetratriacontyl group (including all isomers), pentatriacontyl group (including all isomers), hexatriacontyl group (including all isomers), heptatriacontyl group (including all isomers), octatriacontyl group (including all isomers), nonatriacontyl group (including all isomers), tetracontyl group (including all isomers) may be cited. Among these, alkyl groups having 8 to 30 carbons are preferred, and alkyl groups having 10 to 20 carbons are more preferred.

In addition, alkyl groups may be linear or branched; however, from the points of stability, viscosity characteristics and the like, branched alkyl groups are preferred, in particular, from the point of availability, branched all groups derived from oligomers of olefins, such as ethylene, propylene, butene and isobutylene, are more preferred.

In addition, in the alkyl naphthalenes represented by General Formula (A), $R^{21}$, $R^{22}$, $R^{23}$ and $R^{24}$ may be identical or different. That is to say, $R^{21}$, $R^{22}$, $R^{23}$ and $R^{24}$ may all be hydrocarbon groups containing an alkyl group, or at least one among $R^{21}$, $R^{22}$, $R^{23}$ and $R^{24}$ may be an alkyl group and the others may be hydrogen atoms. The total number of carbons of $R^2$, $R^{22}$, $R^{23}$ and $R^{24}$, is preferably 8 to 50, and more preferably 10 to 40.

If two or more among $R^{21}$, $R^{22}$, $R^{23}$ and $R^{24}$ are hydrocarbon groups, the combination thereof is arbitrary if at least one among these is an alkyl group; however it is desirable that all are alkyl groups. In addition, two hydrocarbon groups may be bonded on the same benzene ring, such as when $R^{21}$ and $R^{22}$ are hydrocarbon groups, and in addition, one hydrocarbon group each may be bonded on different benzene rings, such as when $R^{21}$ and $R^{23}$ are hydrocarbon groups.

As alkyl naphthalenes represented by General Formula (A), concretely, decyl naphthalene (including all isomers), undecyl naphthalene (including all isomers), dodecyl naphthalene (including all isomers), tridecyl naphthalene (including all isomers), tetradecyl naphthalene (including all isomers), pentadecyl naphthalene (including all isomers), hexadecyl naphthalene (including all isomers), heptadecyl naphthalene (including all isomers), octadecyl naphthalene (including all isomers), nonadecyl naphthalene (including all isomers), icosyl naphthalene (including all isomers), di(decyl)naphthalene (including all isomers), di(undecyl)naphthalene (including all isomers), di(dodecyl)naphthalene (including all isomers), di(tridecyl)naphthalene (including all isomers), di(tetradecyl)naphthalene (including all isomers), di(pentadecyl)naphthalene (including all isomers), di(hexadecyl)naphthalene (including all isomers), di(heptadecyl) naphthalene (including all isomers), di(octadecyl)naphthalene (including all isomers), di(nonadecyl)naphthalene (including all isomers), di(icosyl)naphthalene (including all isomers), and the like, may be cited.

Among these, alkyl naphthalenes having one to four (more preferably one to two) alkyl groups having 8 to 30 carbons (more preferably 10 to 20) are preferred, and in addition, the total number of carbons of the alkyl groups of the alkyl naphthalene is preferably 8 to 50 (more preferably 10 to 40).

The above alkyl naphthalene may be used as one species alone, or as a mixture of two or more species. When using a mixture of two or more species of alkyl naphthalenes, the average molecular weight of the mixture is preferably 200 to 500.

The methods for preparing alkyl naphthalenes are arbitrary, and preparation is possible by a variety of well-known methods. As an example thereof, the method of adding to naphthalene, for instance, halides of hydrocarbon, olefins, styrene and the like, in the presence of acidic catalysts, which are Friedel-Krafts catalysts, such as, mineral acids such as sulfuric acid, phosphoric acid, silico-tungstic acid and hydrofluoric acid, solid acidic substances such as acid clay and activated earth, and metal halides such as aluminum chloride and zinc chloride, and the like [methods], may be cited.

In addition, compounds represented by the following General Formula (B) or (C) can be used as aromatic compounds constituting the aromatic solvent.

[Chemical formula 7]

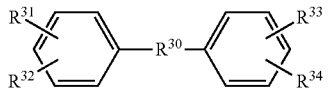

(B)

wherein $R^{30}$ represents an alkylene group or an alkenylene group having 1 to 8 carbons, $R^{31}$, $R^{32}$, $R^{33}$ and $R^{34}$ may be identical or different, each representing a hydrogen atom or an alkyl group having 1 to 4 carbons, and the total number of carbons of $R^{30}$, $R^{31}$, $R^{32}$, $R^{33}$ and $R^{34}$ being 1 to 8.

[Chemical formula 8]

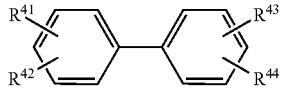

(C)

wherein $R^{41}$, $R^{42}$, $R^{43}$ and $R^{44}$ may be identical or different, each representing a hydrogen atom or a hydrocarbon group having 1 to 10 carbons, and the total number of carbons of $R^1$, $R^2$, $R^3$ and $R^4$ being 1 to 10.]

In addition, as compounds having three or more aromatic rings, polycyclic aromatic compounds having a fluorene ring, an anthracene ring, a phenanthrene ring, a fluoranthene ring, a pyrene ring, a perylene ring, a benzophenanthrene ring, a benzofluoranthene ring, a benzoperylene ring, and the like, may be cited. The aromatic rings of these polycyclic aromatic compounds, may be either substituted or unsubstituted. As substituents of aromatic ring, alkyl groups having 4 to 30 carbons are preferred.

Among the above aromatic compounds, from the point of long drain intervals, aromatic compounds having two rings or more are preferred, at least one species of polycyclic aromatic compound selected from alkyl naphthalene and compounds having three or more aromatic rings are more preferred, and using alkyl naphthalene, fluorene, phenanthrene, benzophenanthrene, anthracene, and alkylation products thereof is even more preferred.

In the fourth embodiment, among the above aromatic compounds, one species may be used alone, and in addition, two or more species may be used in combination.

It is desirable that the content of the aromatic solvent in the antioxidant composition according to the fourth embodiment is selected suitably so that the content of organic molybdenum compound is in the above preferred range.

In the following, the lubricating oil composition according to the fourth embodiment will be described in detail.

The lubricating oil composition according to the fourth embodiment contains a lubricating base oil and the above-mentioned antioxidant composition according to the fourth embodiment.

Herein, the content of the antioxidant composition according to the fourth embodiment in lubricating oil composition according to the fourth embodiment is in the range established in amounts in terms of molybdenum element described in the previous section of Embodiment (I), duplicate description will be omitted here.

As lubricating base oil used in the lubricating oil composition according to the fourth embodiment, mineral base oils or synthetic oils used in conventional lubricating oils can be used with no particular limitation.

Concretely, those [oils] obtained by distillating crude oil at ordinary pressure, subjecting the obtained ordinary pressure residual oil to distillation at reduced pressure, and subjecting the obtained lubricating oil fraction to refining by carrying out one or more treatments, such as, solvent deasphalting, solvent extraction, hydrocracking, solvent dewaxing and hydrogenation refining, or wax isomerized mineral oils and base oils prepared by methods whereby a GTL WAX (gas-to-liquid wax) is isomerized, and the like, can be given as examples of mineral base oils.

As synthetic oils, concretely, polybutene or hydrogenated compounds thereof; poly-α-olefins such as 1-octene oligomer and 1-decene oligomer, or hydrogenated compounds thereof; diesters such as ditridecyl glutarate, di-2-ethyl hexyl adipate, diisodecyl adipate, ditridecyl adipate, and di-2-ethyl hexyl sebacate; polyol esters such as neopentyl glycol ester, trimethylol propane caprylate, trimethylol propane pelargonate, pentaerythritol-2-ethyl hexanoate, and pentaerythritol pelargonate; aromatic synthetic oils such as alkyl benzene, alkyl naphthalene, and aromatic ester, or mixtures thereof, and the like, can be given as examples.

In the fourth embodiment, among the above-mentioned mineral base oils or the above-mentioned synthetic oils, one species may be used alone, or two or more species may be used in combination. The mixed base oil in which two or more species of lubricating base oils have been combined includes mixed base oils of two or more species of mineral base oils, mixed base oils of two or more species of synthetic oils, and mixed base oils of one or more species of mineral base oils and one or more species of synthetic oils.

In the fourth embodiment, among the above lubricating base oils, mineral base oils having a total aromatic content of 10% by mass or less, poly-α-olefins or hydrogenated compounds thereof, and ester type base oils are preferred. Note that, since the mineral base oils having a total aromatic content of 10% by mass or less used in the fourth embodiment is the same as the mineral base oils having a total aromatic content of 10% by mass or less described as the second lubricating base oil in the above third embodiment, duplicate description will be omitted here.

The antioxidant composition and the lubricating oil composition according to the fourth embodiment may respectively comprise the above-mentioned constituents only, and may also contain, as necessary, various additives described below. Note that the method for including the following additives to the lubricating oil composition according to the fourth embodiment may be either method in (I) or (II) below.

(I) After including the following additive in the antioxidant composition according to the fourth embodiment, this antioxidant composition and a lubricating base oil having a total aromatic content of 10% by mass or less are mixed to obtain the lubricating oil composition according to the fourth embodiment.

(II) The following additive and the antioxidant composition according to the fourth embodiment are each mixed separately with a lubricating base oil having a total aromatic content of 10% by mass or less to obtain the lubricating oil composition according to the fourth embodiment.

The lubricating oil composition according to the fifth embodiment of the present invention is the above-mentioned fifth lubricating oil composition, containing a lubricating base oil, an organic molybdenum compound, and at least one species of polycyclic aromatic compound selected from alkyl naphthalene and compounds having three or more aromatic rings (a4).

As lubricating base oil used in the lubricating oil composition according to the fifth embodiment, mineral base oils or synthetic oils used in conventional lubricating oils can be used with no particular limitation. Note that, since concrete examples and preferred examples as well as the preferred ranges of various characteristics of the lubricating base oil used in the fifth embodiment are the same as in the case of the above fourth embodiment, duplicate description will be omitted here.

In addition, the lubricating oil composition according to the fifth embodiment contains an organic molybdenum compound. Since the organic molybdenum compound used in the fifth embodiment has the same description as in the section for the organic molybdenum compound in the above-mentioned Embodiment (I), duplicate description will be omitted here.

Since, the content of the organic molybdenum compound in the lubricating oil composition according to the fifth embodiment is in the range established in amounts in terms of molybdenum element described in the previous section of Embodiment (1), duplicate description will be omitted here.

In addition, the lubricating oil composition according to the fifth embodiment contains at least one species of polycyclic aromatic compound selected from alkyl naphthalene and compounds having three or more aromatic rings (hereinafter, simply referred to as "polycyclic aromatic compounds").

Among the polycyclic aromatic compounds according to the fifth embodiment, as alkyl naphthalenes, there are no particular restrictions as long as they have a naphthalene ring and an alkyl group bonded to the naphthalene ring; however, compounds represented by General Formula (A) given as examples in the description of above fourth embodiment are preferably used. Note that, since the alkyl naphthalenes used in the fifth embodiment are the same as in the case of the above fourth embodiment, duplicate description will be omitted here.

In addition, as compounds having three or more aromatic rings, polycyclic aromatic compounds having fluorene ring, anthracene ring, phenanthrene ring, fluoranthene ring, pyrene ring, perylene ring, benzophenanthrene ring, benzo fluoranthene ring, benzo perylene ring, or the like, may be cited. The aromatic ring of these polycyclic aromatic compounds may be either substituted or unsubstituted. Alkyl groups having 1 to 40 carbons are preferred as aromatic ring substituents.

In the fifth embodiment, among the above alkyl naphthalene and compounds having three or more aromatic rings, one species may be used alone, in addition, two or more species may be used in combination.

Among the above polycyclic aromatic compounds, alkyl naphthalene, fluorene, phenanthrene, benzophenanthrene, anthracene, and alkylation products thereof are used preferably from the point of long drain intervals.

The content of the polycyclic aromatic compound in the lubricating oil composition according to the fifth embodiment based on the total amount of the composition as the reference is preferably 0.01% by mass or greater, more preferably 0.05% by mass or greater, even more preferably 0.1% by mass or greater, and particularly preferably 0.3% by mass or greater. If the content of the polycyclic aromatic compound is less than 0.01% by mass, effect of increasing the long drain intervals tends to be insufficient. In addition, the content of the polycyclic aromatic compound based on the total amount of the composition as the reference is preferably 50% by mass or less, more preferably 30% by mass or less, even more preferably 20% by mass or less, all the more preferably 10% by mass or less, particularly preferably 5% by mass or less, and most preferably 3% by mass or less. Even if the content of the polycyclic aromatic compound exceeds 50% by mass, the effect of increasing the long drain intervals tends not to be obtained commensurate to the content, and furthermore, raising the viscosity index of the lubricating oil composition is difficult, and in addition, the costs tend to increase.

In addition, in the fifth embodiment, the mixing quantity of the polycyclic aromatic compound with respect to the lubricating base oil is, with respect to 100 parts in mass of the lubricating base oil, preferably 0.01 parts in mass or greater, more preferably 0.05 parts in mass or greater, even more preferably 0.1 parts in mass or greater, and particularly preferably 0.3 parts in mass or greater. If the mixing quantity of the polycyclic aromatic compound with respect to lubricating base oil 100 parts in mass is less than 0.01 parts in mass, the effect of increasing the long drain intervals tends to be insufficient. In addition, mix quantity of the polycyclic aromatic compound with respect to the lubricating base oil is, with respect to 100 parts in mass of lubricating base oil, preferably 50 parts in mass or less, more preferably 30 parts in mass or less, even more preferably 20 parts in mass or less, all the more preferably 10 parts in mass or less, particularly preferably 5 parts in mass or less, and most preferably 3 parts in mass or less. If, with respect to 100 parts in mass of lubricating base oil, 50% by mass is exceeded, even if the polycyclic aromatic compound mixed, the effect of increasing the long drain intervals tend not to be obtained commensurate to the mixing quantity.

The lubricating oil composition according to the fifth embodiment may comprise a lubricating base oil, an organic molybdenum compound and a polycyclic aromatic compound only, and may also further contain, as necessary, various additives described below.

The lubricating oil composition according to the sixth embodiment of the present invention is the above-mentioned sixth lubricating oil composition, containing a lubricating base oil, an organic molybdenum compound, and an aromatic compound having a nitrogen atom, an oxygen atom or a sulfur atom (a5).

As lubricating base oil used in the lubricating oil composition according to the sixth embodiment, mineral base oils or synthetic oils used in conventional lubricating oils can be used with no particular limitation. Note that, since concrete examples and preferred examples as well as the preferred ranges of various characteristics of the lubricating base oil used in the sixth embodiment are the same as in the case of the above fourth embodiment, duplicate description will be omitted here.

In addition, since the organic molybdenum compound used in the sixth embodiment has the same description as in the section for the organic molybdenum compound in the above-mentioned Embodiment (I), duplicate description will be omitted here.

Since, the content of the organic molybdenum compound in the lubricating oil composition according to the sixth embodiment is in the range established in amounts in terms of molybdenum element described in the previous section of Embodiment (1), duplicate description will be omitted here.

In addition to the above organic molybdenum compound, the lubricating oil composition according to the sixth embodiment contains an aromatic compound having a nitrogen atom, an oxygen atom or a sulfur atom. The aromatic compounds represented by the following General Formula (1) are preferably used as such aromatic compound.

[Chemical formula 9]

$$(R)_a\text{-}A\text{-}(X)_b \qquad (1)$$

wherein A represents an aromatic ring, X represents a monovalent functional group having at least one nitrogen atom, oxygen atom or sulfur atom, R represents an organic group having 1 to 40 carbons (with the proviso that the tert-butyl group is excluded), a represents an integer of 1 or greater, b represents an integer of 1 or greater when A is an aromatic carbocyclic ring, and b represents an integer of 0 or 1 or greater when A is a heteroaromatic ring.]

The aromatic ring represented by A in the above General Formula (1) is not limited in particular as long as it has an aromaticity, and may be either an aromatic carbocyclic ring or a heteroaromatic ring.

The aromatic ring represented by A may be either an aromatic carbocyclic ring or a heteroaromatic ring, and concretely, benzene ring, naphthalene ring, fluorene ring, anthracene ring, phenanthrene ring, fluoranthene ring, pyrene ring, perylene ring, pyrrole ring, imidazole ring, pyrazole ring, pyridine ring, pyrazine ring, pyrimidine ring, indole ring, quinoline ring, isoquinoline ring, quinolizine ring, thiazole ring, isothiazole ring, oxazole ring, isooxazole ring, triazine ring, furan ring, thiophene ring, imidazoline ring, pyrrolidine ring, piperidine ring, piperazine ring, pyridazine ring, purine ring, quinazoline ring, acridine ring, carbazole ring, phenothiazine ring, phenoxazine ring, phenanthroline ring, benzotriazole ring, indazole ring, benzimidazole ring, porphyrin ring, phthalocyanine ring, and derivatives thereof, and the like, may be cited. Among these, as aromatic ring represented by A, benzene ring, naphthalene ring, fluorene ring, anthracene ring, phenanthrene ring, quinoline ring, biquinoline ring, pyridine ring, bipyridine ring, terpyridine ring, phenanthroline ring, pyrrole ring and indole ring are preferred.

In addition, as organic group having 1 to 40 carbons represented by R, alkyl groups having 1 to 40 carbons (with the proviso that the tert-butyl group is excluded), as well as groups having an SH group, a OH group or an $NH_2$ group bonded to the side chain or the extremity of these alkyl groups are preferred. As alkyl groups having 1 to 40 carbons, concretely, methyl group, ethyl group, n-propyl group, isopropyl group, linear or branched butyl group, linear or branched pentyl group, linear or branched hexyl group, linear or branched heptyl group, linear or branched octyl group, linear or branched nonyl group, linear or branched decyl group, linear or branched undecyl group, linear or branched dodecyl group, linear or branched tridecyl group, linear or branched tetradecyl group, linear or branched pentadecyl group, linear or branched hexadecyl group, linear or branched heptadecyl group, linear or branched octadecyl group, linear or branched nonadecyl group, linear or branched icosyl group, linear or branched henicosyl group, linear or branched docosyl group, linear or branched tricosyl group, linear or branched tetracosyl group, linear or branched pentacosyl group, linear or branched hexacosyl group, linear or branched heptacosyl group, linear or branched octacosyl group, linear or branched nonacosyl group, linear or branched triacontyl group, linear or branched hentriacontyl group, linear or branched dotriacontyl group, linear or branched tritriacontyl group, linear or branched tetratriacontyl group, linear or branched pentatriacontyl group, linear or branched hexatriacontyl group, linear or branched heptatriacontyl group, linear or branched octatriacontyl group, linear or branched nonatriacontyl group, linear or branched tetracontyl group, and the like (including all isomers), may be cited. Among these, as organic groups represented by R, linear or branched alkyl groups having a number of carbon of preferably 4 to 30, more preferably 6 to 24, and even more preferably 8 to 18, are preferred.

In addition, X in General Formula (1) represents a monovalent functional group having at least one sulfur atom, oxygen atom or nitrogen atom. As functional group represented by X, the mercapto group (—SH), the hydroxyl group (—OH), the amino group (—$NH_2$), the imino group, the azo group, the diazo group, the oxy imino group, the oxy amino group, the hydrazo group, the hydrazi group, the diazo amino group, the carbamoyl group, the carbonyl group, the thio carbonyl group, the isocyanogen group, and the like, may be cited, among which, the mercapto group, the amino group and the oxy group are preferred, and from the point of sulfur content reduction of the lubricating oil composition, the oxy group or the amino group is more preferred.

a in General Formula (1) represents an integer of 1 or greater, and preferably an integer from 1 to 3. Note that when a is 2 or greater, the a R [groups] may be identical or different. From the point of excellent effects in the combined use with an organic molybdenum compound, a is preferably 1 or 2.

In addition, b represents an integer of 1 or greater when A is an aromatic carbocyclic ring, and b represents an integer of 0 or 1 or greater when A is a heteroaromatic ring. When b is 2 or greater, the b X [groups] may be identical or different. From the point of excellent effects in the combined use with an organic molybdenum compound, b is preferably 1 or 2.

The molecular weight of the aromatic compound represented by General Formula (1) has no particular limitations, and is preferably 150 to 1000, and more preferably 250 to 500. If the molecular weight of the aromatic compound is less than the above lower limit value, oxidation stability at high temperature tends to be poor, on the other hand, if the above upper limit value is exceeded, the effects with respect to the mixing quantity tend to be smaller.

Among the aromatic compounds represented by the General Formula (1), as preferred examples of aromatic carbocyclic compounds, concretely, compounds derived from aromatic carbocyclic compounds having a benzoyl group, a phenyl acetyl group, a phenacyl group, a benzyl oxy group, a benzoyl oxy group, a p-toluoyl group, an anilino group, a phenyl imino group, a phenyl azo group, a benzamide group, a benzene sulfinyl group, a benzene sulfonyl group, a benzene sulfonamide group, a sulfanyl group, a naphthyl oxy group, a naphthoyl group, a naphthoyl oxy group, or the like, and alkylation products thereof, and the like, may be cited. More concretely, compounds derived from triazine, salicyl aldehyde, 2-oxy azo compound, 2-hydroxy naphthaldehyde-1,2-hydroxy haphthaldehyde-3,C-methyl benzoyl acetone, cis or trans-α-benzoin oxime, salicyl aldoxime, bis salicyl aldoxime, bis salicyl aldehyde ethylene diimine, bis benzoyl acetonate, eriochrome black T, alizarin, o-amino phenol, isophthalic acid dihydrazide and polymer thereof with isophthalic acid dichloride, glyoxal bis hydroxyanil and thio derivatives thereof, as well as alkylation products thereof, and the like, may be cited.

In addition, among the aromatic compounds represented by General Formula (1), as preferred examples of compounds having heteroaromatic ring, concretely, compounds derived from indole, indazole, benzimidazole, methyl benzotriazole, quinoline, isoquinoline, quinazoline, acridine, carbazole, phenothiazine, phenoxazine, oxine, quinaldic acid, picolinic acid, 2,2'-bipyridine, 3,3'-dimethyl-2,2'-bipyridine, 6,6'-dimethyl-2,2'-bipyridine, 1,10-phenanthroline, terpyridine, biquinoline, phthalocyanine, 8-oxy quinoline, 8-mercapto quinoline, 2-methyl oxine, 8,8'-dioxy-5,5'-biquinolyl, and alkylation products thereof, and the like, may be cited.

Among these, as aromatic compounds represented by General Formula (1), alkyl phenol, alkyl catechol, alkyl aniline, alkyl salicyl aldehyde, alkyl naphthol, alkyl naphthyl aldehyde, alkyl naphthyl amine, alkyl pyridine, alkyl bipyridine, alkyl indole, alkyl oxyquinolinoline, alkyl mercaptoquinolinoline, alkyl quinazoline, alkyl acridine, alkyl carbazole, alkyl phenoxazine are preferred. In addition, the number of carbons in the alkyl group of these aromatic compounds is preferably 1 to 40.

In the lubricating oil composition according to the sixth embodiment, the content of the aromatic compound represented by General Formula (1) based on the total amount of the composition as the reference is preferably 0.01% by mass or greater, more preferably 0.1% by mass or greater, even more preferably 0.5% by mass or greater, and in addition, preferably 5% by mass or less, more preferably 3% by mass or less, and even more preferably 2% by mass or less. If the content of the compound represented by General Formula (1) is less than the above lower limit value, the effects of improvement of oxidation stability, ability to retain the base number, high temperature detergency and resistance against NOx by the use in combination with the organic molybdenum compound tend to be insufficient, and in addition, even if the above upper limit value is exceeded, the above improvement effects tend not to be obtained commensurate to the increase in the content.

The lubricating oil composition according to the sixth embodiment may comprise the above lubricating base oil, the organic molybdenum compound and the aromatic compound represented by General Formula (1) only, and can also include various additives described below according to the application thereof.

The above Embodiment (I) and the lubricating oil composition according to the first to the sixth embodiments of the present invention preferably further contain at least one species of phosphorus-containing additive phosphorus-containing anti-wear agent) selected from the phosphorus compounds represented by General Formula (2), the phosphorus compounds represented by General Formula (3) and metal salts however, molybdenum salts are excluded) or amine salts thereof.

[Chemical formula 10]

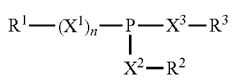

(2)

wherein $R^1$ represents a hydrocarbon group having 1 to 30 carbons, $R^2$ and $R^3$ may be identical or different, each representing a hydrogen atom or a hydrocarbon group having 1 to 30 carbons, $X^1$, $X^2$ and $X^3$ may be identical or different, each representing an oxygen atom or a sulfur atom, and n represents 0 or 1, at least one among $X^2$ or $X^3$ representing an oxygen atom when n represents 0, and at least one among $X^1$, $X^2$ or $X^3$ representing an oxygen atom when n represents 1.

[Chemical formula 11]

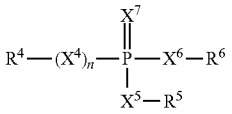

(3)

wherein $R^4$ represents a hydrocarbon group having 1 to 30 carbons, $R^5$ and $R^6$ may be identical or different, each representing a hydrogen atom or a hydrocarbon group having 1 to 30 carbons, $X^1$, $X^5$, $X^6$ and $X^7$ may be identical or different, each representing an oxygen atom or a sulfur atom, and n represents 0 or 1, at least two among $X^5$, $X^6$ or $X^7$ representing oxygen atoms when n represents 0, and at least three among $X^4$, $X^5$, $X^6$ or $X^7$ representing oxygen atoms when n represents 1. As hydrocarbon groups having 1 to 30 carbons represented by $R^1$ to $R^6$, in the above General Formulae (2) and (3), concretely, alkyl groups, cycloalkyl groups, alkenyl groups, alkyl-substituted cycloalkyl groups, aryl groups, alkyl-substituted aryl groups, and aryl alkyl groups can be cited.

As the above alkyl groups, for instance, alkyl groups such as methyl group, ethyl group, propyl group, butyl group, pentyl group, hexyl group, heptyl group, octyl group, nonyl group, decyl group, undecyl group, dodecyl group, tridecyl group, tetradecyl group, pentadecyl group, hexadecyl group, heptadecyl group and octadecyl group (these alkyl groups may be linear or branched) can be cited.

As the above cycloalkyl groups, for instance, cycloalkyl groups having 5 to 7 carbons, such as, cyclopentyl group, cyclohexyl group and cycloheptyl group can be cited. In addition, as the above alkyl cycloalkyl groups, for instance, alkyl cycloalkyl groups having 6 to 11 carbons, such as, methyl cyclopentyl group, dimethyl cyclopentyl group, methyl ethyl cyclopentyl group, diethyl cyclopentyl group, methyl cyclohexyl group, dimethyl cyclohexyl group, methyl ethyl cyclohexyl group, diethyl cyclohexyl group, methyl cycloheptyl group, dimethyl cycloheptyl group, methyl ethyl cycloheptyl group and diethyl cycloheptyl group (the position of the alkyl group substitution onto the cycloalkyl group is also arbitrary) can be cited.

As the above alkenyl group, for instance, alkenyl groups such as, butenyl group, pentenyl group, hexenyl group, heptenyl group, octenyl group, nonenyl group, decenyl group, undecenyl group, dodecenyl group, tridecenyl group, tetradecenyl group, pentadecenyl group, hexadecenyl group, heptadecenyl group and octadecenyl group (these alkenyl groups may be linear or branched; in addition, the position of the double-bond is also arbitrary) can be cited.

As the above aryl group, for instance, aryl groups such as phenyl group and naphthyl group can be cited. In addition as the above alkyl aryl groups, for instance, alkyl aryl groups having 7 to 18 carbons, such as, tolyl group, xylyl group, ethyl phenyl group, propyl phenyl group, butyl phenyl group, pentyl phenyl group, hexyl phenyl group, heptyl phenyl group, octyl phenyl group, nonyl phenyl group, decyl phenyl group, undecyl phenyl group and dodecyl phenyl group (alkyl group may be linear or branched, in addition aryl group the position of substitution onto the aryl group is also arbitrary) can be cited.

As the above aryl alkyl groups, for instance, aryl alkyl groups having 7 to 12 carbons, such as, benzyl group, phenylethyl group, phenyl propyl group, phenyl butyl group, phenyl pentyl group and phenyl hexyl group (these alkyl groups may be linear or branched) can be cited.

The hydrocarbon groups having 1 to 30 carbons represented by the above $R^1$ to $R^6$, are preferably alkyl groups having 1 to 30 carbons or aryl groups having 6 to 24 carbons, even more preferably alkyl groups having 3 to 18 carbons, and even more preferably having 4 to 12 carbons.

As phosphorus compounds represented by General Formula (2), for instance, phosphorous monoester, mono thio phosphorous monoester, (hydrocarbyl)phosphonous acid and (hydrocarbyl)mono thio phosphonous acid having one above-mentioned hydrocarbon group having 1 to 30 carbons; phosphorous diester, mono thio phosphorous diester, (hydrocarbyl)phosphonous acid monoester and (hydrocarbyl) mono thio phosphonous acid monoester having two above-mentioned hydrocarbon groups having 1 to 30 carbons; phosphorous triester, mono thio phosphorous triester, (hydrocarbyl) phosphonous acid diester and (hydrocarbyl)mono thio phosphonous acid diester having three above-mentioned hydrocarbon group having 1 to 30 carbons; and mixtures thereof, or the like, may be cited.

The compounds represented by General Formula (2) are preferably compounds in which $X^1$ to $X^3$ are all oxygen atoms, that is to say, compounds represented by the following General Formula (4).

[Chemical formula 12]

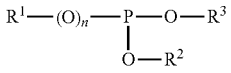

(4)

wherein $R^1$ represents a hydrocarbon group having 1 to 30 carbons, $R^2$ and $R^3$ may be identical or different, each representing a hydrogen atom or a hydrocarbon group having 1 to 30 carbons, and n represents 0 or 1.

As phosphorus compound represented by General Formula (3), for instance, phosphoric acid monoester, mono thio phosphoric acid monoester, (hydrocarbyl)phosphonic acid and (hydrocarbyl)mono thio phosphonic acid having one above-mentioned hydrocarbon group having 1 to 30 carbons; phosphodiester, mono thio phosphodiester, (hydrocarbyl)phosphonic acid monoester and (hydrocarbyl)mono thio phosphonic acid monoester having two above-mentioned hydrocarbon groups having 1 to 30 carbons; phosphoric acid triester, mono thio phosphoric acid triester, (hydrocarbyl) phosphonic acid diester and (hydrocarbyl)mono thio phosphonic acid diester having three above-mentioned hydrocarbon groups having 1 to 30 carbons; and mixtures thereof, or the like, may be cited.

The compounds represented by General Formula (3) are preferably compounds in which $X^4$ to $X^7$ are all oxygen atoms, that is to say, compounds represented by the following General Formula (5).

[Chemical formula 13]

(5)

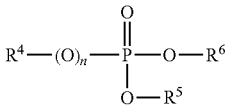

wherein $R^4$, $R^5$ and $R^6$ may be identical or different, each representing a hydrogen atom or a hydrocarbon group having 1 to 30 carbons, and n represents 0 or 1.

In addition, metal salts or amine salts of the phosphorus compounds represented by General Formula (2) or (3) can be obtained by action, onto the phosphorus compounds represented by General Formula (2) or (3), of a metallic base, such as, metallic oxide, metallic hydroxide, metallic carbonate, and metallic chloride, a nitrogen compound, such as, ammonia, amine compounds having within the molecule only a hydrocarbon group having 1 to 30 carbons or a hydroxyl group-containing hydrocarbon group, and neutralization of a part or the entirety of the remaining acidic hydrogens.

As metals in the above metallic bases, concretely, alkali metals such as lithium, sodium, potassium and cesium, alkaline earth metals such as calcium, magnesium and barium, heavy metals such as zinc, copper, iron, lead, nickel, silver and manganese (however, molybdenum is excluded), and the like, may be cited. Among these, alkaline earth metals such as calcium and magnesium, and zinc are preferred, and zinc is particularly preferred.

Note that the metal salts of the above phosphorus compound have different structures depending on the valence of the metal or the number of OH groups or SH groups in the phosphorus compound, therefore, the structure of the metal salt of the phosphorus compound is not restricted in any way. For instance, although it is believed that when 1 mol of zinc oxide is reacted with 2 mol of phosphodiester (a compound having one OH group), a compound having the structure represented by the following Formula (6) is obtained as the principal component, it is also believed that a polymerized molecule is also present.

[Chemical formula 14]

(6)

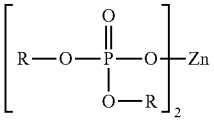

wherein R represents respectively independently a hydrogen atom or a hydrocarbon group having 1 to 30 carbons.

In addition, for instance, although it is believed that when 1 mol of zinc oxide and 1 mol of phosphoric acid monoester (a compound with two OH groups) are reacted, a compound having the structure represented by the following Formula (7) is obtained as the principal component, it is also believed that a polymerized molecule is also present.

[Chemical formula 15]

(7)

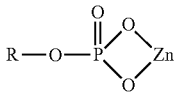

wherein R represents a hydrogen atom or a hydrocarbon group having 1 to 30 carbons.

In addition, as the above nitrogen compounds, concretely, monoamines, diamines, polyamines, alkanol amines, and the like, given as examples in the description of above-mentioned molybdenum-amine complexes may be cited. In addition, heterocyclic compounds such as n-hydroxyethyl oleyl imidazoline, amine alkylene oxide adducts to an amine compound, or the like, can also be used.

Among these nitrogen compounds, aliphatic amines having an alkyl group or an alkenyl group having 10 to 20 carbons, such as, decyl amine, dodecyl amine, tridecyl amine, heptadecyl amine, octadecyl amine, oleyl amine and stearyl amine (these may be linear or branched) can be given as preferred examples.

Regarding the above phosphorus-containing additives, one species may be used alone, and in addition, two or more species may be used in combination.

As phosphorus-containing additives, phosphorus compounds represented by the above-mentioned General Formula (4) or (5) or metal salts thereof (excluding molybdenum salts) are preferred, among which, salts of phosphorous acid diesters having two alkyl groups or aryl groups having 3 to 18 carbons and zinc or calcium, salts of phosphorous acid triesters having three alkyl groups or aryl groups having 3 to 18 carbons, preferably alkyl groups having 6 to 12 carbons, phosphoric acid monoester having one alkyl group or aryl group having 3 to 18 carbons and zinc or calcium, salt of phosphoric acid diester having two alkyl group or aryl group having 3 to 18 carbons and zinc or calcium, or phosphoric acid triesters having three alkyl groups or aryl groups having 3 to 18 carbons, and preferably alkyl groups having 6 to 12 carbons, salts of (hydrocarbyl)phosphonous acid having one alkyl group or aryl group having 1 to 18 carbons and zinc or calcium, salts of (hydrocarbyl) phosphonous acid monoesters having two alkyl groups or aryl groups having 1 to 18 carbons and zinc or calcium, (hydrocarbyl)phosphonous acid diesters having three alkyl groups or aryl groups having 1 to 18 carbons, salts of (hydrocarbyl)phosphonic acid having one alkyl group or aryl group having 1 to 18 carbons and zinc or calcium, salts of (hydrocarbyl)phosphonic acid monoester having two alkyl groups or aryl groups having 1 to 18 carbons and zinc or calcium, (hydrocarbyl) phosphonic acid diesters having three alkyl groups or aryl groups having 1 to 18 carbons are preferred.

As the above (hydrocarbyl)phosphonic(nous) acids, metal salts thereof, (hydrocarbyl)phosphonic(nous) acid monoesters, metal salts thereof, as well as (hydrocarbyl) phosphonic(nous) acid diesters, the total number of carbons of the hydrocarbon groups is preferably 12 to 30 from the points of oil solubility and extreme pressure properties, more preferably 14 to 24, and even more preferably 16 to 20. In the lubricating oil composition according to the above Embodiment (I) and the first to the sixth embodiments of the present invention, the content of the phosphorus-containing additive in terms of phosphorus element based on the total amount of the composition as the reference is preferably 0.005% by mass or greater, more preferably 0.01% by mass or greater, even more preferably 0.02% by mass or greater, in addition, preferably 0.5% by mass or less, more preferably 0.2% by mass or less, even more preferably 0.1% by mass or less, and particularly preferably 0.08% by mass or less. If the content of the phosphorus-containing additive in terms of phosphorus element is less than 0.005% by mass anti-wear properties become insufficient, and longer drain intervals tend to be difficult to achieve. On the other hand, even if the content of phosphorus-containing additive in terms of phosphorus element exceeds 0.5% by mass, the above improvement effects tend not to be obtained commensurate to the increase in the content, and in addition, when the lubricating oil composition of the first embodiment is used as a lubricating oil for internal combustion engine, detrimental effects of phosphorus on the emission gas after-treatment device is feared. From the point of the ability to decrease notably the influence on the emission gas after-treatment device, the content of phosphorus-containing additive in terms of phosphorus element is preferably 0.08% by mass or less, and in particular 0.05% by mass or less.

Note that, regarding the compounds containing sulfur among the above-mentioned phosphorus-containing additive, inclusion is also possible within the limits of the above amount of phosphorus element, and the compound content in terms of amount of sulfur element is preferably 0.1% by mass or less, and more preferably 0.08% by mass or less. Then, the lubricating oil composition according to the above Embodiment (I) and the first to the sixth embodiments, position of the present invention most preferably does not contain a compound containing sulfur as phosphorus-containing additive, that is to say, the phosphorus-containing additive is constituted solely by the phosphorus compounds represented by General Formula (4) or (5) or metal salts thereof (excluding molybdenum salts) or amine salts thereof.

In addition, the above Embodiment (1) and the lubricating oil composition according to the first to the sixth embodiments of the present invention preferably further contains a metallic detergent, in order to improve further the acid neutralization properties, high temperature detergency and anti-wear properties thereof.

As metallic detergent, for instance, alkali metal sulfonate or alkaline earth metal sulfonate, alkali metal phenate or alkaline earth metal phenate, alkali metal salicylate or alkaline earth metal salicylate, alkali metal phosphonate or alkaline earth metal phosphonate, or mixtures thereof, and the like, may be cited.

As alkali metal or alkaline earth metal sulfonate, more concretely, for instance, alkali metal salts or alkaline earth metal salts, and in particular, magnesium salts and/or calcium salts, of alkyl aromatic sulfonic acids obtained by sulfonation of an alkyl aromatic compound having a molecular weight of 100 to 1500, and preferably 200 to 700, are used preferably, and as alkyl aromatic sulfonic acids, concretely, the so-called petroleum sulfonic acids, synthetic sulfonic acids, and the like, may be cited.

As petroleum sulfonic acids, generally, those obtained by sulfonation of alkyl aromatic compounds of the lubricating oil fraction of a mineral oil, the by-product generated during white oil manufacturing, the so-called mahogany acid, and the like, are used. In addition, as synthetic sulfonic acids, for instance, those obtained by sulfonation, with, serving as the source material, an alkyl benzene having a linear or branched alkyl group generated as a by-product from an alkyl benzene manufacturing plant to be the source material of a cleaner, or obtained by alkylating benzene with a polyolefin, or those obtained by sulfonation of dinonyl naphthalene, and the like, are used. In addition, although there are no particular limitations as sulfonation agents when sulfonating these alkyl aromatic compounds, in general, fuming sulfuric acid and sulfuric acid are used.

As alkali metal or alkaline earth metal phenates, more concretely, alkali metal salts or alkaline earth metal salts, in particular magnesium salts and/or calcium salts of alkyl phenols having at least one linear or branched alkyl group having 4 to 30 carbons, preferably 6 to 18, alkyl phenol sulfides obtained by reacting this alkyl phenol and an elementary sulfur or Mannich reaction products of alkyl phenols obtained by reacting this alkyl phenol and formaldehyde, or the like, are preferably used.

As alkali metal or alkaline earth metal salicylates, more concretely, alkali metal salts or alkaline earth metal salts, in particular magnesium salts and/or calcium salts of alkyl salicylic acids having at least one linear or branched alkyl group having 4 to 30 carbons, preferably 6 to 18, or the like, are preferably used.

In addition, alkali metal or alkaline earth metal sulfonates, alkali metal or alkaline earth metal phenates and alkali metal or alkaline earth metal salicylates not only include neutral salts (normal salts) obtained by reacting alkyl aromatic sulfonic acids, alkyl phenols, alkyl phenol sulfides, Mannich reaction products of alkyl phenols, alkyl salicylic acid, and the like, directly with a metallic base such as oxides and hydroxides of alkali metal or alkaline earth metal, or once they have been turned into alkali metal salts such as sodium salts and potassium salts, by substitution with an alkaline earth metal salt, or the like, but furthermore, basic salts obtained by heating neutral salts (normal salts) thereof and excess alkali metal or alkaline earth metal salts or alkali metal or alkaline earth metal bases (hydroxides or oxides of alkali metal or alkaline earth metal) in the presence of water, and over-based salts (ultra basic salts) obtained by reacting neutral salts (normal salts) with a base such as a hydroxide of alkali metal or alkaline earth metal in the presence of carbon dioxide or boric acid or a borate salt. Note that these reactions are carried out in general, in a solvent (aliphatic hydrocarbon solvent such as hexane, aromatic hydrocarbon solvent such as xylene, base oil for light lubricating oil and the like).

In addition, a metallic detergent is in general commercialized in a form diluted with base oil for light lubricating oil or the like, and is available, and in general, using those having a metallic content thereof of 1.0 to 20% by mass, preferably 2.0 to 16% by mass is desirable. In addition, the total base number of metallic detergent is in general 0 to 500 mg KOH/g, and preferably 20 to 450 mg KOH/g. Note that the total base number referred to herein means the total base number as measured by the perchloric acid method according to 7. in JIS K2501 "Petroleum Products and Lubricants—Determination of Neutralization Number".

In the above Embodiment (I) and the lubricating oil composition according to the first to the sixth embodiments of the present invention, one species alone or two or more species in combination selected from sulfonate, phenate, salicylate, or the like of alkali metal or alkaline earth metal, can be used. Alkali metal or alkaline earth metal salicylate is particularly preferred as metallic detergent, on the point that friction reduction effect and/or anti-wear effect are large due to low ash, and the point that long drain intervals are excellent. In addition, from the point that increase in acid number can be further suppressed, using alkali metal or alkaline earth metal sulfonate is particularly preferred.

The metal ratio of the metallic detergent is not limited in particular, and those having 20 or less can be used in general; however from the point of the ability to increase further the friction reduction effect and long drain intervals, inclusion of one species or two or more species selected from metallic detergents having a metal ratio of 1 to 10 is preferred. Note that metal ratio referred to herein is represented by the valence of metal element in the metallic detergent x metal element content (mol %)/soap group content (mol %), and metal element means calcium, magnesium and the like, and soap group means sulfonic acid group, salicylic acid group and the like.

As metallic detergent, alkali metal or alkaline earth metal salicylate is particularly preferred on the point of large friction reduction effect due to low ash, and the point of better long drain intervals. In addition, alkali metal or alkaline earth metal sulfonate is particularly preferred on the point of the ability to suppress increase in viscosity.

The upper limit value of the content of metallic detergent in the above Embodiment (I) and the lubricating oil composition according to the first to the sixth embodiments of the present invention is not limited in particular, and is in general 0.5% by mass or less based on the total amount of the composition as the reference; however, in general, it is preferably adjusted according to other additives so that the sulfated ash of the composition becomes 1.0% by mass or less based on the total amount of the composition as the reference. From such points of view, the content of the metallic detergent in terms of amount of metal element based on the total amount of the composition as the reference is preferably 0.3% by mass or less, and even more preferably 0.23% by mass or less. In addition, the content of metallic detergent is preferably 0.01% by mass or greater, more preferably 0.02% by mass or greater, and even more preferably 0.15% by mass or greater. Note that a metallic detergent content of less than 0.01% by mass is not desirable, as long drain intervals capabilities such as high temperature detergency, oxidation stability, and ability to retain the base number become difficult to obtain.

In addition, the mass ratio (M/Mo) of metal (M) contained in the metallic detergent and molybdenum (Mo) contained in the organic molybdenum compound not containing sulfur as a constitutive element is preferably 0.1 to 500, more preferably 2 to 100, even more preferably 3 to 60, all the more preferably 5 to 50, and particularly preferably 10 to 40.

In addition, the above Embodiment (I) and the lubricating oil composition according to the first to the sixth embodiments of the present invention preferably further contain an ashless dispersant.

Any ashless dispersant used in a lubricating oil can be used as ashless dispersant, for instance, nitrogen compounds containing at least one linear or branched alkyl group or alkenyl group having 40 to 400 carbons within the molecule, or derivatives thereof, or modification products of alkenyl succinimide, and the like, may be cited. Any one species, or two species or more selected from these can be mixed.

The number of carbons of this alkyl group or alkenyl group is 40 to 400, and preferably 60 to 350. If the number of carbons of the alkyl group or alkenyl group is less than 40, the solubility of the compound with respect to the lubricating base oil decreases, on the other hand, if the number of carbons of the alkyl group or alkenyl group exceeds 400, the low temperature fluidity of the lubricating oil composition deteriorates, such that neither is desirable. Although this alkyl group or alkenyl group may be linear or branched, concretely, branched alkyl groups and branched alkenyl groups derived from oligomers of olefins such as propylene, 1-butene and isobutylene, and co-oligomers of ethylene and propylene, and the like, may be cited as preferred ones.

As specific examples of ashless dispersant, for instance, the following compounds may be cited. One species, or two or more species of compounds selected from among these can be used.

(I) succinimides having at least one alkyl group or alkenyl group having 40 to 400 carbons within the molecule, or derivatives thereof (II) benzylamines having at least one alkyl group or alkenyl group having 40 to 400 carbons within the molecule, or derivatives thereof (III) polyamines having at least one alkyl group or alkenyl group having 40 to 400 carbons within the molecule, or derivatives thereof.

As the above-mentioned (1) succinimide, more concretely, the compounds represented by the following General Formula (8) or (9), and the like, can be given as examples.

[Chemical formula 16]

(8)

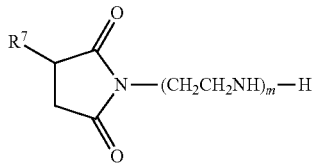

wherein $R^7$ represents an alkyl group or an alkenyl group having a number of carbons of 40 to 400, and preferably 60 to 350, and m represents an integer from 1 to 5, and preferably from 2 to 4.

[Chemical formula 17]

(9)

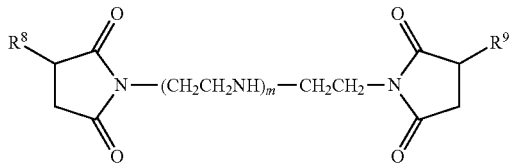

wherein $R^8$ and $R^9$ each separately represent an alkyl group or an alkenyl group having a number of carbons of 40 to 400, preferably 60 to 350, and even more preferably a polybutenyl group, and m represents an integer from 0 to 4, and preferably from 1 to 3.

Note that succinimides include so-called mono type succinimides represented by Formula (8), in which a succinic anhydride is added at one extremity of a polyamine, and so-called bis type succinimides represented by Formula (9), in which succinic anhydrides are added at both extremities of a polyamine, and in the lubricating oil composition of the first embodiment, only one of these may be included, or mixtures thereof may be included.

There is no particular limitation in the preparation of the above-mentioned succinimide, which can be obtained by, for instance, reacting a combination having an alkyl group or an alkenyl group having 40 to 400 carbons with maleic anhydride at 100 to 200° C. to obtain an alkyl or alkenyl succinic acid which is then reacted with a polyamine. As polyamine, concretely, diethylene triamine, triethylene tetramine, tetraethylene pentamine, and pentaethylene hexamine, and the like, can be given as examples.

As the above-mentioned (II) benzylamine) benzylamine, more concretely, the compound represented by the following General Formula (10), and the like, can be given as examples.

[Chemical formula 18]

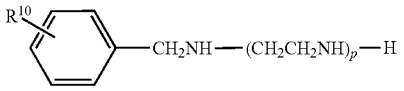

(10)

wherein $R^{10}$ represents an alkyl group or an alkenyl group with a number of carbons of 40 to 400, and preferably 60 to 350, and p represents an integer from 1 to 5, and preferably from 2 to 4.

There is no limitation whatsoever in the preparation method for the above-mentioned benzylamine, which can be obtained, for instance, by reacting a polyolefin such as propylene oligomer, polybutene, and ethylene-α-olefin copolymer with a phenol to obtain an alkyl phenol, and then, reacting thereto formaldehyde and a polyamine such as diethylene triamine, triethylene tetramine, tetraethylene pentamine, and pentaethylene hexamine by the Mannich reaction.

As the above-mentioned (III) polyamine, more concretely, the compounds represented by the following General Formula (11), and the like, can be given as examples.

$$R^{11}—NH—(CH_2CH_2NH)_q—H \quad (11)$$

[in Formula (11), $R^{11}$ represents an alkyl group or an alkenyl group with a number of carbons of 40 to 400, and preferably 60 to 350, and q represents an integer from 1 to 5, and preferably from 2 to 4.]

There is no limitation whatsoever in the preparation method for the above-mentioned polyamine, which can be obtained, for instance, by chlorinating a polyolefin such as propylene oligomer, polybutene, and ethylene-α-olefin copolymer, then reacting thereto ammoniac, or polyamine such as ethylene diamine, diethylene triamine, triethylene tetramine, tetraethylene pentamine, and pentaethylene hexamine.

In addition, as the nitrogen-containing compound derivatives given as one example of ashless dispersant, concretely, for instance, the so-called acid modification compounds obtained by action of a mono carboxylic acid having 1 to 30 carbons (fatty acid and the like) or a polycarboxylic acid having 2 to 30 carbons such as oxalic acid, phthalic acid, trimellitic acid or pyromellitic acid, onto the above nitrogen-containing compound, and neutralization or amidation of a portion or the entirety of the remaining amino groups and/or imino groups; the so-called boron modification compounds obtained by action of boric acid onto the above nitrogen-containing compound, and neutralization or amidation of a portion or the entirety of the remaining amino groups and/or imino groups; sulfur modification compounds obtained by action of a sulfur compound onto the above nitrogen-containing compound; and modification compounds obtained by combining two or more modifications selected from acid modification, boron modification and sulfur modification, onto the above nitrogen-containing compound, and the like, may be cited. Among these derivatives, boron modification compounds of alkenyl succinimide are effective, as they have excellent heat resistance and oxidation stability, and in the lubricating oil composition according to the first embodiment, further increase the ability to retain the base number and high temperature detergency.

When including an ashless dispersant in the above Embodiment (I) and the lubricating oil composition according to the first to the sixth embodiments of the present invention, the content thereof is, in general 0.01 to 20% by mass based on the total amount of lubricating oil composition as the reference, and preferably 0.1 to 10% by mass. If the content of ashless dispersant is less than 0.01% by mass, effects with regard to the ability to retain the base number at high temperature is low, on the other hand, if exceeding 20% by mass, the low temperature fluidity of the lubricating oil composition deteriorates widely, such that neither is desirable.

In addition, above Embodiment (I) and the lubricating oil composition according to the first to the sixth embodiments of the present invention preferably further contains a chain-terminating type antioxidant. This further increases the oxidation stability of the lubricating oil composition, allowing the ability to retain the base number and high temperature detergency in the lubricating oil composition to be further increased.

As chain-terminating type antioxidants, those [antioxidants] generally used in lubricating oils, such as, phenol type antioxidants and amine type antioxidants, and metal-containing antioxidants can be used.

As phenol type antioxidants, for instance, 4,4'-methylene bis(2,6-di-tert-butyl phenol), 4,4'-bis(2,6-di-tert-butyl phenol), 4,4'-bis(2-methyl-6-tert-butyl phenol), 2,2'-methylene bis(4-ethyl-6-tert-butyl phenol), 2,2'-methylene bis(4-methyl-6-tert-butyl phenol), 4,4'-butylidene bis(3-methyl-6-tert-butyl phenol), 4,4'-isopropylidene bis(2,6-di-tert-butyl phenol), 2,2'-methylene bis(4-methyl-6-nonyl phenol), 2,2'-isobutylidene bis(4,6-dimethyl phenol), 2,2'-methylene bis (4-methyl-6-cyclohexyl phenol), 2,6-di-tert-butyl-4-methyl phenol, 2,6-di-tert-butyl-4-ethyl phenol, 2,4-dimethyl-6-tert-butyl phenol, 2,6-di-tert-α-dimethylamino-p-cresol, 2,6-di-tert-butyl-4-(N,N'-dimethylamino methyl phenol), 4,4'-thio bis(2-methyl-6-tert-butyl phenol), 4,4'-thio bis(3-methyl-6-tert-butyl phenol), 2,2'-thio bis(4-methyl-6-tert-butyl phenol), bis(3-methyl-4-hydroxy-5-tert-butyl benzyl)sulfide, bis (3,5-di-tert-butyl-4-hydroxy benzyl)sulfide, 2,2'-thio-diethylene bis[3-(3,5-di-tert-butyl-4-hydroxyphenyl) propionate], tridecyl-3-(3,5-di-tert-butyl-4-hydroxyphenyl) propionate, pentaerythrityl-tetrakis[3-(3,5-di-tert-butyl-4-hydroxyphenyl)propionate], octyl-3-(3,5-di-tert-butyl-4-hydroxyphenyl)propionate, octadecyl-3-(3,5-di-tert-butyl-4-hydroxyphenyl)propionate, 3-methyl-5-tert-butyl-4-hydroxyphenyl substituted fatty acid esters, and the like, can be given as preferred examples. These may be used [as] one species alone, or may be used by mixing two or more species.

As amine type antioxidants, for instance, phenyl-α-naphthyl amine, alkyl phenyl-α-naphthyl amine, and dialkyl diphenyl amine can be cited. These may be used [as] one species alone, or may be used by mixing two or more species.

Furthermore, the above-mentioned phenol type antioxidants and amine type antioxidants may be used in combination.

When including a chain-terminating type antioxidant in the above Embodiment (I) and the lubricating oil composition according to the first to the sixth embodiments of the present invention, the content thereof, based on the total amount of lubricating oil composition as the reference, is in general 5.0% by mass or less, preferably 3.0% by mass or less, and more preferably 2.5% by mass or less. If the content thereof exceeds 5.0% by mass, sufficient oxidation stability commensurate with the content cannot be obtained, which is thus not desirable. On the other hand, in order to further increase the ability to retain the base number and high temperature detergency in the course of lubricating oil degradation, the content thereof, based on the total amount of lubricating oil composition as the reference, is preferably 0.1% by mass or greater, and preferably 1% by mass or greater.

Note that the above phosphorus-containing additives compounds that do not dissolve in lubricating base oil or compound that have low solubility (for instance, zinc dialkyl phosphate and the like, which exist in solid state at ordinary temperature), and when such compounds are used as phosphorus-containing additives, it is particularly desirable from the points of improving the solubility of the phosphorus-containing additive in the lubricating base oil and shortening the preparation time for the lubricating oil composition, to mix a nitrogen-containing compound (for instance, an amine compound as the ashless dispersant, an amine type antioxidant as the chain-terminating type antioxidant, or a mixture thereof) and the phosphorus-containing additive, carry out dissolution or reaction, and mixing the obtained solute or reaction product as an oil-soluble additive into the lubricating oil composition. As a preparation example of such oil-soluble additives, they are obtained, for instance, by mixing the phosphorus-containing additive and the above-mentioned nitrogen-containing compound, preferably in an organic solvent such as hexane, toluene or decalin, at 15 to 150° C., preferably at 30 to 120° C., and particularly preferably at 40 to 90° C., for 10 minutes to 5 hours, preferably 20 minutes to 3 hours, and particularly preferably 30 minutes to one hour, carry out the dissolution or the reaction, and evaporating the solvent by distillation at reduced pressure or the like.

In order to further increase the capabilities thereof, any additive generally used in lubricating oil can be added to the above Embodiment (I) and the lubricating oil composition according to the first to the sixth embodiments of the present invention, according to the purpose. As such additives, for instance, additives such as anti-wear agents, friction modifiers, viscosity index improvers, corrosion inhibitors, anti-rusts, anti-emulsifying agents, metal deactivators, anti-foaming agents, and pigments, or the like, can be cited.

As anti-wear agents, for instance, sulfur-containing compounds such as disulfide, sulfide olefin, sulfide oil fat, metal salts of dithiophosphoric acid (zinc salts, molybdenum salts and the like), metal salts of dithio carbamic acid (zinc salts, molybdenum salts and the like), dithiophosphoester and derivatives thereof reaction products with olefin cyclopentadiene, (methyl)methacrylic acid, propionic acid and the like; in the case of propionic acid, those with addition at the p position are preferred), trithio phosphoester, dithio carbamic acid ester, and the like, may be cited. These can be included in general, in a range of 0.005 to 5% by mass as long as the capabilities of the composition of the first embodiment are not compromised widely, and from the points of sulfur content reduction and long drain intervals, the content thereof in values in terms of sulfur is preferably 0.1% by mass or less, and more preferably 0.05% by mass or less.

As friction modifiers, any compound generally used as friction modifier for lubricating oil can be used, for instance, molybdenum-containing friction modifiers such as molybdenum disulfide, molybdenum dithio carbamate and molybdenum dithio phosphate, amine compounds having at least one linear chain alkyl group or linear chain alkenyl group having 6 to 30 carbons within the molecule, and in particular an alkyl group or alkenyl group having 6 to 30 carbons, ashless friction modifiers such as fatty acid esters, fatty acid amides, fatty acids, aliphatic alcohols, aliphatic ethers, hydrazides (oleyl hydrazide and the like), semicarbazide, urea, ureide, biuret, and the like, may be cited. The content of these friction modifiers is in general 0.1 to 5% by mass.

As viscosity index improvers, concretely, so-called non-dispersant viscosity index improvers, such as, polymers or copolymers of one species or two or more species of monomers selected from various methacrylic acid esters, or hydrogenates thereof, and the like, or so-called dispersive viscosity index improvers from the copolymerization of various methacrylic acid esters further containing a nitrogen compound, non-dispersant or dispersive ethylene-α-olefin copolymers (as α-olefins, propylene, 1-butene, 1-pentene, and the like, can be given as examples) or hydrogenated compounds thereof, poly isobutylene or hydrogenates thereof, hydrogenated compounds of styrene-diene copolymer, styrene-anhydrous maleate copolymer and polyalkyl styrene, and the like, may be cited.

The molecular weights of these viscosity index improvers need to be selected taking shear stability into account. Concretely, the number average molecular weight used for a viscosity index improver is, for instance, in general 5,000 to 1,000,000 and preferably 100,000 to 900,000 in the case of dispersive and non-dispersant polymethacrylates, in general 800 to 5,000 and preferably 1,000 to 4,000 in the case of poly isobutylene or hydrogenated compounds thereof, and in general 800 to 500,000 and preferably 3,000 to 200,000 in the case of ethylene-α-olefin copolymers or hydrogenated compounds thereof.

In addition, when ethylene-α-olefin copolymers or hydrogenated compounds thereof are used among these viscosity index improvers, a lubricating oil composition with particularly excellent shear stability can be obtained. One species or two or more species of compounds suitably selected from the above-mentioned viscosity index improvers can be included in adequate amounts. The content of viscosity index improver with the lubricating oil composition as the reference is in general 0.1 to 20% by mass.

As corrosion inhibitors, for instance, benzotriazole type, tolyl triazole type, thiadiazole type, and imidazole type compounds, and the like, may be cited.

As anti-rusts, for instance, petroleum sulfonate, alkyl benzene sulfonate, dinonyl naphthalene sulfonate, alkenyl succinic acid ester, and polyalcohol ester, and the like, may be cited.

As anti-emulsifying agents, for instance, polyalkylene glycol type nonionic surfactants, such as, polyoxyethylene alkyl ether, polyoxyethylene alkyl phenyl ether, and polyoxyethylene alkyl naphthyl ether, and the like, may be cited.

As metal deactivators, for instance, imidazoline, pyrimidine derivative, alkyl thiadiazole, mercapto benzothiazole, benzotriazole or derivatives thereof, 1,3,4-thiadiazole polysulfide, 1,3,4-thiaziazolyl-2,5-bis dialkyl dithio carbamate, 2-(alkyl dithio)benzoimidazole, and β-(o-carboxy benzyl thio)propione nitrile, and the like, may be cited. As antifoaming agents, for instance, silicone, fluorosilicone, and fluoro alkyl ether, and the like, may be cited.

When including these additives in the Embodiment (1) and the lubricating oil composition according to the first to the sixth embodiments of the present invention, the contents thereof based on the total amount of lubricating oil composition as the reference are selected in the ranges of 0.005 to 5% by mass for each of the corrosion inhibitors, anti-rusts and anti-emulsifying agents, 0.005 to 1% by mass for metal deactivators, and 0.0005 to 1% by mass for antifoaming agents.

In addition, the kinematic viscosity of the above Embodiment (I) and the lubricating oil composition according to the first to the sixth embodiments of the present invention has no particular limitations, and the kinematic viscosity thereof at 100° C. is preferably 25 $mm^2/s$ or less, and more preferably 15 $mm^2/s$ or less. Meanwhile, the kinematic viscosity thereof at 100° C. is preferably 4 $mm^2/s$ or greater, and more preferably 5 $mm^2/s$ or greater. If the kinematic viscosity at 100° C. of the lubricating oil composition exceeds the previous upper limit value, low temperature viscosity characteristic deteriorate, on the other hand, if this kinematic viscosity is less than the above lower limit value, as oil film formation is insufficient at the lubrication spot, lubricity becomes poor and loss of lubricating base oil by evaporation becomes important, both of which being undesirable.

In addition, the viscosity index of the lubricating oil composition according to the above Embodiment (I) and first to sixth embodiments of the present invention has no particular limitations however, in order to obtain excellent viscosity characteristics from a low temperature to a high temperature, the value thereof is preferably 80 or greater, more preferably 120 or greater, and even more preferably 150 or greater. If the viscosity index of the lubricating base oil is less than the previous lower limit value, the low temperature viscosity characteristic tends to deteriorate.

In addition, the amount of the above Embodiment (I) and the lubricating oil composition according to the first to the sixth embodiments of the present invention lost by evaporation, in terms of NOACK evaporation amount, is preferably 20% by mass or less, more preferably 16% by mass or less, and particularly preferably 10% by mass or less. A NOACK evaporation amount exceeding the previous upper limit value for the lubricating oil composition is not desirable, since not only the loss of lubricating oil by evaporation is important, there is the risk that sulfur compound and phosphorus compound, or the metal fraction within the composition, along with the lubricating base oil, deposit in the emission gas cleaning apparatus when used as a lubricating oil for internal combustion engine, and detrimental effects on emission gas cleaning ability are feared.

By selecting at least one species of aromatic constituent selected from the above (a1) to (a5), an organic molybdenum compound, and preferably an organic molybdenum compound not containing sulfur as a constitutive element, as well as various additive used as necessary, the above Embodiment (I) and the lubricating oil composition according to the first to the sixth embodiments of the present invention can also be made into a low sulfur lubricating oil composition having a sulfur content within the composition of 0.3% by mass or less, preferably 0.2% by mass or less, and more preferably 0.1% by mass or less, with excellent long drain intervals.

In addition, in order to increase the long drain intervals of the above Embodiment (I) and the lubricating oil composition according to the first to the sixth embodiments of the present invention, and alleviate the detrimental effects on the emission gas after-treatment device as much as possible, the sulfated ash of the composition is preferably brought to 1.0% by mass or less, more preferably brought to 0.8% by mass or less, more preferably brought to 0.6% by mass or less, and particularly preferably brought to 0.5% by mass or less by optimizing the organic molybdenum compound, preferably the organic molybdenum compound not containing sulfur as a constitutive element and other additives containing metal, and the contents thereof. Herein, sulfated ash indicates a value measured by the method defined in, JIS K 22721, 5. "Determination of Sulfated Ash", and mainly originating from the metal-containing additives.

According to the lubricating oil composition according to the above Embodiment (1) and first to sixth of the present invention, even if an ashless antioxidant is not used in combination, using in combination the above-mentioned specific aromatic constituent and organic molybdenum compound, in particular an organic molybdenum compound not containing sulfur as a constitutive element, allows oxidation stability, the ability to retain the base number, high temperature detergency and resistance against NOx to be achieved at a high level and in a balanced manner, and in particular, allows the resistance against NOx to be raised significantly. This effect is prominently demonstrated particularly when using a base oil having a total aromatic content of 10% by mass or less, for instance, highly refined mineral oil such as API Gr III base oil (saturation fraction: 90% by mass or greater, viscosity index: 120 or greater; sulfur content: 0.05% by mass or less) or a lubricating base oil having a low aromatic content, such as, poly α-olefin type base oil, or fundamentally not containing an aromatic content.

The lubricating oil composition of the present invention according to the above Embodiment (I) and the first to the sixth embodiments of the present invention, has excellent long drain intervals (oxidation stability, ability to retain the base number, high temperature detergency, and resistance against NOx). Therefore, it can be used preferably as lubricating oil for internal combustion engines, such as, gasoline engines, diesel engines and gas engines for two-wheeled vehicles, four-wheeled vehicles, power generation, marine use, and the like, and as it is low sulfur and low ash, it is in particularly suited for internal combustion engines fitted with an emission gas after-treatment device. In addition, it can be used particularly preferably as a lubricating oil for internal combustion engines using low sulfur fuels, for instance, gasoline, gas oil and kerosene having a sulfur content of 50 mass ppm or less, more preferably 30 mass ppm or less, and particularly preferably 10 mass ppm or less, or fuels having a sulfur content of 1 mass ppm or less (LPG, natural gas, hydrogen substantially not containing sulfur content, dimethyl ether, alcohol, GTL (gas-to-liquid) and the like).

In addition, the lubricant composition of the present invention can also be used suitably as lubricating oil requiring oxidation stability, for instance, lubricating oils such as lubricating oils for drive-train such as automatic or manual transmission, grease, wet type brake oil, hydraulic actuation oil, turbine oil, compressor oil, bearing oil and refrigerator oil.

EXAMPLES

Hereinafter, the present invention will be described more concretely based on examples and comparative examples; however, the present invention is not limited in any way to the following examples.

Examples 1-1 to 1-5, Comparative Examples 1-1 to 1-2

In Examples 1-1 to 1-5 and Comparative Examples 1-1 to 1-2, using the lubricating base oils and additives respectively shown below, lubricating oil compositions having the compositions shown in Tables 1 and 2 were prepared. In Tables 1 and 2 are shown together the sulfur contents, the phosphorus contents and the molybdenum contents (all values in terms of element) of the lubricating oil composition obtained in each example or comparative example.

(Base Oils)

Base Oil 1-1: hydrocracked mineral oil (kinematic viscosity at 100° C.: 5.3 $mm^2/s$; viscosity index: 120; polycyclic aromatic content: 0.04% by mass; total aromatic content: 5.0% by mass; sulfur content: less than 0.01% by mass)

Base Oil 1-2: hydrocracked mineral oil (kinematic viscosity at 100° C.: 4.3 $mm^2/s$; viscosity index: 123; polycyclic aromatic content: less than 0.001% by mass; total aromatic content: less than 0.1% by mass; sulfur content: less than 0.01% by mass)

Base Oil 1-3: poly α-olefin (kinematic viscosity at 100° C.: 6.0 $mm^2/s$; polycyclic aromatic content: less than 0.001% by mass; total aromatic content: less than 0.1% by mass; sulfur content: less than 0.01% by mass)

Base Oil 1-4: mixture of poly α-olefin and alkyl benzene (mixing ratio: 90/10 (mass ratio); kinematic viscosity at 100° C.: 5.5 $mm^2/s$; polycyclic aromatic content: less than 0.001% by mass; total aromatic content: 10% by mass; sulfur content: less than 0.01% by mass)

(Organic Molybdenum Compound)

A1-1: ditridecyl amine complex of molybdenum (molybdenum content: 9.7% by mass; sulfur content: 0% by mass)

A1-2: molybdenum salt of 2-ethyl hexanoic acid (molybdenum content: 15% by mass; sulfur content: 0% by mass)

A1-3: di(2-ethyl hexyl)molybdenum dithio carbamate (molybdenum content: 4.5% by mass; sulfur content: 5.0% by mass)

(Phosphorus-Containing Additive)

B1-1: zinc di-n-butyl phosphate (phosphorus content: 13.2% by mass; sulfur content: 0% by mass; zinc content: 13% by mass)

(Metallic Detergent)

C1-1: calcium sulfonate (base number: 300 mg KOH/g; calcium content: 11.9% by mass; sulfur content: 1.7% by mass; metal ratio: 10)

(Ashless Dispersant)

D1-1: mixture (mass ratio 1:4) of polybutenyl succinimide (number average molecular weight of poly butenyl group: 1300; nitrogen content: 1.8% by mass) and boronated product thereof (boron content: 0.77% by mass)

(Chain Terminator)

E1-1: mixture (mass ratio: 1:1) of octyl-3-(3,5-di-tert-butyl-4-hydroxyphenyl)propinate and dialkyl diphenyl amine (Viscosity Index Improver)

F1-1: ethylene-propylene copolymer type viscosity index improver (weight average molecular weight: 150,000).

Hereinafter, the following tests were carried out using each lubricating oil composition of Examples 1-1 to 1-5 and Comparative Examples 1-1 to 1-2.

[NOx absorption test] Changes over time of the base number (hydrochloric acid method) and acid number were measured when NOx-containing gas was blown into test oil methods according to Proceedings of JAST Tribology Conference 1992, 10, 465, for forced degradation. The test temperature in the present test was 140° C., and the NOx concentration in the NOx-containing gas was 1185 ppm. The base number residual ratio 16 hours after or 40 hours after and acid numbers 40 hours after starting blowing NOx gas are shown in Tables 1 and 2. In the tables, a smaller decrease in the base number, or a smaller increase in the acid number, indicates a long drain oil with a higher base number maintenance capability and a longer usable time, even in the presence of NOx, such as used in internal combustion engines.

TABLE 1

| | | | Example 1-1 | Example 1-2 | Example 1-3 |
|---|---|---|---|---|---|
| Base oil [% by mass] | | Base oil 1-1 | Residue | Residue | Residue |
| | | Base oil 1-2 | — | — | — |
| | | Base oil 1-3 | — | — | — |
| | | Base oil 1-4 | — | — | — |
| Organic molybdenum compound [% by mass] (molybdenum content [% by mass]) | | A1-1 | 0.2 (0.02) | — | 0.2 (0.02) |
| | | A1-2 | — | 0.2 (0.02) | — |
| | | A1-3 | — | — | — |
| Phosphorus compound [% by mass] (phosphorus content [% by mass]) | | B1-1 | 0.53 (0.07) | 0.53 (0.07) | 0.53 (0.07) |
| Metallic detergent [% by mass] (metal content [% by mass]) | | C1-1 | 1.5 (0.18) | 1.5 (0.18) | 1.5 (0.18) |
| Ashless dispersant [% by mass] | | D1-1 | 5.0 | 5.0 | 5.0 |
| Chain terminator [% by mass] | | E1-1 | — | — | 1.0 |
| Viscosity index improver [% by mass] | | F1-1 | 4.0 | 4.0 | — |
| Molybdenum content [% by mass] | | | 0.02 | 0.02 | 0.02 |
| Phosphorus content [% by mass] | | | 0.07 | 0.07 | 0.07 |
| Sulfur content [mass ppm] | | | 0.03 | 0.03 | 0.03 |
| Mass ratio (M/Mo) of metal (M) contained in the metallic detergent and molybdenum (Mo) contained in organic molybdenum compound | | | 9 | 9 | 9 |
| NOx absorption test | Base number residual ratio [%] | 16 hours later | 60 | 35 | 64 |
| | | 40 hours later | 14 | 10 | 18 |
| | Acid number [mg KOH/g] | 40 hours later | 6.8 | 7.2 | 0.71 |

TABLE 2

| | | | Example 1-4 | Comp. Ex. 1-1 | Comp. Ex. 1-2 | Example 1-5 |
|---|---|---|---|---|---|---|
| Base oil [% by mass] | | Base oil 1-1 | Residue | — | — | — |
| | | Base oil 1-2 | — | Residue | — | — |
| | | Base oil 1-3 | — | — | Residue | — |
| | | Base oil 1-4 | — | — | — | Residue |
| Organic molybdenum compound [% by mass] (molybdenum content [% by mass]) | | A1-1 | — | 0.2 (0.02) | 0.2 (0.02) | 0.2 (0.02) |
| | | A1-2 | — | — | — | — |
| | | A1-3 | 0.4 (0.02) | — | — | — |
| Phosphorus compound [% by mass] (phosphorus content [% by mass]) | | B1-1 | 0.53 (0.07) | 0.53 (0.07) | 0.53 (0.07) | 0.53 (0.07) |
| Metallic detergent [% by mass] (metal content [% by mass]) | | C1-1 | 1.5 (0.18) | 1.5 (0.18) | 1.5 (0.18) | 1.5 (0.18) |
| Ashless dispersant [% by mass] | | D1-1 | 5.0 | 5.0 | 5.0 | 5.0 |
| Chain terminator [% by mass] | | E1-1 | — | — | — | — |
| Viscosity index improver [% by mass] | | F1-1 | 4.0 | 4.0 | 4.0 | 4.0 |
| Molybdenum content [% by mass] | | | 0.02 | 0.02 | 0.02 | 0.02 |
| Phosphorus content [% by mass] | | | 0.07 | 0.07 | 0.07 | 0.07 |
| Sulfur content [mass ppm] | | | 0.05 | 0.03 | 0.03 | 0.03 |
| Mass ratio (M/Mo) of metal (M) contained in the metallic detergent and molybdenum (Mo) contained in organic molybdenum compound | | | 9 | 9 | 9 | 9 |
| NOx absorption test | Base number residual ratio [%] | 16 hours later | 20 | 22 | 27 | 26 |
| | | 40 hours later | 0 | 3 | 6 | 6 |
| | Acid number [mg KOH/g] | 40 hours later | 5.1 | 28 | 18 | 17 |

Examples 1-6 to 1-8, Comparative Example 1-5

In Examples 1-6 to 1-8, using respectively the Base Oil 1-5 shown below and the above additives, lubricating oil compositions having the compositions shown in Table 3 were prepared. In Table 3 are shown together the sulfur contents, the phosphorus contents and the molybdenum contents (all values in terms of element) of the lubricating oil composition obtained in each example or comparative example.

(Base Oil)

Base Oil 1-5: solvent-refined mineral oil (kinematic viscosity at 100° C., 5.2 $mm^2/s$; viscosity index: 100; polycyclic aromatic content: 3.5% by mass; total aromatic content: 26% by mass; sulfur content: 0.1% by mass).

Hereinafter, using each lubricating oil composition of Examples 1-6 to 1-8, the same NOx absorption test was carried out. The obtained results are shown in Table 3.

TABLE 3

| | | Example 1-6 | Example 1-7 | Example 1-8 |
|---|---|---|---|---|
| Base oil [% by mass] | Base oil 1-5 | Residue | Residue | Residue |
| Organic molybdenum compound [% by mass] (molybdenum content [% by mass]) | A1-1 | 0.2 (0.02) | — | — |
| | A1-2 | — | 0.2 (0.02) | — |
| | A1-3 | — | — | 0.4 (0.02) |
| Phosphorus compound [% by mass] (phosphorus content [% by mass]) | B1-1 | 0.53 (0.07) | 0.53 (0.07) | 0.53 (0.07) |
| Metallic detergent [% by mass] (metal content [% by mass]) | C1-1 | 1.5 (0.18) | 1.5 (0.18) | 1.5 (0.18) |
| Ashless dispersant [% by mass] | D1-1 | 5.0 | 5.0 | 5.0 |
| Antioxidant [% by mass] | E1-1 | — | — | — |
| Viscosity index improver [% by mass] | F1-1 | 4.0 | 4.0 | 4.0 |
| Molybdenum content [% by mass] | | 0.02 | 0.02 | 0.02 |
| Phosphorus content [% by mass] | | 0.07 | 0.07 | 0.07 |

TABLE 3-continued

| | | | Example 1-6 | Example 1-7 | Example 1-8 |
|---|---|---|---|---|---|
| Sulfur content [mass ppm] | | | 0.13 | 0.13 | 0.15 |
| Mass ratio (M/Mo) of metal (M) contained in the metallic detergent and molybdenum (Mo) contained in organic molybdenum compound | | | 9 | 9 | 9 |
| NOx absorption test | Base number residual ratio [%] | 16 hours later | 55 | 35 | 17 |
| | | 40 hours later | 15 | 10 | 0 |
| | Acid number [mg KOH/g] | 40 hours later | 1.9 | 2.4 | 3.0 |

Examples 1-9, 1-10

In Examples 1-9, 1-10, using respectively the Base Oils 1-6 and 1-7 shown below and the above additives, lubricating oil compositions having the compositions shown in Table 4 were prepared. In Table 4 are shown together the sulfur contents, the phosphorus contents and the molybdenum contents (all values in terms of element) of the lubricating oil composition obtained in each example.

(Base Oils)

Base Oil 1-6: mixture of Base Oil 3 (poly α-olefin) and benzophenanthrene (mixing ratio: 99.89/0.11 (mass ratio); total aromatic content: 0.1% by mass; polycyclic aromatic content: 0.1% by mass; sulfur content: less than 0.01% by mass)

Base Oil 1-7: mixture of Base Oil 3 (poly α-olefin) and benzophenanthrene (mixing ratio: 99.44/0.56 (mass ratio); total aromatic content: 0.5% by mass; polycyclic aromatic content: 0.5% by mass; sulfur content: less than 0.01% by mass).

Hereinafter, using each lubricating oil composition of Examples 1-9 and 1-10, the same NOx absorption test was carried out. The base number remaining ratio 64 hours after starting blowing NOx gas and the acid number 40 hours after or 64 hours after are shown in Table 4.

[Test for evaluating compatibility with respect to emission gas after-treatment device] With respect to a diesel fuel having a sulfur content of 1 mass ppm or less, 0.1% by mass of the lubricating oil composition of Example 1-1 was added to prepare a test fuel. Using this test fuel and the lubricating oil composition of Example 1-1 as engine oil, under the conditions of 2400 rpm rotation speed, ½ charge and 100 hours driving time, a single cylinder general purpose diesel engine fitted with an external regeneration type DPF was driven, and compatibility of the lubricating oil composition with respect to DPF was evaluated.

In addition, as a comparative test, a similar test to above was carried out, using a test fuel [resulting] from the addition of 0.1% by mass of a lubricating oil composition (Example 1-11; sulfur content of the composition: 0.3% by mass; phosphorus content: 0.07% by mass), in which the B1-1 constituent (zinc di-n-butyl phosphate) of the lubricating oil composition of Comparative Example 1-5 has been replaced with ZDTP, with respect to a diesel fuel having a sulfur content of 1 mass ppm or less, and the lubricating oil composition of Example 1-11 as engine oil.

In the above test, when the lubricating oil composition of Example 1-11 was used, a tendency of the DPF to clog was observed. This tendency of the DPF to clog is thought to originate from the generation of $CaSO_4$. On the other hand, when the lubricating oil composition of Example 1-1 was used, the obstruction of DPF was improved compared to

TABLE 4

| | | | Example 1-9 | Example 1-10 |
|---|---|---|---|---|
| Base oil [% by mass] | | Base oil 1-6 | Residue | — |
| | | Base oil 1-7 | — | Residue |
| Organic molybdenum compound [% by mass] (molybdenum content [% by mass]) | | A1-1 | 0.2 (0.02) | 0.2 (0.02) |
| | | A1-2 | — | — |
| | | A1-3 | — | — |
| Phosphorus compound [% by mass] (phosphorus content [% by mass]) | | B1-1 | 0.53 (0.07) | 0.53 (0.07) |
| Metallic detergent [% by mass] (metal content [% by mass]) | | C1-1 | 1.5 (0.18) | 1.5 (0.18) |
| Ashless dispersant [% by mass] | | D1-1 | 5.0 | 5.0 |
| Antioxidant [% by mass] | | E1-1 | — | — |
| Viscosity index improver [% by mass] | | F1-1 | 4.0 | 4.0 |
| Molybdenum content [% by mass] | | | 0.02 | 0.02 |
| Phosphorus content [% by mass] | | | 0.07 | 0.07 |
| Sulfur content [mass ppm] | | | 0.03 | 0.03 |
| Mass ratio (M/Mo) of metal (M) contained in the metallic detergent and molybdenum (Mo) contained in organic molybdenum compound | | | 9 | 9 |
| NOx absorption test | Base number residual ratio [%] | 64 hours later | — | 29 |
| | Acid number [mg KOH/g] | 40 hours later | 5.3 | 1.6 |
| | | 64 hours later | — | 2.1 |

when the lubricating oil composition of Example 1-11 was used, and at the same time, regeneration of DPF after the drive was found to be easy.

Examples 2-1 to 2-3

Preparation of Antioxidant Compositions

In Examples 2-1 to 2-3, antioxidant compositions were prepared by mixing the organic molybdenum compound and the lubricating base oils respectively shown below. The types of organic molybdenum compound and lubricating base oil in each example, as well as the molybdenum content (value in terms of element) of the obtained lubricating oil composition, are shown in Table 5.

(Organic Molybdenum Compound)

A2-1: ditridecyl amine complex of molybdenum (molybdenum content: 9.7% by mass; sulfur content: 0% by mass)

(Lubricating Base Oil)

Base Oil 2-1: solvent-refined mineral oil (kinematic viscosity at 100° C., 7.4 $mm^2/s$; viscosity index: 95; total aromatic content: 31.4% by mass; polycyclic aromatic content: 5% by mass; sulfur content: 0.54% by mass)

Base Oil 2-2: solvent-refined mineral oil (kinematic viscosity at 100° C.: 10.5 $mm^2/s$; viscosity index: 95; total aromatic content: 37.3% by mass; polycyclic aromatic content: 7% by mass; sulfur content: 0.61% by mass)

Base Oil 2-3: solvent-refined mineral oil (kinematic viscosity at 100° C.: 22.0 $mm^2/s$; viscosity index: 95; total aromatic content: 42.1% by mass; polycyclic aromatic content: 10% by mass; sulfur content: 0.58% by mass).

TABLE 5

| | Example 2-1 | Example 2-2 | Example 2-3 |
|---|---|---|---|
| Organic molybdenum compound | A2-1 | A2-2 | A2-3 |
| Lubricating base oil | Base oil 2-1 | Base oil 2-2 | Base oil 2-3 |
| Content of organic molybdenum compound (value in terms of element) [% by mass] | 1.0 | 2.0 | 2.0 |

Examples 2-4 to 2-9, Examples 1-12 to 1-13 and Comparative Examples 2-1 to 2-2

Preparation of Lubricating Oil Compositions

In Examples 2-4 to 2-9, using the antioxidant compositions of Examples 2-1 to 2-3 as well as the lubricating base oils and additives shown below, lubricating oil compositions having the compositions shown in Table 6 were prepared. In addition, in Examples 1-12 to 1-13 and Comparative Examples 2-1 to 2-2, using the bases oil for lubricating oil and additives shown below and without using the antioxidant compositions of Examples 2-1 to 2-3, lubricating oil compositions having the compositions shown in Table 7 were prepared. The molybdenum contents (values in terms of element) of the obtained lubricating oil compositions are shown together in Table 6 and 7.

(Lubricating Base Oils)

Base Oil 2-4: hydrocracked mineral oil (kinematic viscosity at 100° C.: 5.3 $mm^2/s$; viscosity index: 120; polycyclic aromatic content: 0.04% by mass; total aromatic content: 5.0% by mass; sulfur content: less than 0.01% by mass)

Base Oil 2-5: poly α-olefin (kinematic viscosity at 100° C.: 6.0 $mm^2/s$; polycyclic aromatic content: less than 0.001% by mass; total aromatic content: less than 0.1% by mass; sulfur content: less than 0.01% by mass)

(Organic Molybdenum Compound)

B2-1: di(2-ethyl hexyl)molybdenum dithio carbamate (molybdenum content: 10% by mass; sulfur content: 10% by mass)

B2-2: ditridecyl amine complex of molybdenum (molybdenum content: 9.7% by mass; sulfur content: 0% by mass, nitrogen content: 1.1% by mass)

(Metallic Detergent)

C2-1: calcium sulfonate (base number: 300 mg KOH/g; calcium content: 11.9% by mass; sulfur content: 1.7% by mass; metal ratio: 10)

(Ashless Dispersant)

D2-1: mixture (mass ratio: 1:4) of polybutenyl succinimide (number average molecular weight of poly butenyl group: 1300; nitrogen content: 1.8% by mass) and boronated product thereof (boron content: 0.77% by mass).

[NOx absorption test] For each lubricating oil composition of Examples 24 to 2-9, Examples 1-12 to 1-13 and Comparative Example 2-1 to 2-2, NOx absorption test was carried out as described below.

Changes over time of the base number (hydrochloric acid method) and acid number were measured when NOx-containing gas was blown into test oil methods according to Proceedings of JAST Tribology Conference 1992, 10, 465, for forced degradation. The test temperature in the present test was 140° C., and the NOx concentration in the NOx-containing gas was 1185 ppm. The base numbers and acid numbers 40 hours after starting blowing NOx gas are shown in Tables 6 and 7. In the tables, a smaller decrease in the base number, or a smaller increase in the acid number, indicates a long drain oil with a higher base number maintenance capability and a longer usable time, even in the presence of NOx, such as used in internal combustion engines.

TABLE 6

| | | Ex. 2-4 | Ex. 2-5 | Ex. 2-6 | Ex. 2-7 | Ex. 2-8 | Ex. 2-9 |
|---|---|---|---|---|---|---|---|
| Composition [% by mass] | Base oil 2-4 | Residue | Residue | Residue | | | |
| | Base oil 2-5 | — | | | Residue | Residue | Residue |
| | Antioxidant composition of Example 2-1 | 2.0 | | | 0 | | |
| | Antioxidant composition of Example 2-2 | — | 1.0 | — | — | 1.0 | — |
| | Antioxidant composition of | — | — | 1.0 | — | — | 1.0 |

TABLE 6-continued

| | | | Ex. 2-4 | Ex. 2-5 | Ex. 2-6 | Ex. 2-7 | Ex. 2-8 | Ex. 2-9 |
|---|---|---|---|---|---|---|---|---|
| | Example 2-3 | | | | | | | |
| | B2-1 | | — | — | — | — | — | — |
| | B2-2 | | — | — | — | — | — | — |
| | C2-1 (metal content [% by mass]) | | 1.5 (0.18) | 1.5 (0.18) | 1.5 (0.18) | 1.5 (0.18) | 1.5 (0.18) | 1.5 (0.18) |
| | D2-1 | | 5.0 | 5.0 | 5.0 | 5.0 | 5.0 | 5.0 |
| Molybdenum content [% by mass] | | | 0.02 | 0.02 | 0.02 | 0.02 | 0.02 | 0.02 |
| NOx absorption test | Base number residual ratio [%] | 40 hours later | 16 | 14 | 18 | 19 | 20 | 18 |
| | Acid number [mgKOH/g] | 40 hours later | 3.2 | 3.1 | 2.5 | 5.1 | 5.4 | 4.8 |

TABLE 7

| | | | Ex. 1-12 | Ex. 1-13 | Comp. Ex. 2-1 | Comp. Ex. 2-2 |
|---|---|---|---|---|---|---|
| Composition [% by mass] | Base oil 2-4 | | Residue | Residue | — | — |
| | Base oil 2-5 | | — | — | Residue | Residue |
| | Antioxidant composition of Example 2-1 | | — | — | — | — |
| | Antioxidant composition of Example 2-2 | | — | — | — | — |
| | Antioxidant composition of Example 2-3 | | — | — | — | — |
| | B2-1 | | 0.2 | — | 0.2 | — |
| | B2-2 | | — | 0.2 | — | 0.2 |
| | C2-1 (metal content [% by mass]) | | 1.5 (0.18) | 1.5 (0.18) | 1.5 (0.18) | 1.5 (0.18) |
| | D2-1 | | 5.0 | 5.0 | 5.0 | 5.0 |
| Molybdenum content [% by mass] | | | 0.02 | 0.02 | 0.02 | 0.02 |
| NOx absorption test | Base number residual ratio [%] | 40 hours later | 10 | 14 | 0 | 6 |
| | Acid number [mgKOH/g] | 40 hours later | 6 | 8 | 15 | 18 |

Examples 3-1 to 3-7, Examples 1-14 and Comparative Example 3-1

In Examples 3-1 to 3-7, Examples 1-14 and Comparative Example 3-1, using the lubricating base oils and additives respectively shown below, lubricating oil compositions having the compositions shown in Tables 8 and 9 were prepared. Herein, in Examples 3-1 to 3-7, Base Oil 3-1 and organic molybdenum compound A3-2 were mixed, and then, this mixture and Base Oil 3-3 and other additives were mixed. The sulfur content in the mixed base oil of each example or comparative example, as well as the sulfur content, the phosphorus content and the molybdenum content (all values in terms of element) of the lubricating oil compositions are shown together in Tables 8 and 9.

(Lubricating Base Oils)

Base Oil 3-1: solvent-refined mineral oil (kinematic viscosity at 100° C.: 5.2 $mm^2/s$; viscosity index: 95; polycyclic aromatic content: 5% by mass; total aromatic content: 30% by mass; sulfur content: 0.6% by mass)

Base Oil 3-2: hydrocracked mineral oil (kinematic viscosity at 100° C.: 5.3 $mm^2/s$; viscosity index: 120; polycyclic aromatic content: 0.04% by mass; total aromatic content: 5.0% by mass; sulfur content: less than 0.01% by mass)

(Organic Molybdenum Compounds)

A3-1: ditridecyl amine complex of molybdenum (molybdenum content: 9.7% by mass; sulfur content: 0% by mass, nitrogen content: 1.1% by mass)

A3-2: di(2-ethyl hexyl)molybdenum dithio carbamate (molybdenum content: 4.5% by mass; sulfur content: 5.0% by mass)

(Phosphorus-Containing Additive)

B3-1: zinc di-n-butyl phosphate (phosphorus content: 13.2% by mass; sulfur content: 0% by mass; zinc content: 13% by mass)

(Metallic Detergent)

C3-1: calcium sulfonate (base number: 300 mg KOH/g; calcium content: 11.9% by mass; sulfur content: 1.7% by mass; metal ratio: 10)

(Ashless Dispersant)

D3-1: mixture (mass ratio: 1:4) of polybutenyl succinimide (number average molecular weight of poly butenyl group: 1300; nitrogen content: 1.8% by mass) and boronated product thereof (boron content: 0.77% by mass)

(Viscosity Index Improver)

E3-1: ethylene-propylene copolymer type viscosity index improver (weight average molecular weight: 150,000).

[NOx absorption test] For each lubricating oil composition of Examples 3-1 to 3-7, Example 1-14 and Comparative Example 3-1, NOx absorption test was carried out as described below.

Changes over time of the base number (hydrochloric acid method) and acid number were measured when NOx-containing gas was blown into test oil methods according to Proceedings of JAST Tribology Conference 1992, 10, 465, for forced degradation. The test temperature in the present test was 140° C., and the NOx concentration in the NOx-containing gas was 1185 ppm. Base numbers 16 hours after or 40 hours after starting blowing NOx gas and acid number 40 hours after are shown in Tables 8 and 9. In the tables, a smaller decrease in the base number, or a smaller increase in the acid number, indicates a long drain oil with a higher base number maintenance capability and a longer usable time, even in the presence of NOx, such as used in internal combustion engines.

[Hot tube test] For each lubricating oil composition of Examples 3-3 to 3-5, a hot tube test was carried out as follows.

Hot tube tests were performed according to JPI-5S-5599, at the two conditions of 290° C. or 300° C. Rating was 10 points for colorless transparency (no dirt), and 0 points for black opacity, and standard tubes created beforehand grading therebetween by one were referred to for the evaluation. The obtained results are shown in Tables 8 and 9. If the rating is 6 or greater at 290° C., this has excellent detergency as lubricating oil for conventional gasoline engine and for diesel engine; however, as lubricating oil for gas engine, demonstration of excellent detergency at 300° C. or higher in the present test is desirable.

TABLE 8

| | | | Ex. 3-1 | Ex. 3-2 | Ex. 3-3 | Ex. 3-4 | Ex. 3-5 |
|---|---|---|---|---|---|---|---|
| Proportion of each base oil in the total amount of base oil [% by mass] | | Base oil 3-1 | 5 | 10 | 20 | 50 | 80 |
| | | Base oil 3-2 | 95 | 90 | 80 | 50 | 20 |
| Sulfur content of base oil [% by mass] | | | 0.03 | 0.06 | 0.12 | 0.30 | 0.48 |
| Composition of lubricant oil composition | Base oil [% by mass] | | Residue | Residue | Residue | Residue | Residue |
| | Organic molybdenum compound [% by mass] (molybdenum content [% by mass]) | A3-1 | 0.2 (0.02) | 0.2 (0.02) | 0.2 (0.02) | 0.2 (0.02) | 0.2 (0.02) |
| | | A3-2 | — | — | — | — | — |
| | Phosphorus compound [% by mass] (phosphorus content [% by mass]) | B3-1 | 0.6 (0.07) | 0.6 (0.07) | 0.6 (0.07) | 0.6 (0.07) | 0.6 (0.07) |
| | Metallic detergent [% by mass] (metal content [% by mass]) | C3-1 | 1.5 (0.18) | 1.5 (0.18) | 1.5 (0.18) | 1.5 (0.18) | 1.5 (0.18) |
| | Ashless dispersant [% by mass] | D3-1 | 5.0 | 5.0 | 5.0 | 5.0 | 5.0 |
| | Viscosity index improver [% by mass] | E3-1 | 4.0 | 4.0 | 4.0 | 4.0 | 4.0 |
| Molybdenum content [% by mass] | | | 0.02 | 0.02 | 0.02 | 0.02 | 0.02 |
| Phosphorus content [% by mass] | | | 0.07 | 0.07 | 0.07 | 0.07 | 0.07 |
| Sulfur content [mass ppm] | | | 0.06 | 0.09 | 0.15 | 0.33 | 0.51 |
| Mass ratio (M/Mo) of metal (M) contained in the metallic detergent and molybdenum (Mo) contained in organic molybdenum compound | | | 9 | 9 | 9 | 9 | 9 |
| NOx absorption test | Base number residual ratio [%] | 16 hours later | 58 | 59 | 62 | 60 | 61 |
| | | 40 hours later | 22 | 22 | 39 | 21 | 22 |
| | Acid number [mg KOH/g] | 40 hours later | 2.0 | 1.7 | 1.4 | 1.8 | 2.0 |
| Hot tube test (score) | | 290° C. | — | — | 10 | 10 | 10 |
| | | 300° C. | — | — | 5 | 7 | 5 |

TABLE 9

| | | | Ex. 1-14 | Ex. 3-6 | Comp. Ex. 3-1 | Ex. 3-7 |
|---|---|---|---|---|---|---|
| Proportion of each base oil in the total amount of base oil [% by mass] | | Base oil 3-1 | — | 100 | 10 | 10 |
| | | Base oil 3-2 | 100 | — | 90 | 90 |
| Sulfur content of base oil [% by mass] | | | <0.01 | 0.60 | 0.06 | 0.06 |
| Composition of lubricant oil composition | Base oil [% by mass] | | Residue | Residue | Residue | Residue |
| | Organic molybdenum compound [% by mass] (molybdenum content [% by mass]) | A3-1 | 0.2 (0.02) | 0.2 (0.02) | — | — |
| | | A3-2 | — | — | — | 0.4 (0.02) |
| | Phosphorus compound [% by mass] | B3-1 | 0.6 (0.07) | 0.6 (0.07) | 0.6 (0.07) | 0.6 (0.07) |

TABLE 9-continued

| | | | Ex. 1-14 | Ex. 3-6 | Comp. Ex. 3-1 | Ex. 3-7 |
|---|---|---|---|---|---|---|
| | (phosphorus content [% by mass]) | | | | | |
| | Metallic detergent [% by mass] (metal content [% by mass]) | C3-1 | 1.5 (0.18) | 1.5 (0.18) | 1.5 (0.18) | 1.5 (0.18) |
| | Ashless dispersant [% by mass] | D3-1 | 5.0 | 5.0 | 5.0 | 5.0 |
| | Viscosity index improver [% by mass] | E3-1 | 4.0 | 4.0 | 4.0 | 4.0 |
| Molybdenum content [% by mass] | | | 0.02 | 0.02 | 0.00 | 0.02 |
| Phosphorus content [% by mass] | | | 0.07 | 0.07 | 0.07 | 0.07 |
| Sulfur content [mass ppm] | | | 0.03 | 0.63 | 0.09 | 0.11 |
| Mass ratio (M/Mo) of metal (M) contained in the metallic detergent and molybdenum (Mo) contained in organic molybdenum compound | | | 9 | 9 | 9 | 9 |
| NO*x* absorption test | Base number residual ratio [%] | 16 hours later | 54 | 59 | 30 | 20 |
| | | 40 hours later | 14 | 22 | 10 | 8 |
| | Acid number [mgKOH/g] | 40 hours later | 7.0 | 2.6 | 30 | 3.5 |

[Test for evaluating compatibility with respect to emission gas after-treatment device] With respect to a diesel fuel having a sulfur content of 1 mass ppm or less, 0.1% by mass of the lubricating oil composition of Example 3-1 was added to prepare a test fuel. Using this test fuel and the lubricating oil composition of Example 3-1 as engine oil, under the conditions of 2400 rpm rotation speed, ½ charge and 100 hours driving time, a single cylinder general purpose diesel engine fitted with an external regeneration type DPF was driven, and compatibility of the lubricating oil composition with respect to DPF was evaluated. In addition, as a comparative test, a similar test to above was carried out, using a test fuel [resulting] from the addition of 0.1% by mass of a lubricating oil composition (Example 3-8; sulfur content: 0.25% by mass; phosphorus content: 0.07% by mass), in which the B3-1 constituent in the lubricating oil composition of Example 3-7 has been replaced with ZDTP, with respect to a diesel fuel having a sulfur content of 1 mass ppm or less, and the lubricating oil composition of Examples 3-8 as engine oil.

In the above test, when the lubricating oil composition of Example 3-8 was used, a tendency of the DPF to clog was observed. This tendency of the DPF to clog is thought to originate from the generation of $CaSO_4$. On the other hand, when the lubricating oil composition of Example 3-1 was used, the obstruction of DPF was improved compared to when the lubricating oil composition of Example 3-8 was used, and at the same time, regeneration of DPF after the drive was found to be easy.

Examples 4-1 and 4-2

Preparation of Antioxidant Compositions

In Examples 4-1 and 4-2, antioxidant compositions were prepared by mixing the organic molybdenum compound and the aromatic solvents respectively shown below. The types of organic molybdenum compound and aromatic solvent in each example, as well as the content of organic molybdenum compound (value in terms of molybdenum element) in the obtained lubricating oil composition are shown in Table 10.

(Organic Molybdenum Compound)

A4-1: ditridecyl amine complex of molybdenum (molybdenum content: 9.7% by mass; sulfur content: 0% by mass)

(Aromatic Solvent)

Solvent 4-1: alkyl naphthalene having one to two tetradecyl groups (kinematic viscosity at 100° C., 5.0 $mm^2/s$)

Solvent 4-2: alkyl naphthalene having one to two hexadecyl groups (kinematic viscosity at 100° C.: 12 $mm^2/s$).

TABLE 10

| | Example 4-1 | Example 4-2 |
|---|---|---|
| Organic molybdenum compound | A4-1 | A4-2 |
| Aromatic solvent | Solvent 1 | Solvent 2 |
| Content of organic molybdenum compound (value in terms of element) [% by mass] | 2.0 | 2.0 |

Examples 4-3 to 47, Examples 1-15 to 1-17 and Comparative Examples 4-1 to 4-2

Preparation of Lubricating Oil Composition

In Examples 4-3 to 4-7, using antioxidant composition of Examples 4-1 or 4-2, as well as lubricating base oils and additives shown below, lubricating oil compositions having the compositions shown in Table 11 were prepared. In addition, in Examples 1-15 to 1-17 and Comparative Examples 4-1 to 4-2, using the lubricating base oils and additives shown below, and without using the antioxidant composition of Examples 4-1 or 4-2, lubricating oil compositions having the compositions shown in Table 12 were prepared. The molybdenum contents (value in terms of element) of the obtained lubricating oil compositions are shown in Tables 11 and 12.

(Lubricating Base Oils)

Base Oil 4-1: hydrocracked mineral oil (kinematic viscosity at 100° C.: 5.3 $mm^2/s$; viscosity index: 120; polycyclic aromatic content: 0.04% by mass; total aromatic content: 5.0% by mass; sulfur content: less than 0.01% by mass)

Base Oil 4-2: poly α-olefin (kinematic viscosity at 100° C.: 6.0 $mm^2/s$; polycyclic aromatic content: less than 0.001% by mass; total aromatic content: less than 0.1% by mass; sulfur content: less than 0.01% by mass)

(Organic Molybdenum Compound)

B4-1: di(2-ethyl hexyl)molybdenum dithio carbamate (molybdenum content: 10% by mass; sulfur content: 10% by mass)

B4-2: ditridecyl amine complex of molybdenum (molybdenum content: 9.7% by mass; sulfur content: 0% by mass, nitrogen content: 1.1% by mass)

(Metallic Detergent)

C4-1: calcium sulfonate (base number: 300 mg KOH/g; calcium content: 11.9% by mass; sulfur content: 1.7% by mass; metal ratio: 10)

(Ashless Dispersant)

D4-1: mixture (mass ratio: 1:4) of polybutenyl succinimide (number average molecular weight of poly butenyl group: 1300; nitrogen content: 1.8% by mass) and boronated product thereof (boron content 0.77% by mass)

(Chain-Terminating Type Antioxidant)

E4-1: octyl-3-(3,5-di-t-butyl-4-hydroxyphenyl)propionate (sulfur content: 0.0% by mass)

E4-2: alkyl diphenyl amine (alkyl group: mixture of butyl group and octyl group).

[NOx absorption test] For each lubricating oil composition of Examples 4-3 to 47, Examples 1-15 to 1-17 and Comparative Examples 4-1 to 4-2, NOx absorption test was carried out as described below.

Changes over time of the base number (hydrochloric acid method) and acid number were measured when NOx-containing gas was blown into test oil methods according to Proceedings of JAST Tribology Conference 1992, 10, 465, for forced degradation. The test temperature in the present test was 140° C., and the NOx concentration in the NOx-containing gas was 1185 ppm. The base numbers 40 hours after or 82 hours after starting blowing NOx gas and acid numbers 40 hours after, 70 hours after or 82 hours after are shown in Table 11 and 12. In the tables, a smaller decrease in the base number, or a smaller increase in the acid number, indicates a long drain oil with a higher base number maintenance capability and a longer usable time, even in the presence of NOx, such as used in internal combustion engines.

TABLE 11

| | | | Example 4-3 | Example 4-4 | Example 4-5 | Example 4-6 | Example 4-7 |
|---|---|---|---|---|---|---|---|
| Composition [% by mass] | Base oil 4-1 | | Residue | Residue | — | — | Residue |
| | Base oil 4-2 | | — | — | Residue | Residue | — |
| | Antioxidant composition of Example 4-1 | | 1.0 | — | 1.0 | — | 1.0 |
| | Antioxidant composition of Example 4-2 | | — | 1.0 | — | 1.0 | — |
| | B4-1 | | — | — | — | — | — |
| | B4-2 | | — | — | — | — | — |
| | C4-1 (metal content [% by mass]) | | 1.5 (0.18) | 1.5 (0.18) | 1.5 (0.18) | 1.5 (0.18) | 1.5 (0.18) |
| | D4-1 | | 5.0 | 5.0 | 5.0 | 5.0 | 5.0 |
| | E4-1 | | — | — | — | — | 0.5 |
| | E4-2 | | — | — | — | — | 0.5 |
| Molybdenum content [% by mass] | | | 0.02 | 0.02 | 0.02 | 0.02 | 0.02 |
| NOx absorption test | Base number residual ratio [%] | 40 hours later | 16 | 14 | 20 | 21 | — |
| | | 82 hours later | — | — | — | — | 16 |
| | Acid number [mg KOH/g] | 40 hours later | 2.2 | 2.4 | 5.5 | 6.0 | — |
| | | 70 hours later | — | — | — | — | 1.2 |
| | | 82 hours later | — | — | — | — | 2.2 |

TABLE 12

| | | | Ex. 1-15 | Ex. 1-16 | Comp. Ex. 4-1 | Comp. Ex. 4-2 | Ex. 1-17 |
|---|---|---|---|---|---|---|---|
| Composition [% by mass] | Base oil 4-1 | | Residue | Residue | — | — | Residue |
| | Base oil 4-2 | | — | — | Residue | Residue | — |
| | Antioxidant composition of Example 4-1 | | — | — | — | — | — |
| | Antioxidant composition of Example 4-2 | | — | — | — | — | — |
| | B4-1 | | 0.2 | — | 0.2 | — | — |
| | B4-2 | | — | 0.2 | — | 0.2 | 0.2 |
| | C4-1 (metal content [% by mass]) | | 1.5 (0.8) | 1.5 (0.8) | 1.5 (0.8) | 1.5 (0.8) | 1.5 (0.8) |
| | D4-1 | | 5.0 | 5.0 | 5.0 | 5.0 | 5.0 |
| | E4-1 | | — | — | — | — | 0.5 |
| | E4-2 | | — | — | — | — | 0.5 |
| Molybdenum content [% by mass] | | | 0.02 | 0.02 | 0.02 | 0.02 | 0.02 |
| NOx absorption test | Base number residual ratio [%] | 40 hours later | 10 | 14 | 0 | 6 | — |
| | | 82 hours later | — | — | — | — | 0 |
| | Acid number [mgKOH/g] | 40 hours later | 6.0 | 8.0 | 15 | 18 | — |
| | | 70 hours later | — | — | — | — | 6.6 |
| | | 82 hours later | — | — | — | — | 13.2 |

Examples 5-1 to 5-13, Examples 1-18 to 1-21, Comparative Examples 5-1 to 5-4

In Examples 5-1 to 5-13, Examples 1-18 to 1-21 and Comparative Examples 5-1 to 5-4, using the lubricating base oils and additives respectively shown below, lubricating oil compositions having the compositions shown in Table 13 to 17 were prepared. The sulfur content, the phosphorus content and the molybdenum content (all values in terms of element) in the lubricating oil composition of each example or comparative example are shown together in Tables 13 to 17.

(Lubricating Base Oil)

Base Oil 5-1: poly α-olefin (kinematic viscosity at 100° C.: 6.0 $mm^2/s$; polycyclic aromatic content: less than 0.001% by mass; total aromatic content: less than 0.1% by mass; sulfur content: less than 0.01% by mass)

Base Oil 5-2: hydrocracked mineral oil (kinematic viscosity at 100° C.: 5.3 $mm^2/s$; viscosity index: 120; polycyclic aromatic content: 0.04% by mass; total aromatic content: 5.0% by mass; sulfur content: less than 0.01% by mass)

(Organic Molybdenum Compound)

A5-1: di(2-ethyl hexyl)molybdenum dithio carbamate (molybdenum content: 4.5% by mass; sulfur content: 5.0% by mass)

A5-2: ditridecyl amine complex of molybdenum (molybdenum content: 9.7% by mass; sulfur content: 0% by mass, nitrogen content: 1.1% by mass)

A5-3: molybdenum salt of 2-ethyl hexanoic acid (molybdenum content: 15% by mass; sulfur content: 0% by mass)

(Polycyclic Aromatic Compound)

B5-1: alkyl naphthalene having one to two hexadecyl groups

B5-2: benzophenanthrene (Phosphorus-Containing Additive)

C5-1: zinc di-n-butyl phosphate (phosphorus content: 13.2% by mass; sulfur content: 0% by mass; zinc content: 13% by mass)

(Metallic Detergent)

D5-1: calcium sulfonate (base number: 300 mg KOH/g; calcium content: 11.9% by mass; sulfur content: 1.7% by mass; metal ratio: 10)

(Ashless Dispersant)

E5-1: mixture (mass ratio: 1:4) of polybutenyl succinimide (number average molecular weight of poly butenyl group: 1300; nitrogen content: 1.8% by mass) and boronated product thereof (boron content 0.77% by mass)

(Viscosity Index Improver)

F5-1: ethylene-propylene copolymer type viscosity index improver (weight average molecular weight: 150,000)

(Chain-Terminating Type Antioxidant)

G5-1: octyl-3-(3,5-di-t-butyl-4-hydroxyphenyl)propionate

G5-2: alkyl diphenyl amine (alkyl group: mixture of butyl group and octyl group).

[NOx absorption test] For each lubricating oil composition of Examples 5-1 to 5-13, Examples 1-18 to 1-21 and Comparative Examples 5-1 to 5-4, NOx absorption test was carried out as described below.

Changes over time of the base number (hydrochloric acid method) and acid number were measured when NOx-containing gas was blown into test oil methods according to Proceedings of JAST Tribology Conference 1992, 10, 465, for forced degradation. The test temperature in the present test was 140° C., and the NOx concentration in the NOx-containing gas was 1185 ppm. The base numbers 16 hours after, 40 hours after, 64 hours after or 82 hours after starting blowing NOx gas and acid numbers 40 hours after, 64 hours after, 70 hours after or 82 hours after are shown in Tables 13 to 17. In the tables, a smaller decrease in the base number, or a smaller increase in the acid number, indicates a long drain oil with a higher base number maintenance capability and a longer usable time, even in the presence of NOx, such as used in internal combustion engines.

TABLE 13

| | | | Example 5-1 | Example 5-2 | Example 5-3 | Example 5-4 | Example 5-5 | Example 5-6 |
|---|---|---|---|---|---|---|---|---|
| Base oil [% by mass] | | Base oil 5-1 | Residue | — | Residue | — | Residue | — |
| | | Base oil 5-2 | — | Residue | — | Residue | — | Residue |
| Organic molybdenum compound [% by mass] (molybdenum content [% by mass]) | | A5-1 | 0.40 (0.02) | 0.40 (0.02) | — | — | — | — |
| | | A5-2 | — | — | 0.20 (0.02) | 0.20 (0.02) | — | — |
| | | A5-3 | — | — | — | — | 0.13 (0.02) | 0.13 (0.02) |
| Polycyclic aromatic compound [% by mass] | | B5-1 | 2.00 | 2.00 | 2.00 | 2.00 | 2.00 | 2.00 |
| | | B5-2 | — | — | — | — | — | — |
| Phosphorus compound [% by mass] (phosphorus content [% by mass]) | | C5-1 | 0.53 (0.07) | 0.53 (0.07) | 0.53 (0.07) | 0.53 (0.07) | 0.53 (0.07) | 0.53 (0.07) |
| Metallic detergent [% by mass] (metal content [% by mass]) | | D5-1 | 1.5 (0.18) | 1.5 (0.18) | 1.5 (0.18) | 1.5 (0.18) | 1.5 (0.18) | 1.5 (0.18) |
| Ashless dispersant [% by mass] | | E5-1 | 5.00 | 5.00 | 5.00 | 5.00 | 5.00 | 5.00 |
| Viscosity index improver [% by mass] | | F5-1 | 4.00 | 4.00 | 4.00 | 4.00 | 4.00 | 4.00 |
| Chain-terminating type antioxidant [% by mass] | | G5-1 | — | — | — | — | — | — |
| | | G5-2 | — | — | — | — | — | — |
| Molybdenum content [% by mass] | | | 0.02 | 0.02 | 0.02 | 0.02 | 0.02 | 0.02 |
| Phosphorus content [% by mass] | | | 0.07 | 0.07 | 0.07 | 0.07 | 0.07 | 0.07 |
| Sulfur content [% by mass] | | | 0.03 | 0.03 | 0.03 | 0.03 | 0.03 | 0.03 |
| NOx absorption test | Base number residual ratio [%] | 16 hours later | 20 | 20 | 58 | 55 | 34 | 34 |
| | | 40 hours later | 10 | 6 | 20 | 19 | 16 | 17 |
| | | 64 hours later | — | — | — | — | — | — |
| | | 82 hours later | — | — | — | — | — | — |

TABLE 13-continued

| | | | Example 5-1 | Example 5-2 | Example 5-3 | Example 5-4 | Example 5-5 | Example 5-6 |
|---|---|---|---|---|---|---|---|---|
| | Acid number [mgKOH/g] | 40 hours later | 2.1 | 1.9 | 2.0 | 1.5 | 2.2 | 1.7 |
| | | 64 hours later | — | — | — | — | — | — |
| | | 70 hours later | — | — | — | — | — | — |
| | | 82 hours later | — | — | — | — | — | — |

TABLE 14

| | | | Example 5-7 | Example 5-8 | Example 5-9 | Example 5-10 |
|---|---|---|---|---|---|---|
| Base oil [% by mass] | | Base oil 5-1 | — | — | — | — |
| | | Base oil 5-2 | Residue | Residue | Residue | Residue |
| Organic molybdenum compound [% by mass] | | A5-1 | — | — | — | — |
| (molybdenum content [% by mass]) | | A5-2 | 0.20 (0.02) | 0.20 (0.02) | 0.20 (0.02) | 0.20 (0.02) |
| | | A5-3 | — | — | — | — |
| Polycyclic aromatic compound [% by mass] | | B5-1 | 1.00 | 5.00 | 10.0 | 20.0 |
| | | B5-2 | — | — | — | — |
| Phosphorus compound [% by mass] (phosphorus content [% by mass]) | | C5-1 | 0.53 (0.07) | 0.53 (0.07) | 0.53 (0.07) | 0.53 (0.07) |
| Metallic detergent [% by mass] (metal content [% by mass]) | | D5-1 | 1.5 (0.18) | 1.5 (0.18) | 1.5 (0.18) | 1.5 (0.18) |
| Ashless dispersant [% by mass] | | E5-1 | 5.00 | 5.00 | 5.00 | 5.00 |
| Viscosity index improver [% by mass] | | F5-1 | 4.00 | 4.00 | 4.00 | 4.00 |
| Chain-terminating type antioxidant [% by mass] | | G5-1 | — | — | — | — |
| | | G5-2 | — | — | — | — |
| Molybdenum content [% by mass] | | | 0.02 | 0.02 | 0.02 | 0.02 |
| Phosphorus content [% by mass] | | | 0.07 | 0.07 | 0.07 | 0.07 |
| Sulfur content [% by mass] | | | 0.03 | 0.03 | 0.03 | 0.03 |
| NO*x* absorption test | Base number residual ratio [%] | 16 hours laler | 52 | 60 | 60 | 60 |
| | | 40 hours later | 18 | 22 | 22 | 22 |
| | | 64 hours later | — | — | — | — |
| | | 82 hours later | — | — | — | — |
| | Acid number [mg KOH/g] | 40 hours later | 2.3 | 1.1 | 1.1 | 1.1 |
| | | 64 hours later | — | — | — | — |
| | | 70 hours later | — | — | — | — |
| | | 82 hours later | — | — | — | — |

TABLE 15

| | | | Example 5-11 | Example 5-12 | Example 5-13 |
|---|---|---|---|---|---|
| Base oil [% by mass] | | Base oil 5-1 | — | Residue | Residue |
| | | Base oil 5-2 | Residue | — | — |
| Organic molybdenum compound [% by mass] | | A5-1 | — | — | — |
| (molybdenum content [% by mass]) | | A5-2 | 0.20 (0.02) | 0.20 (0.02) | 0.20 (0.02) |
| | | A5-3 | — | — | — |
| Polycyclic aromatic compound [% by mass] | | B5-1 | 1.00 | — | — |
| | | B5-2 | — | 0.1 | 0.5 |
| Phosphorus compound [% by mass] (phosphorus content [% by mass]) | | C5-1 | 0.53 (0.07) | 0.53 (0.07) | 0.53 (0.07) |
| Metallic detergent [% by mass] (metal content [% by mass]) | | D5-1 | 1.5 (0.18) | 1.5 (0.18) | 1.5 (0.18) |
| Ashless dispersant [% by mass] | | E5-1 | 5.00 | 5.00 | 5.00 |
| Viscosity index improver [% by mass] | | F5-1 | 4.00 | 4.00 | 4.00 |
| Chain-terminating type antioxidant [% by mass] | | G5-1 | 0.5 | — | — |
| | | G5-2 | 0.5 | — | — |
| Molybdenum content [% by mass] | | | 0.02 | 0.02 | 0.02 |
| Phosphorus content [% by mass] | | | 0.07 | 0.07 | 0.07 |
| Sulfur content [% by mass] | | | 0.03 | 0.03 | 0.03 |
| NO*x* absorption test | Base number residual ratio [%] | 16 hours later | — | — | — |
| | | 40 hours later | — | — | — |
| | | 64 hours later | — | — | 29 |
| | | 82 hours later | 15 | — | — |
| | Acid number [mgKOH/g] | 40 hours later | 1.0 | 5.3 | 1.6 |
| | | 64 hours later | — | — | 2.1 |
| | | 70 hours later | 1.2 | — | — |
| | | 82 hours later | 2.2 | — | — |

TABLE 16

| | | | Comp. Ex. 5-1 | Ex. 1-18 | Comp. Ex. 5-2 | Ex. 1-19 |
|---|---|---|---|---|---|---|
| Base oil [% by mass] | | Base oil 5-1 | Residue | — | Residue | — |
| | | Base oil 5-2 | — | Residue | — | Residue |
| Organic molybdenum compound [% by mass] | | A5-1 | 0.40 (0.02) | 0.40 (0.02) | — | — |
| (molybdenum content [% by mass]) | | A5-2 | — | — | 0.20 (0.02) | 0.20 (0.02) |
| | | A5-3 | — | — | — | — |
| Polycyclic aromatic compound [% by mass] | | B5-1 | — | — | — | — |
| | | B5-2 | — | — | — | — |
| Phosphorus compound [% by mass] (phosphorus content [% by mass]) | | C5-1 | 0.53 (0.07) | 0.53 (0.07) | 0.53 (0.07) | 0.53 (0.07) |
| Metallic detergent [% by mass] (metal content [% by mass]) | | D5-1 | 1.5 (0.18) | 1.5 (0.18) | 1.5 (0.18) | 1.5 (0.18) |
| Ashless dispersant [% mass] | | E5-1 | 5.00 | 5.00 | 5.00 | 5.00 |
| Viscosity index improver [% by mass] | | F5-1 | 4.00 | 4.00 | 4.00 | 4.00 |
| Chain-terminating type antioxidant [% by mass] | | G5-1 | — | — | — | — |
| | | G5-2 | — | — | — | — |
| Molybdenum content [% by mass] | | | 0.02 | 0.02 | 0.02 | 0.02 |
| Phosphorus content [% by mass] | | | 0.07 | 0.07 | 0.07 | 0.07 |
| Sulfur content [% by mass] | | | 0.05 | 0.05 | 0.03 | 0.03 |
| NOx absorption test | Base number residual ratio [%] | 16 hours later | 19 | 20 | 27 | 60 |
| | | 40 hours later | 0 | 0 | 0 | 14 |
| | | 64 hours later | — | — | — | — |
| | | 82 hours later | — | — | — | — |
| | Acid number [mg KOH/g] | 40 hours later | 17.3 | 5.1 | 18.0 | 6.8 |
| | | 64 hours later | — | — | — | — |
| | | 70 hours later | — | — | — | — |
| | | 82 hours later | — | — | — | — |

TABLE 17

| | | | Comp. Ex. 5-3 | Ex. 1-20 | Comp. Ex. 5-4 | Ex. 1-20 |
|---|---|---|---|---|---|---|
| Base oil [% by mass] | | Base oil 5-1 | Residue | — | Residue | — |
| | | Base oil 5-2 | — | Residue | — | Residue |
| Organic molybdenum compound [% by mass] | | A5-1 | — | — | — | — |
| (molybdenum content [% by mass]) | | A5-2 | — | — | — | 0.20 (0.02) |
| | | A5-3 | 0.13 | 0.13 (0.02) | — (0.02) | — |
| Polycyclic aromatic compound [% by mass] | | B5-1 | — | — | 5.00 | — |
| | | B5-2 | — | — | — | — |
| Phosphorus compound [% by mass] (phosphorus content [% by mass]) | | C5-1 | 0.53 (0.07) | 0.53 (0.07) | 0.53 (0.07) | 0.53 (0.07) |
| Metallic detergent [% by mass] (metal content [% by mass]) | | D5-1 | 1.5 (0.18) | 1.5 (0.18) | 1.5 (0.18) | 1.5 (0.18) |
| Ashless dispersant [% by mass] | | E5-1 | 5.00 | 5.00 | 5.00 | 5.00 |
| Viscosity index improver [% by mass] | | F5-1 | 4.00 | 4.00 | 4.00 | 4.00 |
| Chain-terminating type antioxidant [% by mass] | | G5-1 | — | — | — | — |
| | | G5-2 | — | — | — | — |
| Molybdenum content [% by mass] | | | 0.02 | 0.02 | 0.00 | 0.02 |
| Phosphorus content [% by mass] | | | 0.07 | 0.07 | 0.07 | 0.07 |
| Sulfur content [% by mass] | | | 0.03 | 0.03 | 0.03 | 0.03 |
| NOx absorption test | Base number residual ratio [%] | 16 hours later | 32 | 33 | 31 | — |
| | | 40 hours later | 14 | 14 | 13 | — |
| | | 64 hours later | — | — | — | — |
| | | 82 hours later | — | — | — | 0 |

TABLE 17-continued

| | | Comp. Ex. 5-3 | Ex. 1-20 | Comp. Ex. 5-4 | Ex. 1-20 |
|---|---|---|---|---|---|
| Acid number [mgKOH/g] | 40 hours later | 18.8 | 7.8 | 18 | 1.5 |
| | 64 hours later | — | — | — | — |
| | 70 hours later | — | — | — | 6.6 |
| | 82 hours later | — | — | — | 13.2 |

[Test for evaluating compatibility with respect to emission gas after-treatment device] With respect to a diesel fuel having a sulfur content of 1 mass ppm or less, 0.1% by mass of the lubricating oil composition of Example 5-4 was added to prepare a test fuel. Using this test fuel and the lubricating oil composition of Example 5-4 as engine oil, under the conditions of 2400 rpm rotation speed, ½ charge and 100 hours driving time, a single cylinder general purpose diesel engine fitted with an external regeneration type DPF was driven, and compatibility of the lubricating oil composition with respect to DPF was evaluated.

In addition, as a comparative test, a similar test to above was carried out, using a test fuel [resulting] from the addition of 0.1% by mass of a lubricating oil composition (Example 1-22; sulfur content: 0.2% by mass; phosphorus content: 0.07% by mass), in which the C5-1 constituent in the lubricating oil composition of Examples 1-18 has been replaced with ZDTP, with respect to a diesel fuel having a sulfur content of 1 mass ppm or less, and the lubricating oil composition of Examples 1-22 as engine oil.

In the above test, when the lubricating oil composition of Example Examples 1-22 was used, a tendency of the DPF to clog was observed. This tendency of the DPF to clog is thought to originate from the generation of $CaSO_4$. On the other hand, when the lubricating oil composition of Examples 54 was used, the obstruction of DPF was improved compared to when the lubricating oil composition of Example 1-22 was used, and at the same time, regeneration of DPF after the drive was found to be easy.

Examples 6-1 to 6-5, Examples 1-23 and Comparative Examples 6-1 to 6-3

In Examples 6-1 to 6-5, Examples 1-23 and Comparative Examples 6-1 to 6-3, using the lubricating base oils and additives respectively shown below, lubricating oil compositions having the compositions shown in Tables 18 and 19 were prepared. The sulfur contents, the phosphorus contents and the molybdenum contents (all values in terms of element) of the lubricating oil composition obtained in each example or comparative example are shown together in Table 18 and 19.

(Base Oils)

Base Oil 6-1: poly α-olefin (kinematic viscosity at 100° C.: 6.0 $mm^2/s$; polycyclic aromatic content: less than 0.001% by mass; total aromatic content: less than 0.1% by mass; sulfur content: less than 0.01% by mass)

Base Oil 6-2: hydrocracked mineral oil (kinematic viscosity at 100° C.: 5.3 $mm^2/s$; viscosity index: 120; polycyclic aromatic content: 0.04% by mass; total aromatic content: 5.0% by mass; sulfur content: less than 0.01% by mass)

(Organic Molybdenum Compound)

A6-1: ditridecyl amine complex of molybdenum (molybdenum content: 9.7% by mass; sulfur content: 0% by mass)

(Aromatic Compounds Represented by General Formula (1))

B6-1: 4-octyl phenol (molecular weight: 178)

B6-2: hexadecyl phenol (molecular weight: 318)

B6-3: hexadecyl catechol (molecular weight: 334)

B6-4: 4-octyl aniline (molecular weight: 179)

(Phosphorus-Containing Additive)

C6-1: zinc di-n-butyl phosphate (phosphorus content: 13.2% by mass; sulfur content: 0% by mass; zinc content: 13% by mass)

(Metallic Detergent)

D6-1: calcium sulfonate (base number: 300 mg KOH/g; calcium content: 11.9% by mass; sulfur content: 1.7% by mass; metal ratio: 10)

(Ashless Dispersant)

E6-1: mixture (mass ratio: 1:4) of polybutenyl succinimide (number average molecular weight of poly butenyl group: 1300; nitrogen content: 1.8% by mass) and boronated product thereof (boron content 0.77% by mass).

Hereinafter, the following tests were carried out using each lubricating oil composition of Examples 6-1 to 6-5, Examples 1-23 and Comparative Example 6-1 to 6-3.

[NOx absorption test] Changes over time of the base number (hydrochloric acid method) and acid number were measured when NOx-containing gas was blown into test oil methods according to Proceedings of JAST Tribology Conference 1992, 10, 465, for forced degradation. The test temperature in the present test was 140° C., and the NOx concentration in the NOx-containing gas was 1185 ppm. The base numbers and acid numbers 40 hours after starting blowing NOx gas are shown in Tables 18 and 19. In the tables, a smaller decrease in the base number, or a smaller increase in the acid number, indicates a long drain oil with a higher base number maintenance capability and a longer usable time, even in the presence of NOx, such as used in internal combustion engines.

TABLE 18

| | | Example 6-1 | Example 6-2 | Example 6-3 | Example 6-4 | Example 6-5 |
|---|---|---|---|---|---|---|
| Base oil [% by mass] | Base Oil 6-1 | Residue | — | — | — | — |
| | Base oil 6-2 | — | Residue | Residue | Residue | Residue |

TABLE 18-continued

| | | | Example 6-1 | Example 6-2 | Example 6-3 | Example 6-4 | Example 6-5 |
|---|---|---|---|---|---|---|---|
| Organic molybdenum compound [% by mass] (molybdenum content [% by mass]) | | A6-1 | 0.2 (0.02) | 0.2 (0.02) | 0.2 (0.02) | 0.2 (0.02) | 0.2 (0.02) |
| Aromatic compound represented by General Formula (1) [% by mass] | | B6-1 | 0.5 | 0.5 | — | — | — |
| | | B6-2 | — | — | 0.5 | — | — |
| | | B6-3 | — | — | — | 0.5 | — |
| | | B6-4 | — | — | — | — | 0.5 |
| Phosphorus compound [% by mass] (phosphorus content [% by mass]) | | C6-1 | 0.5 (0.07) | 0.5 (0.07) | 0.5 (0.07) | 0.5 (0.07) | 0.5 (0.07) |
| Metallic detergent [% by mass] (metal content [% by mass]) | | D6-1 | 1.5 (0.18) | 1.5 (0.18) | 1.5 (0.18) | 1.5 (0.18) | 1.5 (0.18) |
| Ashless dispersant [% by mass] | | E6-1 | 5.0 | 5.0 | 5.0 | 5.0 | 5.0 |
| Molybdenum content [% by mass] | | | 0.02 | 0.02 | 0.02 | 0.02 | 0.02 |
| Phosphorus content [% by mass] | | | 0.07 | 0.07 | 0.07 | 0.07 | 0.07 |
| Sulfur content [% by mass] | | | 0.03 | 0.03 | 0.03 | 0.03 | 0.03 |
| NOx absorption test | Base number residual ratio [%] | 40 hours later | 39 | 30 | 35 | 40 | 33 |
| | Acid number [mgKOH/g] | 40 hours later | 0.9 | 1.4 | 1.5 | 1.2 | 1.3 |

TABLE 19

| | | | Comp. Ex. 6-1 | Ex. 1-23 | Comp. Ex. 6-2 | Comp. Ex. 6-3 |
|---|---|---|---|---|---|---|
| Base oil [% by mass] | | Base oil 6-1 | Residue | — | Residue | — |
| | | Base oil 6-2 | — | Residue | — | Residue |
| Organic molybdenum compound [% by mass] (molybdenum content [% by mass]) | | A6-1 | 0.2 (0.02) | 0.2 (0.02) | — (0.00) | — (0.00) |
| Aromatic compound represented by General Formula (1) [% by mass] | | B6-1 | — | — | 0.5 | 0.5 |
| | | B6-2 | — | — | — | — |
| | | B6-3 | — | — | — | — |
| | | B6-4 | — | — | — | — |
| Phosphorus compound [% by mass] (phosphorus content [% by mass]) | | C6-1 | 0.5 (0.07) | 0.5 (0.07) | 0.5 (0.07) | 0.5 (0.07) |
| Metallic detergent [% by mass] (metal content [% by mass]) | | D6-1 | 1.5 (0.18) | 1.5 (0.18) | 1.5 (0.18) | 1.5 (0.18) |
| Ashless dispersant [% by mass] | | E6-1 | 5.0 | 5.0 | 5.0 | 5.0 |
| Molybdenum content [% by mass] | | | 0.02 | 0.02 | 0.00 | 0.00 |
| Phosphorus content [% by mass] | | | 0.07 | 0.07 | 0.07 | 0.07 |
| Sulfur content [% by mass] | | | 0.03 | 0.03 | 0.03 | 0.03 |
| NOx absorption test | Base number residual ratio [%] | 40 hours later | 7 | 13 | less than 1 | less than 1 |
| | Acid number [mgKOH/g] | 40 hours later | 17 | 8 | 23.4 | 20.8 |

The invention claimed is:

1. A lubricating oil composition, comprising:

a lubricating base oil comprising a polycyclic aromatic content of 0.01% by mass or more based on the total amount of base oil; and an organic molybdenum compound, which is soluable in the lubricating base oil, does not contain sulfur as a constitutive element, and is selected from molybdenum-amine complexes, wherein amine compounds constituting the molybdenum-amine complexes are chosen from monoamines, diamines, polyamines, and alkanol amines, and wherein the number of carbons of the hydrocarbon group on the amine compounds constituting the molybdenum-amine complexes is four or greater.

2. The lubricating oil composition according to claim 1, wherein the lubricating base oil has a polycyclic aromatic content of 0.01 to 5% by mass based on the total amount of base oil.

3. The lubricating oil composition according to claim 1, wherein a monocyclic aromatic content of the lubricating base oil based on the total amount of the base oil is 35% by mass or less.

4. The lubricating oil composition according to claim 1, wherein the total aromatic content of the lubricating base oil based on the total amount of the base oil is 40% by mass or less.

5. The lubricating oil composition according to claim 1, wherein the kinematic viscosity of the lubricating base oil at 100° C. is 1 to 20 $mm^2/s$.

6. The lubricating oil composition according to claim 1, wherein the viscosity index of the lubricating base oil is 80 to 100.

7. The lubricating oil composition according to claim 1, wherein the NOACK evaporation amount of the lubricating base oil is 20% by mass or less.

8. The lubricating oil composition according to claim 1, wherein the content of the organic molybdenum compound in terms of molybdenum element based on the total amount of the composition is 10 to 1000 mass ppm.

9. A lubricating oil composition, comprising an antioxidant composition, wherein the antioxidant composition comprises:

a first lubricating base oil having a total aromatic content of 20 to 100% by mass and an organic molybdenum compound, which is soluble in the first lubrication base oil, does not contain sulfur as a constitutive element, and is selected from molybdenum-amine complexes, wherein amine compounds constituting the molybdenum-amine complexes are chosen from monoamines, diamines, polyamines, and alkanol amines.

10. The lubricating oil composition according to claim 9, wherein the content of the organic molybdenum compound in terms of molybdenum element based on the total amount of the antioxidant composition is 0.1 to 20% by mass or less.

11. The lubricating oil composition according to claim 9, wherein the first lubricating base oil is a mineral oil, and the total aromatic content of the mineral oil is 25 to 45% by mass.

12. The lubricating oil composition according to claim 11, wherein the sulfur content of the mineral oil is 0.05% by mass or greater.

13. The lubricating oil composition according to claim 9, wherein the kinematic viscosity at 100° C. of the first lubricating base oil is 4 to 50 $mm^2/s$.

14. The lubricating oil composition according to claim 9, wherein the viscosity index of the first lubricating base oil is 50 to 120.

15. The lubricating oil composition according to claim 9, wherein the NOACK evaporation amount of the first lubricating base oil is 25% by mass or less.

16. The lubricating oil composition according to claim 9, wherein the content of the organic molybdenum compound in terms of molybdenum element based on the total amount of the antioxidant composition is 10 to 1000 mass ppm.

17. The lubricating oil composition according to claim 9, further comprising a second lubricating base oil having a total aromatic content of less than 20% by mass based on the total amount of the second lubricating base oil.

18. The lubricating oil composition according to claim 17, wherein the second lubricating base oil is a mineral oil.

19. The lubricating oil composition according to claim 18, wherein the total aromatic content of the mineral oil is 0.1 to 10% by mass.

20. The lubricating oil composition according to claim 19, wherein the polycyclic aromatic content of the mineral oil is 0.01 to 2% by mass.

21. The lubricating oil composition according to claim 17, wherein the kinematic viscosity at 100° C. of the second lubricating base oil is 1 to 20 $mm^2/s$.

22. The lubricating oil composition according to claim 17, wherein the viscosity index of the second lubricating base oil is 80 or greater.

23. The lubricating oil composition according to claim 17, wherein the NOACK evaporation amount of the second lubricating base oil is 20% by mass or less.

24. The lubricating oil composition according to claim 9, wherein the proportion of the first lubricating base oil based on the total amount of the lubricating oil composition is 0.5 to 90% by mass.

25. The lubricating oil composition according to claim 9, wherein the first lubricating base oil is a mineral oil having a sulfur content of 0.2% or greater by mass, and the proportion of the first lubricating base oil based on the total amount of the lubricating oil composition is 0.1 to 10% by mass.

26. A lubricating oil composition, comprising:

a first lubricating base oil comprising a total aromatic content of 20 to 100% by by mass;

a second lubricating base oil comprising a total aromatic content of 10% by mass or less; and an organic molybdenum compound, which is soluble in the first lubricating base oil, does not contain sulfur as a constitutive element, and is selected from molybdenum-amine complexes, wherein amine compounds constituting the molybdenum-amine complexes are chosen from monoamines, diamines, polyamines, and alkanol amines, wherein the proportion of the first lubricating base oil in the total amount of the first and second lubricating base oils is 1% by mass or more.

27. The lubricating oil composition according to claim 26, wherein the proportion of the first lubricating base oil in the total amount of the first and second lubricating base oils is 5 to 90% by mass.

28. The lubricating oil composition according to claim 26, wherein the first lubricating base oil is a mineral oil having a sulfur content of 0.2% by mass or more, and the proportion of the first lubricating base oil in the total amount of the first and second lubricating base oils is 10 to 60% by mass.

29. The lubricating oil composition according to claim 26, wherein the total aromatic content after mixing the first and second lubricating base oils based on the total amount of mixed base oil is 1 to 30% by mass.

30. The lubricating oil composition according to claim 26, wherein the polycyclic aromatic content after mixing the first and second lubricating base oils based on the total amount of mixed base oil is 0.01 to 10% by mass.

31. The lubricating oil composition according to claim 26, wherein the monocyclic aromatic content after mixing the first and second lubricating base oils based on the total amount of mixed base oil is 30% by mass or less.

32. The lubricating oil composition according to claim 26, wherein the kinematic viscosity at 100° C. of the mixed base oil of the first and second lubricating base oils is 3 to 20 $mm^2/s$.

33. The lubricating oil composition according to claim 26, wherein the viscosity index of the mixed base oil of the first and second lubricating base oils is 80 or greater.

34. The lubricating oil composition according to claim 26, wherein the NOACK evaporation amount of the mixed base oil of the first and second lubricating base oils is 20% by mass or less.

35. The lubricating oil composition according to claim 26, wherein the content of the organic molybdenum compound in terms of molybdenum element based on the total amount of the lubricating oil composition is 10 to 1000 mass ppm.

36. A lubricating oil composition, comprising:

a lubricating base oil; and an antioxidant composition, wherein the antioxidant composition comprises an aromatic solvent; and an organic molybdenum compound, which is soluble in the lubricating base oil, does not contain sulfur as a constitutive element, and is selected from molybdenum-amine complexes, wherein amine compounds constituting the molybdenum-amine complexes are chosen from monoamines, diamines, polyamines, and alkanol amines.

37. The lubricating oil composition according to claim 36, wherein the content of the organic molybdenum compound in terms of molybdenum element based on the total amount of the antioxidant composition is 0.1 to 20% by mass.

38. The lubricating oil composition according to claim 36, wherein the lubricating base oil is chosen from mineral base oils having a total aromatic content of 10% by mass or less, poly-α-olefins or hydrogenated compounds thereof, and ester-type base oils.

39. The lubricating oil composition according to claim 36, wherein the content of the organic molybdenum compound in terms of molybdenum element based on the total amount of the antioxidant composition is 10 to 1000 mass ppm.

40. A lubricating oil composition, comprising:

at least one species of polycyclic aromatic compounds selected from alkyl naphthalenes and compounds having three or more aromatic rings;

a lubricating base oil; and an organic molybdenum compound, which is soluble in the lubricating base oil, does not contain sulfur as a constitutive element, and is selected from molybdenum-amine complexes, wherein amine compounds constituting the molybdenum-amine complexes are chosen from monoamines, diamines, polyamines, and alakanol amines, and wherein the number of carbons of the hydrocarbon group on the amine compounds constituting the molybdenum-amine complexes is four or greater.

41. The lubricating oil composition according to claim 40, wherein the at least one species of polycyclic aromatic compounds is chosen from alkyl naphthalene, fluorene, phenanthrene, benzophenanthrene, anthracene, and alkylation products thereof.

42. The lubricating oil composition according to claim 40, wherein the content of the at least one species of polycyclic aromatic compounds based on the total amount of the composition is 0.01 to 50% by mass.

43. The lubricating oil composition according to claim 40, wherein the mixing quantity of the at least one species of polycyclic aromatic compounds with respect to 100 parts in mass of the lubricating base oil is 0.01 to 50 parts in mass.

44. The lubricating oil composition according to claim 40, wherein the content of the organic molybdenum compound in terms of molybdenum element based on the total amount of the lubricating oil composition is 10 to 1000 mass ppm.

* * * * *